United States Patent [19]

Saitoh et al.

[11] Patent Number: 4,696,883

[45] Date of Patent: Sep. 29, 1987

[54] MEMBER HAVING LIGHT RECEIVING LAYER WITH SMOOTHLY CONNECTED NON-PARALLEL INTERFACES AND SURFACE REFLECTIVE LAYER

[75] Inventors: Keishi Saitoh, Ibaraki; Tetsuo Sueda, Chofu; Kyosuke Ogawa, Tokyo; Teruo Misumi, Kawasaki; Yoshio Tsuezuki, Toride; Masahiro Kanai, Tokyo, all of Japan

[73] Assignee: Canon Kabushiki Kaisha, Tokyo, Japan

[21] Appl. No.: 753,048

[22] Filed: Jul. 8, 1985

[30] Foreign Application Priority Data

| | | | |
|---|---|---|---|
| Jul. 9, 1984 | [JP] | Japan | 59-140723 |
| Jul. 10, 1984 | [JP] | Japan | 59-141305 |
| Jul. 11, 1984 | [JP] | Japan | 59-142122 |
| Jul. 13, 1984 | [JP] | Japan | 59-144388 |
| Jul. 16, 1984 | [JP] | Japan | 59-146111 |
| Jul. 17, 1984 | [JP] | Japan | 59-146969 |
| Jul. 18, 1984 | [JP] | Japan | 59-150188 |
| Jul. 19, 1984 | [JP] | Japan | 59-148649 |
| Jul. 20, 1984 | [JP] | Japan | 59-149658 |
| Oct. 23, 1984 | [JP] | Japan | 59-221258 |
| Oct. 24, 1984 | [JP] | Japan | 59-222226 |
| Oct. 25, 1984 | [JP] | Japan | 59-223020 |
| Oct. 26, 1984 | [JP] | Japan | 59-224039 |
| Oct. 27, 1984 | [JP] | Japan | 59-225108 |
| Oct. 29, 1984 | [JP] | Japan | 59-225984 |

[51] Int. Cl.[4] ..... G03G 5/085

[52] U.S. Cl. ..... 430/57; 430/65; 430/128

[58] Field of Search ..... 430/56, 57, 58, 65, 430/69, 84, 127

[56] References Cited

U.S. PATENT DOCUMENTS

| | | | |
|---|---|---|---|
| 4,359,514 | 11/1982 | Shimizu et al. | 430/65 |
| 4,492,745 | 1/1985 | Minnura et al. | 430/67 |
| 4,514,483 | 4/1985 | Matsuura et al. | 430/84 |
| 4,592,981 | 6/1986 | Saitoh et al. | 430/69 |
| 4,592,983 | 6/1986 | Saitoh et al. | 430/69 |
| 4,595,644 | 6/1986 | Saitoh et al. | 430/69 |
| 4,600,671 | 7/1986 | Saitoh et al. | 430/69 |

FOREIGN PATENT DOCUMENTS

| | | | |
|---|---|---|---|
| 2733187 | 1/1978 | Fed. Rep. of Germany | 430/65 |
| 56-150754 | 11/1981 | Japan | 430/65 |
| 60-31144 | 2/1985 | Japan | 430/69 |

*Primary Examiner*—John L. Goodrow

*Attorney, Agent, or Firm*—Fitzpatrick, Cella, Harper & Scinto

[57] ABSTRACT

A light-receiving member comprises a substrate and a light-receiving layer of a multi-layer structure having at least one photosensitive layer and a surface layer having reflection preventive function provided successively from the substrate side; said light-receiving layer having at least one pair of non-parallel interfaces within a short range and said non-parallel interfaces being arranged in a large number in at least one direction within the plane perpendicular to the layer thickness direction; said non-parallel interfaces being connected to one another smoothly in the direction in which they are arranged.

94 Claims, 88 Drawing Figures

MEMBER HAVING LIGHT RECEIVING LAYER WITH SMOOTHLY CONNECTED NON-PARALLEL INTERFACES AND SURFACE REFLECTIVE LAYER

CROSS-REFERENCE TO RELATED APPLICATIONS

This application contains sugject matter related to commonly assigned, copending application Ser. Nos. 697,141; 699,868; 705,516; 709,888; 720,011; 740,901; 786,970; 725,751; 726,768, 719,980; 739,867, 740,714; 741,300; 753,048; 752,920 and 753,011.

BACKGROUND OF THE INVENTION

1. Field of the invention

This invention relates to a light-receiving member having sensitivity to electromagnetic waves such as light [herein used in a broad sense, including ultraviolet rays, visible light, infrared rays, X-rays and gamma-rays]. More particularly, it pertains to a light-receiving member suitable for using a coherent light such as laser beam.

2. Description of the prior art

As the method for recording a digital image information as an image, there have been well known the methods in which an electrostatic latent image is formed by scanning optically a light-receiving member with a laser beam modulated corresponding to a digital image information, then said latent image is developed, followed by processing such as transfer or fixing, if desired, to record an image. Among them, in the image forming method employing electrophotography, image recording has been generally practiced with the use of a small size and inexpensive He-Ne laser or a semiconductor laser (generally having an emitted wavelength of 650–820 nm).

In particular, as the light receiving member for electrophotography which is suitable when using a semiconductor laser, an amorphous material containing silicon atoms (hereinafter written briefly as "A-Si") as disclosed in Japanese Laid-open patent application Nos. 86341/1979 and 83746/1981 is attracting attention for its high Vickers hardness and non-polluting properties in social aspect in addition to the advantage of being by far superior in matching in its photosensitive region as compared with other kinds of light-receiving members.

However, when the photosensitive layer is made of a single A-Si layer, for ensuring dark resistance of $10^{12}$ ohm.cm or higher required for electrophotography while maintaining high photosensitivity, it is necessary to incorporate structurally hydrogen atoms or halogen atoms or boron atoms in addition thereto in controlled form within specific ranges of amounts. Accordingly, control of layer formation is required to be performed severely, whereby tolerance in designing of a light-receiving member is considerably limited.

As attempts to enlarge this tolerance in designing, namely to enable effective utilization of its high photosensitivity in spite of somewhat lower dark resistance, there have been proposed a light-receiving layer with a multi-layer structure of two or more laminated layers with different conductivity characteristics with formation of a depletion layer within the light-receiving layer, as disclosed in Japanese Laid-open patent application Nos. 121743/1979, 4053/1982 and 4172/1982, or a light receiving member with a multi-layer structure in which a barrier layer is provided between the substrate and the photosensitive layer and/or on the upper surface of the photosensitive layer, thereby enhancing apparent dark resistance of the light receiving layer as a whole, as disclosed in Japanese Laid-open patent application Nos. 52178/1982, 52179/1982, 52180/1982, 58159/1982, 58160/1982 and 58161/1982.

According to such proposals, A-Si type light-receiving members have been greatly advanced in tolerance in designing of commercialization thereof or easiness in management of its production and productivity, and the speed of development toward commercialization is now further accelerated.

When carrying out laser recording by use of such a light receiving member having a light-receiving layer of a multi-layer structure, due to irregularity in thickness of respective layers, and also because of the laser beam which is an coherent monochromatic light, it is possible that the respective reflected lights reflected from the free surface on the laser irradiation side of the light receiving layer and the layer interface between the respective layers constituting the light-receiving layer and between the substrate and the light-receiving layer (hereinafter "interface" is used to mean comprehensively both the free surface and the layer interface) may undergo interference.

Such an interference phenomenon results in the so-called interference fringe pattern in the visible image formed and causes a poor iamge. In particular, in the case of forming a medium tone image with high gradation, bad appearance of the image will become marked.

Moreover, as the wavelength region of the semiconductor laser beam is shifted toward longer wavelength, absorption of said laser beam in the photosensitive layer becomes reduced, whereby the above interference phenomenon becomes more marked.

This point is explained by referring to the drawings.

FIG. 1 shows a light $I_0$ entering a certain layer constituting the light receiving layer of a light receiving member, a reflected light $R_1$ from the upper interface 102 and a reflected light $R_2$ reflected from the lower interface 101.

Now, the average thickness of the layer is defined as d, its refractive index as n and the wavelength of the light as $\lambda$, and when the layer thickness of a certain layer is uniform gently with a layer thickness difference of $\lambda/2n$ or more, changes in absorbed light quantity and transmitted light quantity occur depending on to which condition of $2nd=m\lambda$ (m is an integer, reflected lights are strengthened with each other) and $2nd=(m+\frac{1}{2})\lambda$ (m is an integer, reflected lights are weakened with each other) the reflected lights $R_1$ and $R_2$ conform.

In the light receiving member of a multi-layer structure, the interference effect as shown in FIG. 1 occurs at each layer, and there ensues a synergistic deleterious influence through respective interferences as shown in FIG. 2. For this reason, the interference fringe corresponding to said interference fringe pattern appears on the visible image transferred and fixed on the transfer member to cause bad images.

As the method for cancelling such an inconvenience, it has been proposed to subject the surface of the substrate to diamond cutting to provide unevenness of ±500 Å–±10000 Å, thereby forming a light scattering surface (as disclosed in Japanese Laid-open patent application No. 162975/1983); to provide a light absorbing layer by subjecting the aluminum substrate surface to black Alumite treatment or dispersing carbon, color pigment or dye in a resin (as disclosed in Japanese Laid-open patent application No. 165845/1982); and to provide a light scattering reflection preventive layer on the substrate surface by subjecting the aluminum substrate surface to satin-like Alumite treatment or by providing a sandy fine unevenness by sand blast (as disclosed in Japanese Laid-open patent application No. 16554/1982).

However, according to these methods of the prior art, the interference fringe pattern appearing on the image could not completely be cancelled.

For example, because only a large number of unevenness with specific sized are formed on the substrate surface according to the first method, although prevention of appearance of interference fringe through light scattering is indeed effected, regular reflection light component yet exists. Therefore, in addition to remaining of the interference fringe by said regular reflection light, enlargement of irradiated spot occurs due to the light scattering effect on the surface of the substrate to be a cause for substantial lowering of resolution.

As for the second method, such a black Alumite treatment is not sufficinent for complete absorption, but reflected light from the substrate surface remains. Also, there are involved various inconveniences. For example, in providing a resin layer containing a color pigment dispersed therein, a phenomenon of degassing from the resin layer occurs during formation of the A-Si photosensitive layer to markedly lower the layer quality of the photosensitive layer formed, and the resin layer suffers from a damage by the plasma during formation of A-Si photosensitive layer to be deteriorated in its inherent absorbing function. Besides, worsening of the surface state deleteriously affects subsequent formation of the A-Si photosensitive layer.

In the case of the third method of irregularly roughening the substrate surface, as shown in FIG. 3, for example, the incident light $I_0$ is partly reflected from the surface of the light receiving layer 302 to become a reflected light $R_1$, with the remainder progressing internally through the light receiving layer 302 to become a transmitted light $I_1$. The transmitted light $I_1$ is partly scattered on the surface of the substrate 301 to become scattered lights $K_1$, $K_2$, $K_3 \ldots K_n$, with the remainder being regularly reflected to become a reflected light $R_2$, a part of which goes outside as an emitted light $R_3$. Thus, since the reflected light $R_1$ and the emitted light $R_3$ which is an interferable component remain, it is not yet possible to extinguish the interference fringe pattern.

On the other hand, if diffusibility of the surface of the substrate 301 is increased in order to prevent multiple reflections within the light receiving layer 302 through prevention of interference, light will be diffused within the light receiving layer 302 to cause halation, whereby resolution is disadvantageously lowered.

Particularly, in a light receiving member of a multi-layer structure, as shown in FIG. 4, even if the surface of the substrate 401 may be irregularly roughened, the reflected light $R_2$ from the first layer 402, the reflected light $R_1$ from the second layer 403 and the regularly reflected light $R_3$ from the surface of the substrate 401 are interfered with each other to form an interference fringe pattern depending on the respective layer thicknesses of the light receiving member. Accordingly, in a light receiving member of a multi-layer structure, it was impossible to completely prevent appearance of interference fringes by irregularly roughening the surface of the substrate 401.

In the case of irregularly roughening the substrate surface according to the method such as sand blasting, etc., the roughness will vary so much from lot to lot, and there is also nonuniformity in roughness even in the same lot, and therefore production control could be done with inconvenience. In addition, relatively large projections with random distributions are frequently formed, hence causing local breakdown of the light receiving layer during charging treatment.

On the other hand, in the case of simply roughening the surface of the substrate 501 regularly, as shown in FIG. 5, since the light-receiving layer 502 is deposited along the uneven shape of the surface of the substrate 501, the slanted plane of the unevenness of the substrate 501 becomes parallel to the slanted plane of the unevenness of the light receiving layer 502.

Accordingly, for the incident light on that portion, $2nd_1=m\lambda$ or $2nd_1=(m+\frac{1}{2})\lambda$ holds, to make it a light portion or a dark portion. Also, in the light receiving layer as a whole, since there is nonuniformity in which the maximum difference among the layer thickness $d_1$, $d_2$, $d_3$ and $d_4$ of the light receiving layer is $\lambda/2n$ or more, there appears a light and dark fringe pattern.

Thus, it is impossible to completely extinguish the interference fringe pattern by only roughening regularly the surface of the substrate 501.

Also, in the case of depositing a light receiving layer of a multi-layer structure on the substrate, the surface of which is regularly roughened, in addition to the interference between the regularly reflected light from the substrate surface and the reflected light from the light receiving layer surface as explained for light receiving member of a single layer structure in FIG. 3, interferences by the reflected lights from the interfaces between the respective layers participate to make the extent of appearance of interferance fringe pattern more complicated than in the case of the light receiving member of a single layer structure.

SUMMARY OF THE INVENTION

An object of the present invention is to provide a novel light-receiving member sensitive to light, which has cancelled the drawbacks as described above.

Another object of the present invention is to provide a light-receiving member which is suitable for image formation by use of a coherent monochromatic light and also easy in production management.

Still another object of the present invention is to provide a light-receiving member which can cancel the interference fringe pattern appearing during image formation and appearance of speckles on reversal developing at the same time and completely.

Still another object of the present invention is to provide a light-receiving member which is high in dielectric strength and photosensitivity and excellent in electrophotographic characteristics.

Still another object of the present invention is to provide a light-receiving member which can provide an image of high quality which is high in density, clear in halftone and high in resolution and is suitable for electrophotography.

Yet another object of the present invention is to provide a light-receiving member which can reduce the light reflection from the surface thereof and efficiently utilize the incident light. According to one aspect of the present invention, there is provided a light receiving member comprising a substrate and a light-receiving layer of a multi-layer structure having at least one photosensitive layer and a surface layer having the reflection preventive function provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

According to another aspect of the present invention, there is provided a light-receiving member comprising a substrate; and a light-receiving layer of a multilayer structure having a first layer comprising an amorphous material containing silicon atoms and germanium atoms, a second layer comprising an amorphous material containing silicon atoms and exhibiting photoconductivity and a surface layer having the reflection preventive function provided successively from the substrate side, said lihgt-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

DESCRIPTION OF THE PREFERRED EMBODIMENTS

Figure 1:
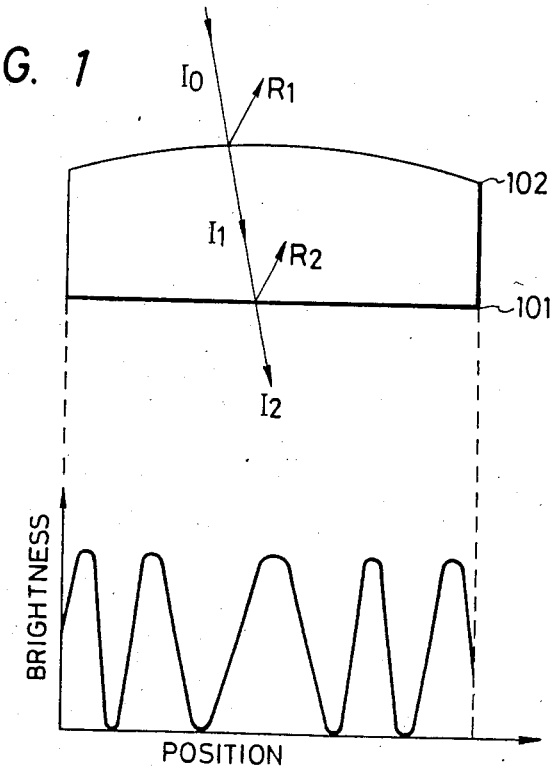
FIG. 1 is a schematic illustration of interference fringe in general.
Figure 2:
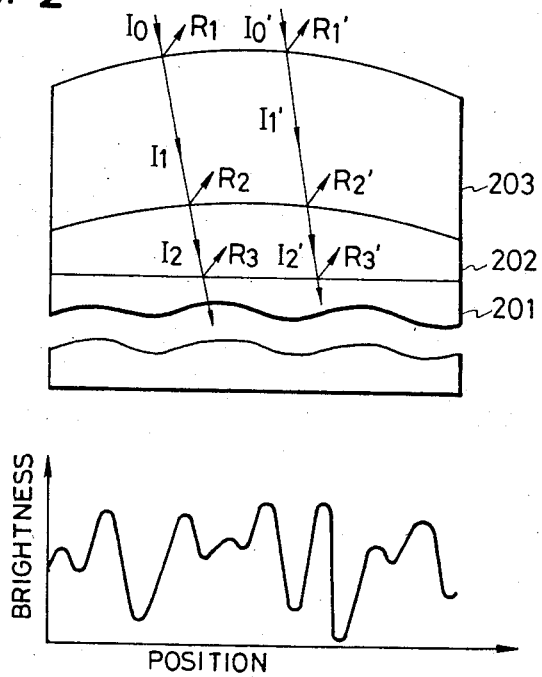
FIG. 2 is a schematic illustration of appearance of interference fringe in the case of a multi-layer light-receiving member.
Figure 3:
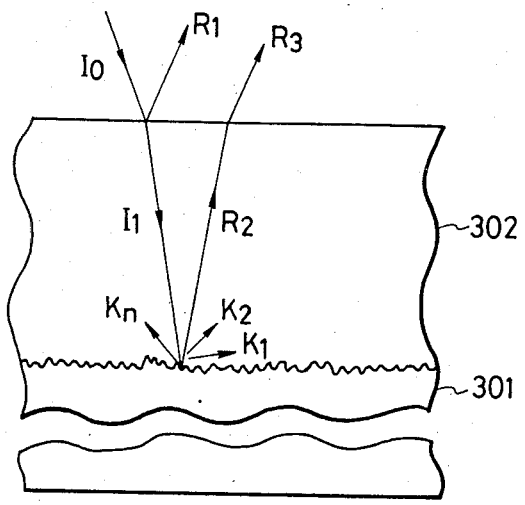
FIG. 3 is a schematic illustration of appearance of interference fringe by scattered light.
Figure 4:
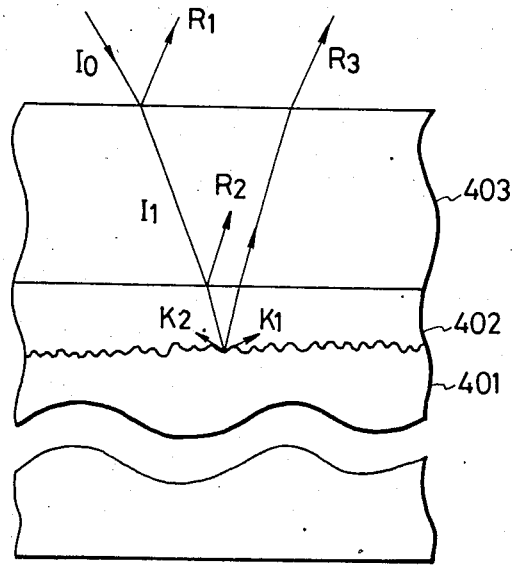
FIG. 4 is a schematic illustration of appearance of interference fringe by scattered light in the case of a multi-layer light-receiving member.
Figure 5:
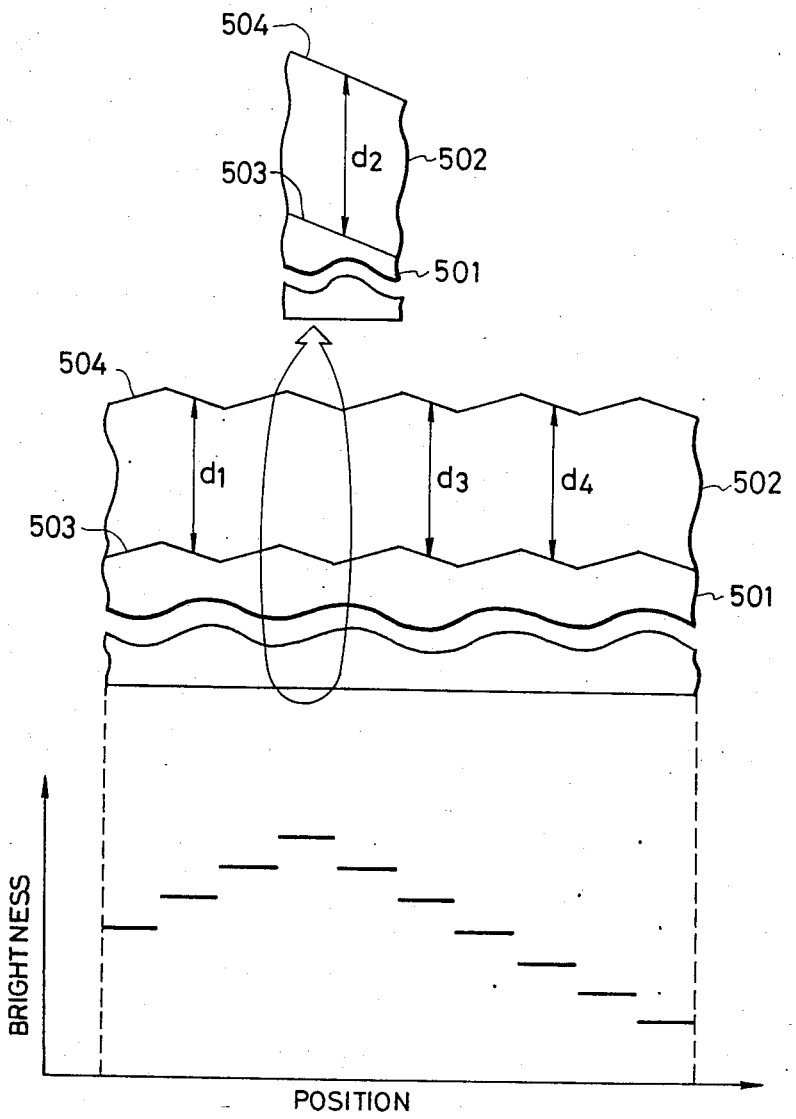
FIG. 5 is a schematic illustration of interference fringe in the case where the interfaces of respective layers of a light-receiving member are parallel to each other.
Figure 6A:
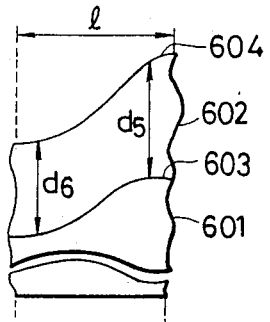
FIG. 6 (A–D) is a schematic illustration about no appearance of interference fringe in the case of non-parallel interfaces between respective layers of a light-receiving member.
Figure 6B:
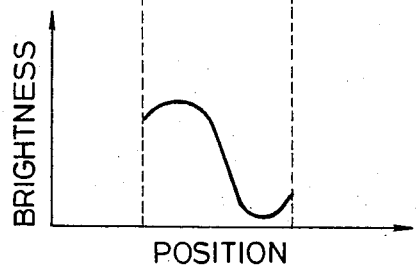
Figure 6C:
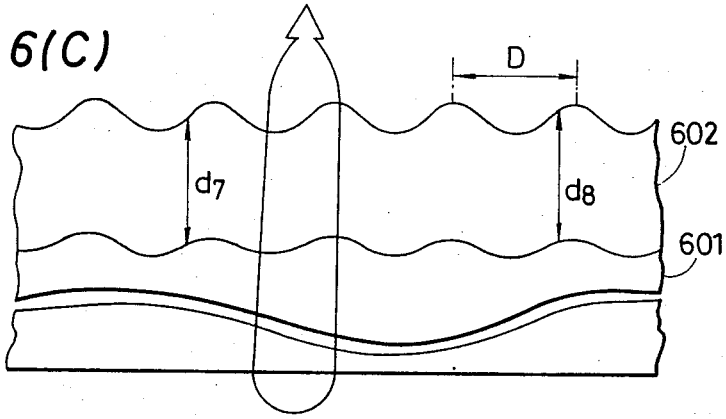
Figure 6D:
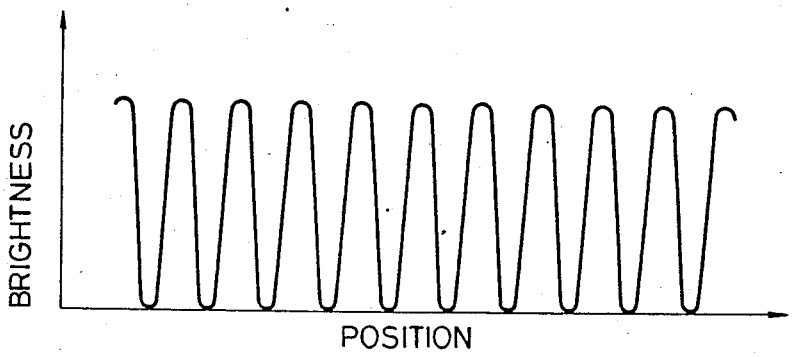

Referring now to the accompnaying drawings, the present invention is to be described in detail.

FIG. 6A–6D is a schematic illustration for explanation of the basic principle of the present invention.

In the present invention, on a substrate (not shown) having a fine smooth unevenness smaller than the resolution required for the device, a light-receiving layer of a multi-layer constitution is provided along the uneven slanted plane, with the thickness of the second layer 602 being continuously changed from $d_5$ to $d_6$, as shown enlarged in a part of FIG. 6, and therefore the interface 603 between the first layer 601 and the second layer 606 and the interface 604 have respective gradients. Accordingly, the coherent light incident on this minute portion (short range region ) l [indicated schematically in FIG. 6 (C), and its enlarged view shown in FIG. 6 (A)] undergoes interference at said minute portion l to form a minute interference fringe pattern [FIG. 6 (B)].

Figure 7A:
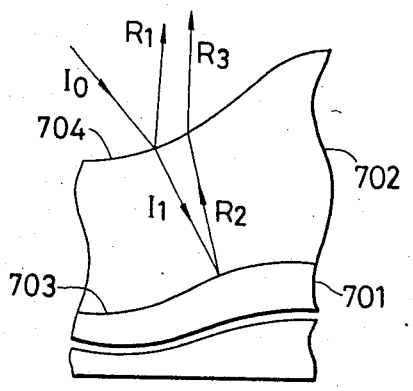
FIG. 7 (A–C) is a schematic illustration of comparison of the reflected light intensity between the case of parallel interfaces and non-parallel interfaces between the respective layers of a light-receiving member.
Figure 7B:
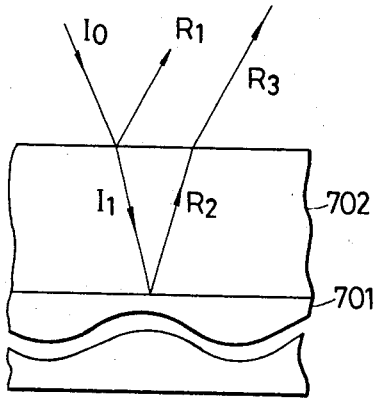
Figure 7C:
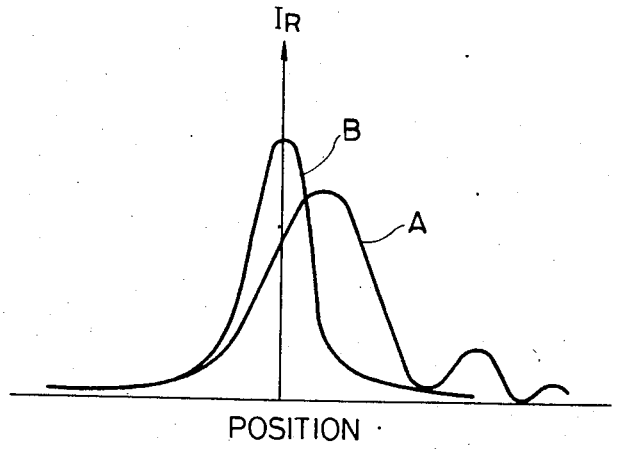
Figure 8:
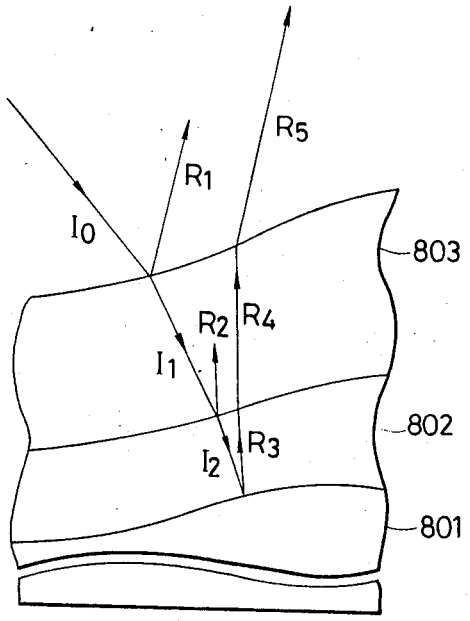
FIG. 8 is a schematic illustration of no appearance of interference fringe in the case of non-parallel interfaces between respective layers as developed.

Also, as shown in FIG. 7 (A–C), when the interface 703 between the first layer 701 and the second layer 702 and the free surface 704 are non-parallel to each other, the reflected light $R_1$ and the emitted lgiht $R_3$ are different in direction of progress from each other relative to the incident light $I_0$ as shown in FIG. 7 (A), and therefore the degree of interference will be reduced as compared with the case (FIG. 7 (B)) when the interfaces 703 and 704 are parallel to each other.

Accordingly, as shown in FIG. 7 (C), as compared with the case "(B)" where a pair of the interfaces are in parallel relation, the difference in lightness and darkness in the interference fringe pattern becomes negligibly small even if interfered, if any, in the non-parallel case "(A)".

The same is the case, as shown in FIG. 6, even when the layer thickness of the layer 602 may be macroscopically ununiform ($d_7 \neq d_8$), and therefore the incident light quantity becomes uniform all over the layer region (see FIG. 6 (D)).

To describe about the effect of the present invention when coherent light is transmitted from the irradiation side to the first layer in the case of a light-receiving layer of a multi-layer structure, reflected lights $R_1$, $R_2$, $R_3$, $R_4$ and $R_5$ exsit in connection with the incident light $I_0$. Accordingly, at the respective layers, the same phenomenon as described with reference to FIG. 7 occurs.

Therefore, when considered for the light-receiving layer as a whole, interference occurs as a synergetic effect of the respective layers and, according to the present invention, appearance of interference can further be prevented as the number of layers constituting the light-receiving layer is increased.

The interference fringe occurring within the minute portion cannot appear on the image, because the size of the minute portion is smaller than the spot size of the irradiated light, namely smaller than the resolution limit. Further, even if appeared on the image, there is no problem at all, since it is less than resolving ability of the eyes.

In the present invention, the slanted plane of unevenness should desirably be mirror finished in order to direct the reflected light assuredly in one direction.

The size l (one cycle of uneven shape) of the minute portion suitable for the present invention is $l<L$, wherein L is the spot size of the irradiation light.

Further, in order to accomplish more effectively the objects of the present invention, the layer thickness difference ($d_5-d_6$) at the minute portion 1 should desirably be as follows:

$d_5-d_6 \geqq \lambda/2n$ (where $\lambda$ is the wavelength of the irradiation light and n is the refractive index of the second layer 602).

In the present invention, within the layer thickness of the minute portion l (hereinafter called as "minute column") in the light-receiving layer of a multi-layer structure, the layer thicknesses of the respective layers are controlled so that at least two interfaces between layers may be in non-parallel relationship, and, provided that this condition is satisfied, any other pair of two interfaces between layers may be in parallel relationship within said minute column.

However, it is desirable that the layers forming parallel interfaces should be formed to have uniform layer thicknesses so that the difference in layer thickness at any two positions may be not more than:

$\lambda/2n$ (n: refractive index of the layer).

In formation of respective layers constituting the light -receiving layer such as the photosensitive layer, the charge injection preventive layer, the barrier layer comprised of an electrically insulating material or the first and second layers, in order to accomplish more effectively and easily the objects of the present invention, the plasma chemical vapor deposition method (PCVD method), the optical CVD method and thermal CVD method can be employed, because the layer thickness can accurately be controlled on the optical level thereby.

The smooth unevenness to be provided on the substrate surface can be formed by fixing a bite having a circular cutting blade at a predetermined position on a cutting working machine such as milling machine, lathe, etc., and cut working accurately the substrate surface by, for example, moving regularly in a certain direction while rotating a cylindrical substrate according to a program previously designed as desired, thereby forming to a desired smooth unevenness shape, pitch and depth. The sinusoidal linear projection produced by the unevenness formed by such a cutting working has a spiral structure with the center axis of the cylindrical substrate as its center.

Figure 9:
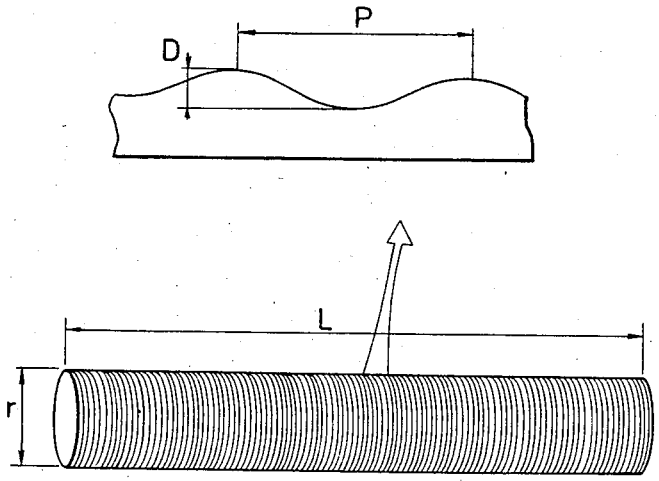
FIG. 9 is a schematic illustration of the surface state of the substrate.

An example of such a structure is shown in FIG. 9. In FIG. 9, L is the length of the substrate, r is the diameter of the substrate. P is the spiral pitch and D is the depth of groove.

The spiral structure of the sinusoidal projection may be made into a multiple spiral structure such as double or triple structure or a crossed spital structure.

Alternatively, a straight line structure along the center axis may also be introduced in addition to the spiral structure.

In the present invention, the respective dimensions of the smooth unevenness provided on the substrate surface under managed condition are set so as to accomplish efficiently the objects of the present invention in view of the following points.

More specifically, in the first place, the A-Si layer constituting the light-receiving layer is sensitive to the structure of the surface on which the layer formaton is effected, and the layer quality will be changed greatly depending on the surface condition.

Accordingly, it is necessary to set dimensions of the smooth unevenness to be provided on the substrate surface so that lowering in layer quality of the A-Si layer may not be brought about.

Secondly, when there is an extreme unevenness on the free surface of the light-receiving layer, cleaning cannot completely be performed in cleaning after image formation.

Further, in case of practicing blade cleaning, there is involved the problem that the blade will be damaged more earlily.

As the result of investigations of the problems in layer deposition as described above, problems in process of electrophotography and the conditions for prevention of interference fringe pattern, it has been found that the pitch at the recessed portion on the substrate surface should preferably be 0.3 to 500 μm, more preferably 1 to 200 μm, most preferably 5 to 50 μm.

It is also desirable that the maximum depth of the recessed portion should preferably be made 0.1 to 5 μm, more preferably 0.3 to 3 μm, most preferably 0.6 to 2 μm. When the pitch and the maximum depth of the recessed portions on the substrate surface are within the ranges as specified above, the gradient of the slanted plane connecting the minimum value point and the maximum value point, respectively, of the adjacent recessed portion and protruded portion may preferably be 1° to 20°, more preferably 3° to 15°, most preferably 4° to 10°.

On the other hand, the maximum of the difference in the layer thickness based on such an uniformness in layer thickness of the respective layers formed on such a substrate should preferably be made 0.1 μm to 2 μm within the same pitch, more preferably 0.1 μm to 1.5 μm, most preferably 0.2 μm to 1 μm.

The light-receiving layer in the light-receiving member of the present invention has a multi-layer structure constituted of at least one photosensitive layer comprising an amorphous material containing silicon atoms and a surface layer having the reflection preventive function or a multi-layer structure having a first layer comprising an amorphous material containing silicon atoms and germanium atoms, a second layer comprising an amorphous material containing silicon atoms and exhibiting photoconductivity and a surface layer having the reflection preventive function provided successively from the substrate side, and therefore can exhibit very excellent electrical, optical, photoconductive characteristics, dielectric strength and use environmental characteristics.

In particular, the light-receiving member of the present invention is free from any influence from residual potential on image formation when applied for light-receiving member for electrophotography, with its electrical characteristics being stable with high sensitivity, having a high SN ratio as well as excellent fatigue resistance and excellent repeated use characteristic and being capable of providing images of high quality of high density, clear halftone and high resolution repeatedly and stably.

Further, in the case of the light-receiving member of the present invention constituted of a first layer comprising an amorphous material containing silicon atoms and germanium atoms, a second layer comprising an amorphous material containing silicon atoms and exhibiting photoconductivity and a surface layer having the reflection preventive function, it is high in photosensitivity over all the visible light region especially in the longer wave length region, and therefore particularly excellent in matching to semiconductor laser, and rapid in response to light.

Referring to the drawings, the light-receiving member of the present invention is to be described in detail below.

Figure 21:
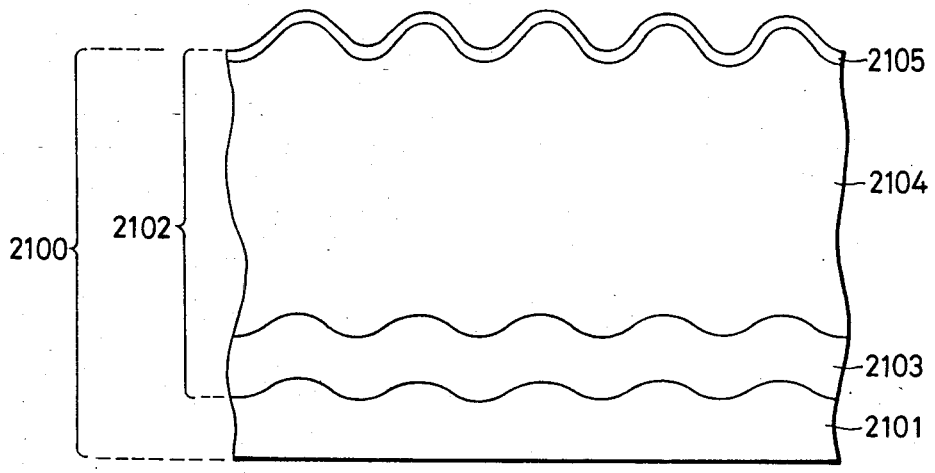

FIG. 21 is a schematic illustration of the layer structure of the light-receiving member according to the first embodiment of the present invention.

The light-receiving member 2100 shown in FIG. 21 has a light-receiving layer 2102 on a substrate 2101 which has been subjected to surface cutting working so as to achieve the objects of the invention, the light-receiving layer 2102 being constituted of a charge injection preventive layer 2103, a photosensitive layer 2104 and a surface layer 2105 from the side of the substrate 2101.

The substrate 2101 may be either electroconductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating substrates should preferably have at least one of the surfaces subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pd, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 2100 in FIG. 21 is to be used as an image forming member for electrophotography, it may desirably be formed into an endless belt or a cylinder for use in continuous copying. The substrate may have a thickness, which is conveniently determined so that a light-receiving member as desired may be formed. When the light-receiving member is required to have flexibility, the substrate is made as thin as possible, so far as the function of the substrate can be exhibited. However, in such a case, the thickness is preferablly 10 $\mu$ or more from the points of fabrication and handling of the substrate as well as its mechnical strength.

The charge injection preventive layer 2103 is provided for the purpose of preventing injection of charges into the photosensitive layer 2104 from the substrate 2101 side, thereby increasing apparent resistance.

The charge injection preventive layer 2103 is constituted of A-Si containing hydrogen atoms and/or halogen atoms (X) (hereinafter written as "A-Si(H,X)") and also contains a substance (C) for controlling conductivity. As the substance (C) for controlling conductivity to be contained in the charge injection preventive layer 2103, there may be mentioned so called impurities in the field of semiconductors. In the present invention, there may be included p-type impurities giving p-type conductivity characteristics and n-type impurities giving n-type conductivity characteristics to Si. More specifically, there may be mentioned as p-type impurities atoms belonging to the group III of the periodic table (Group III atoms), such as B (boron), Al (aluminum), Ga (gallium), In (indium), Tl (thallium), etc., particularly preferably B and Ga.

As n-type impurities, there may be included the atoms belonging to the group V of the periodic table (Group V atoms), such as P (phosphorus), As (arsenic), Sb (antimony), Bi (bismuth), etc., particularly preferably P and As.

In the present invention, the content of the substance (C) for controlling conductivity contained in the charge injection preventive layer 2103 may be suitably be selected depending on the charge injection preventing characteristic required, or when the charge injection preventive layer 2103 is provided on the substrate 2101 directly contacted therewith, the organic relationship such as relation with the characteristic at the contacted interface with the substrate 2101. Also, the content of the substance (C) for controlling conductivity is selected suitably with due considerations of the relationships with characteristics of other layer regions provided in direct contact with the above charge injection preventive layer or the characteristics at the contacted interface with said other layer regions.

In the present invention, the content of the substance (C) for controlling conductivity contained in the charge injection preventive layer 2103 should preferably be 0.001 to $5\times10^4$ atomic ppm, more preferably 0.5 to $1\times10^4$ atomic ppm, most preferably 1 to $5\times10^3$ atomic ppm.

In the present invention, by making the content of the substance (C) in the charge injection preventive layer 2103 prefearably 30 atomic ppm or more, more preferably 50 atomic ppm or more, most preferably 100 atomic ppm or more, for example, in the case when the substance (C) to be incorporated is a p-type impurity mentioned above, migration of electrons injected from the substrate side into the photosensitive layer can be effectively inhibited when the free surface of the light-receiving layer is subjected to the charging treatment to ⊕ polarity. On the other hand, when the substance (C) to be incorporated is an n-type impurity as mentioned above, migration of positive holes injected from the substrate side into the photosensitive layer can be more effectively inhibited when the free surface of the light-receiving layer is subjected to the charging treatment to ⊖ polarity.

The charge injection preventive layer 2103 may have a thickness preferably of 30 Å to 10 $\mu$m, more preferably of 40 Å to 8 $\mu$m, most preferably of 50 Å to 5 $\mu$m.

The photosensitive layer 2104 is constituted of A-Si(H,X) and has both the charge generating function to generate photocarriers by irradiation with a laser beam and the charge transporting function to transport the charges.

The photosensitive layer 2104 may have a thickness preferably of 1 to 100 μm, more preferably of 1 to 80 μm, most preferably of 2 to 50 μm.

The photosensitive layer 2104 may contain a substance for controlling conductivity of the other polarity than that of the substance for controlling conductivity contained in the charge injection preventive layer 2103, or a substance for controlling conductivity of the same polarity may be contained therein in an amount by far smaller than that practically contained in the charge injection preventive layer 2103.

In such a case, the content of the substance for controlling conductivity contained in the above photosensitive layer 2104 can be determined adequately as desired depending on the polarity or the content of the substance contained in the charge injection preventive layer 2103, but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the charge injection preventive layer 2103 and the photosensitive layer 2104, the content in the photosensitive layer 2104 should preferably be 30 atomic ppm or less.

In the present invention, the amount of hydrogen atoms (H) or the amount of halogen atoms (X) or the sum of the amounts of hydrogen atoms and halogen atoms (H+X) to be contained in the charge injection preventive layer 2103 and the photosensitive layer 2104 should preferably be 1 to 40 atomic %, more preferably 5 to 30 atomic %.

As halogen atoms (X), F, Cl, Br and I may be mentioned and among them, F and Cl may preferably be employed.

In the light-receiving member shown in FIG. 21, a so called barrier layer comprising an electrically insulating material may be provided in place of the charge injection preventive layer 2103. Alternatively, it is also possible to use the barrier layer in combination with the charge injection preventive layer 2103.

As the material for forming the barrier layer, there may be included inorganic insulating materials such as $A1_2O_3$, $SiO_2$, $Si_3N_4$, etc. or organic insulating materials such as polycarbonate, etc.

Figure 10:
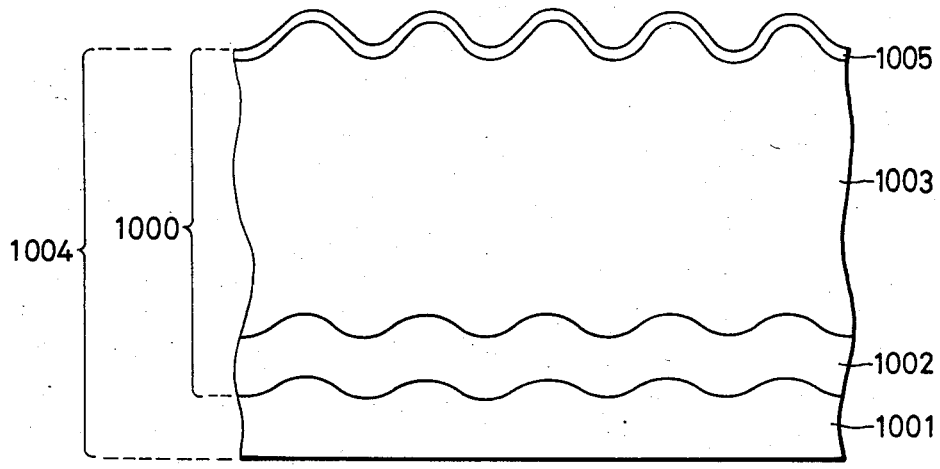
FIG. 10 and FIG. 21 each are schematic illustrations of the layer constitution of the light-receiving member.

FIG. 10 shows a schematic sectional view for illustration of the layer structure of the second embodiment of the light-receiving member of the present invention.

The light-receiving member 1004 as shown in FIG. 10 has a light-receiving layer 1000 on a substrate for light-receiving member 1001, said light-receiving layer 1000 having a free surface 1005 on one end surface.

The light-receiving layer 1000 has a layer structure constituted of a first layer (G) 1002 comprising an amorphous material containing silicon atoms and germanium atoms and, if desired, hydrogen atoms (H) and/or halogen atoms (X) (hereinafter abbreviated as "A-SiGe (H,X)"), a second layer (S) 1003 comprising A-Si containing, if desired, hydrogen atoms (H) and/or halogen atoms (X) (hereinafter abbreviated as A-Si(H,X)) and exhibiting photoconductivity and a surface layer 1005 having the reflection preventive function laminated successively from the substrate 1001 side.

The germanium atoms contained in the first layer (G) 1002 may be contained so that the distribution state may be uniform within the first layer (G), or they can be contained continuously in the layer thickness direction in said first layer (G) 1002, being more enriched at the substrate 1001 side toward the side opposite to the side where said substrate 1001 is provided (the surface layer 1005 side of the light-receiving layer 1001).

When the distribution state of the germanium atoms contained in the first layer (G) is ununiform in the layer thickness direction, it is desirable that the distribution state should be made uniform in the interplanar direction in parallel to the surface of the substrate.

In the present invention, in the second layer (S) provided on the first layer (G), no germanium atoms is contained and by forming a light-receiving layer to such a layer structure, the light-receiving member obtained can be excellent in photosensitivity to the light with wavelengths of all the regions from relatively shorter wavelength to relatively longer wavelength, including visible light region.

Also, when the distribution state of germanium atoms in the first layer (G) is ununiform in the layer thickness direction, the germanium atoms are distributed continuously throughout the whole layer region while giving a change in distribution concentration C of the germanium atoms in the layer thickness direction which is decreased from the substrate toward the second layer (S), and therefore affinity between the first layer (G) and the second layer (S) is excellent. Also, as described as hereinafter, by extremely increasing the distribution concentration C of germanium atoms at the end portion on the substrate side extremely great, the light on the longer wavelength side which cannot substantially be absorbed by the second layer (S) can be absorbed in the first layer (G) substantially completely, when employing a semiconductor laser, whereby interference by reflection from the substrate surface can be prevented.

Also, in the light-receiving member of the present invention, the respective amorphous materials constituting the first layer (G) and the second layer (S) have the common constituent of silicon atoms, and therefore chemical stability can sufficiently be ensured at the laminated interface.

FIGS. 11 through 19 show typical examples of distribution in the layer thickness direction of germanium atoms contained in the first layer region (G) of the light-receiving member in the present invention.

In FIGS. 11 through 19, the abscissa indicates the content C of germanium atoms and the ordinate the layer thickness of the first layer (G), $t_B$ showing the position of the end surface of the first layer (G) on the substrate side and $t_T$ the position of the end surface of the first layer (G) on the side opposite to the substrate side. That is, layer formation of the first layer (G) containing germanium atoms proceeds from the $t_B$ side toward the $t_T$ side.

Figure 11:
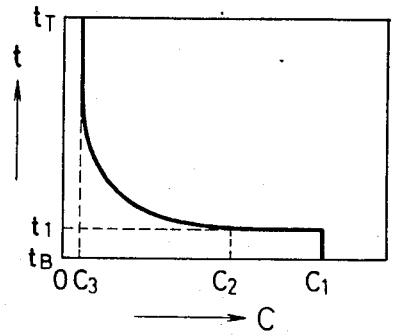
FIGS. 11 through 19 are schematic illustrations of depth profiles of germanium atoms in the first layer.

In FIG. 11, there is shown a first typical embodiment of the depth profile of germanium atoms in the layer thickness direction contained in the first layer (G).

In the embodiment as shown in FIG. 11, from the interface position $t_B$ at which the surface, on which the first layer (G) containing germanium atoms is to be formed, comes into contact with the surface of said first layer (G) to the position $t_1$, germanium atoms are contained in the first layer (G) formed, while the distribution concentration C of germanium atoms taking a constant value of $C_1$, the concentration being gradually decreased from the concentration $C_2$ continuously from the position $t_1$ to the interface position $t_T$. At the interface position $t_T$, the distribution concentration C of germanium atoms is made $C_3$.

Figure 12:
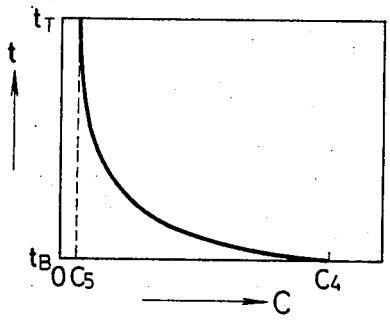

In the embodiment shown in FIG. 12, the distribution concentration C of germanium atoms contained is decreased gradually and continuously from the position $t_B$ to the position $t_T$ from the concentration $C_4$ until it becomes the concentration $C_5$ at the position $t_T$.

Figure 13:
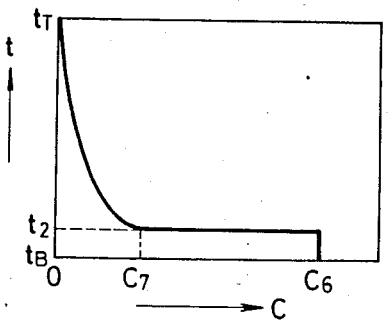

In case of FIG. 13, the distribution concentration C of germanium atoms is made constant as $C_6$ at the position $t_B$, gradually decreased continuously from the position $t_2$ to the position $t_T$, and the concentration C is made substantially zero at the position $t_T$ (substantially zero herein means the content less than the detectable limit).

Figure 14:
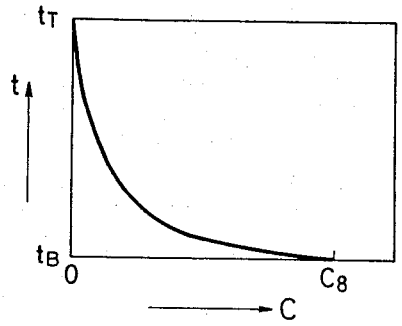

In case of FIG. 14, germanium atoms are decreased gradually and continuously from the position $t_B$ to the position $t_T$ from the concentration $C_8$, until it is made substantially zero at the position $t_T$.

Figure 15:
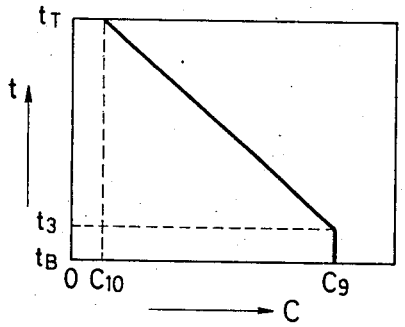

In the embodiment shown in FIG. 15, the distribution concentration C of germanium atoms is constantly $C_9$ between the position $t_B$ and the position $t_3$, and it is made $C_{10}$ at the position $t_T$. Between the position $t_3$ and the position $t_T$, the concentration C is decreased as a first order function from the position $t_3$ to the position $t_T$.

Figure 16:
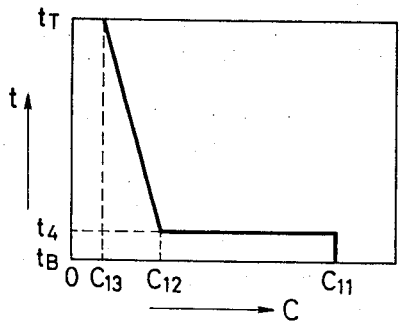

In the embodiment shown in FIG. 16, there is formed a depth profile such that the distribution concentration C takes a constant value of $C_{11}$ from the position $t_B$ to the position $t_4$, and is decreased as a first order function from the concentration $C_{12}$ to the concentration $C_{13}$ from the position $t_4$ to the position $t_T$.

Figure 17:
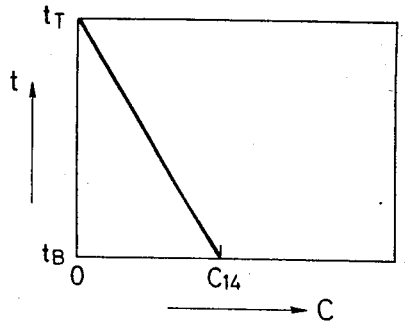

In the embodiment shown in FIG. 17, the distribution concentration C of germanium atoms is decreased as a first order function from the concentration $C_{14}$ to zero from the position $t_B$ to the position $t_T$.

Figure 18:
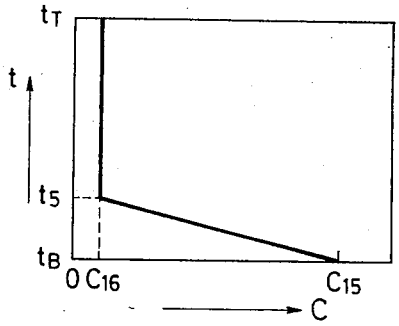

In FIG. 18, there is shown an embodiment, where the distribution concentration C of germanium atoms is decreased as a first order function from the concentration $C_{15}$ to $C_{16}$ from the position $t_B$ to $t_5$ and made constantly at the concentration $C_{16}$ between the position $t_5$ and $t_T$.

Figure 19:
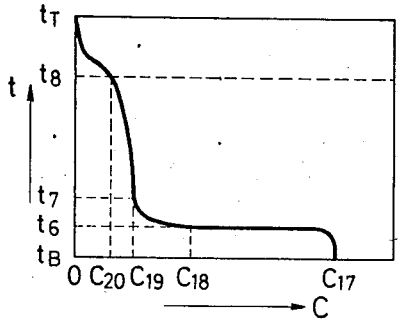

In the embodiment shown in FIG. 19, the distribution concentration C of germanium atoms is at the concentration $C_{17}$ at the position $t_B$, which concentration $C_{17}$ is initially decreased gradually and abruptly near the position $t_6$ to the position $t_6$, until it is made the concentration $C_{18}$ at the position $t_6$.

Between the position $t_6$ and the position $t_7$, the concentration is initially decreased abruptly and thereafter gradually, until it is made the concentration $C_{19}$ at the position $t_7$. Between the position $t_7$ and the position $t_8$, the concentration is decreased very gradually to the concentration $C_{20}$ at the position $t_8$. Between the position $t_8$ and the position $t_T$, the concentration is decreased along the curve having a shape as shown in the Figure from the concentration $C_{20}$ to substantially zero.

As described above about some typical examples of depth profiles of germanium atoms contained in the first layer (G) in the direction of the layer thickness by referring to FIGS. 11 through 19, when the distribution state of germanium atoms is ununiform in the layer thickness direction, the first layer (G) is provided desirably in a depth profile so as to have a portion enriched in distribution concentration C of germanium atoms on the substrate side and a portion depleted in distribution concentration C of germanium atoms considerably lower than that of the substrate side on the interface $t_T$ side.

The first layer (G) constituting the light-receiving member in the present invention is desired to have a localized region (A) containing germanium atoms at a relatively higher concentration on the substrate side as described above.

In the present invention, the localized region (A), as explained in terms of the symbols shown in FIG. 11 through FIG. 19, may be desirably provided within 5 $\mu$ from the interface position $t_B$.

In the present invention, the above localized region (A) may be made to be identical with the whole of the layer region ($L_T$) on the interface position $t_B$ to the thickness of 5 $\mu$, or alternatively a part of the layer region ($L_T$).

It may suitably be determined depending on the characteristics required for the light-receiving layer to be formed, whether the localized region (A) is made a part or whole of the layer region ($L_T$).

The localized region (A) may preferably be formed according to such a layer formation that the maximum value Cmax of the concentrations of germanium atoms in a distribution in the layer thickness direction may preferably be 1000 atomic ppm or more, more preferably 5000 atomic ppm or more, most preferably $1\times10^4$ atomic ppm or more based on silicon atoms.

That is, according to the present invention, it is desirable that the layer region (G) containing germanium atoms is formed so that the maximum value Cmax of the distribution concentration C may exist within a layer thickness of 5 $\mu$ from the substrate side (the layer region within 5 $\mu$ thickness from $t_B$).

In the present invention, the content of germanium atoms in the first layer (G), which may suitably be determined as desired so as to acheive effectively the objects of the present invention, may preferably be 1 to $9.5\times10^5$ atomic ppm, more preferably 100 to $8\times10^5$ atomic ppm, most preferably 500 to $7\times10^5$ atomic ppm.

In the present invention, the layer thickness of the first layer (G) and the thickness of the second layer (S) are one of the important factors for accomplishing effectively the objects of the present invention, and therefore sufficient care should desirably be paid in designing of the light-receiving member so that desirable characteristics may be imparted to the light-receiving member formed.

In the present invention, the layer thickness $T_B$ of the first layer (G) may preferably be 30 Å to 50 $\mu$, more preferably 40 Å to 40 $\mu$, most preferably 50 Å to 30 $\mu$.

On the other hand, the layer thickness T of the second layer (S) may be preferably 0.5 to 90 $\mu$, more preferably 1 to 80 $\mu$, most preferably 2 to 50 $\mu$.

The sum of the above layer thicknesses T and $T_B$, namely ($T+T_B$) may be suitably determined as desired in designing of the layers of the light-receiving member, based on the mutual organic relationship between the characteristics required for both layer regions and the characteristics required for the whole light-receiving layer.

In the light-receiving member of the present invention, the numerical range for the above ($T_B+T$) may generally be from 1 to 100 $\mu$, preferably 1 to 80 $\mu$, most preferably 2 to 50 $\mu$.

In a more preferred embodiment of the present invention, it is preferred to select the numerical values for respective thicknesses $T_B$ and T as mentioned above so that the relation of $T_B/T\leqq1$ may be satisfied.

In selection of the numerical values for the thicknesses $T_B$ and T in the above case, the values of $T_B$ and T should preferably be determined so that the relation $T_B/T \leqq 0.9$, most preferably, $T_B/T \leqq 0.8$, may be satisfied.

In the present invention, when the content of germanium atoms in the first layer (G) is $1 \times 10^5$ atomic ppm or more, the layer thickness $T_B$ should desirably be made considerably thinner, preferably 30 $\mu$ or less, more preferably 25 $\mu$ or less, most preferably 20 $\mu$ or less.

In the present invention, illustrative of halogen atoms (X), which may optionally be incorporated in the first layer (G) and the second layer (S) constituting the light-receiving layer, are fluorine, chlorine, bormine and iodine, particularly preferably fluorine and chlorine.

In the present invention, formation of the first layer (G) constituted of A-SiGe(H,X) may be conducted according to the vacuum deposition method utilizing discharging phenomenon, such as glow discharge method, sputtering method or ion-plating method. For example, for formation of the first layer (G) constituted of A-SiGe(H,X) according to the glow discharge method, the basic procedure comprises introducing a starting gas for Si supply capable of supplying silicon atoms (Si), a starting gas for Ge supply capable of supplying germanium atoms (Ge) optionally together with a starting gas for introduction of hydrogen atoms (H) and/or a starting gas for introduction of halogen atoms (X) into a deposition chamber which can be internally brought to a reduced pressure, and exciting glow discharge in said deposition chamber, thereby effecting layer formation on the surface of a substrate placed at a predetermined position while controlling the depth profile of germanium atoms according to a desired rate of change curve to form a layer constituent of A-SiGe (H,X). Alternatively, for formation according to the sputtering method, when carrying out sputtering by use of two sheets of targets of a target constituted of Si and a target constituted of Ge, or a target of a mixture of Si and Ge in an atmosphere of an inert gas such as Ar, He, etc. or a gas mixture based on these gases, a gas for introduction of hydrogen atoms (H) and/or a gas for introduction of halogen atoms (X) may be introduced, if desired, into a deposition chamber for sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred because of easiness in handling during layer formation and high efficiency for supplying Si.

As the substances which can be used as the starting gases for Ge supply, there may be effectively employed gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. In particular, $GeH_4$, $Ge_2H_6$ and $Ge_3H_8$ are preferred because of easiness in handling during layer formation and high efficiency for supplying Ge.

Effective starting gases for introduction of halogen atoms to be used in the present invention may include a large number of halogenic compounds, as exemplified preferably by halogenic gases, halides, interhalogen compounds, or gaseous or gasifiable halogenic compounds such as silane derivatives substituted with halogens.

Further, there may also be included gaseous or gasifiable hydrogenated silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the light-receiving member of the present invention is formed according to the glow discharge method by employment of such a silicon compound containing halogen atoms, it is possible to form the first layer (G) constituted of A-SiGe containing halogen atoms on a desired substrate without use of a hydrogenated silicon gas as the starting gas capable of supplying Si together with the starting gas for Ge supply.

In the case of forming the first layer (G) containing halogen atoms according to the glow discharge method, the basic procedure comprises introducing, for example, a silicon halide as the starting gas for Si supply, a hydrogenated germanium as the starting gas for Ge supply and a gas such as Ar, $H_2$, He, etc. at a predetermined mixing ratio into the deposition chamber for formation of the first layer (G) and exciting glow discharge to form a plasma atmosphere of these gases, whereby the first layer (G) can be formed on a desired substrate. In order to control the ratio of hydrogen atoms incorporated more easily, hydrogen gas or a gas of a silicon compound containing hydrogen atoms may also be mixed with these gases in a desired amount to form the layer.

Also, each gas is not restricted to a single species, but multiple species may be available at any desired ratio.

For formation of the first layer (G) comprising A-SiGe(H,X) according to the reactive sputtering method or the ion plating method, for example, in the case of the sputtering method, two sheets of a target of Si and a target of Ge or a target of Si and Ge is employed and subjected to sputtering in a desired gas plasma atmosphere. In the case of the ion-plating method, for example, a vaporizing source such as a polycrystalline silicon or a single crystalline silicon and a polycrystalline germanium or a single crystalline germanium may be placed as vaporizing source in an evaporating boat, and the vaporizing source is heated by the resistance heating method or the electron beam method (EB method) to be vaporized, and the flying vaporized product is permitted to pass through a desired gas plasma atmosphere.

In either case of the sputtering method and the ion-plating method, introduction of halogen atoms into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or hydrogenated germanium as mentioned above, may be introduced into a deposition chamber for sputtering, followed by formation of the plasma atmosphere of said gases.

In the present invention, as the starting gas for introduction of halogen atoms, the halides or halo-containing silicon compounds as mentioned above can effectively be used. Otherwise, it is also possible to use effectively as the starting material for formation of the first layer (G) gaseous or gasifiable substances, including halides containing hydrogen atom as one of the constituents, e.g. hydrogen halide such as HF, HCl, HBr, HI, etc.; halo-substituted hydrogenated silicon such as $SiH_2F_2$, $siH_2I_2$, $SiH_2Cl_2$, $SiHCl_3$, $SiH_2Br_2$, $SiHBr_3$, etc.; hydrogenated germanium halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, $GeI_4$, $GeF_2$, $GeCl_2$, $GeBr_2$, $GeI_2$, etc.

Among these substances, halides containing halogen atoms can preferably be used as the starting material for introduction of halogens, because hydrogen atoms, which are very effective for controlling electrical or photoelectric characteristics, can be introduced into the layer simultaneously with introduction of halogen atoms during formation of the first layer (G).

For introducing hydrogen atoms structurally into the first layer (G), other than those as mentioned above, $H_2$ or a hydrogenated silicon such as $SiH_4$, $Si_2H_6$, $Si_3H_8$, $Si_4H_{10}$, etc. together with germanium or a germanium compound for supplying Ge, or a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. together with silicon or a silicon compound for supplying Si can be permitted to co-exist in a deposition chamber, followed by excitation of discharging.

According to a preferred embodiment of the present invention, the amount of hydrogen atoms (H) or the amount of halogen atoms (X) or the sum of the amounts of hydrogen atoms and halogen atoms (H+X) to be contained in the first layer (G) constituting the light-receiving layer to be formed should preferably be 0.01 to 40 atomic %, more preferably 0.05 to 30 atomic %, most preferably 0.1 to 25 atomic %.

For controlling the amount of hydrogen atoms (H) and/or halogen atoms (X) to be contained in the first layer (G), for example, the substrate temperature and/or the amount of the starting materials used for incorporation of hydrogen atoms (H) or halogen atoms (X) to be introduced into the deposition device system, discharging power, etc. may be controlled.

In the present invention, for formation of the second layer (S) constituted of A-Si(H,X), the starting materials (I) for formation of the first layer (G), from which the starting materials for the starting gas for supplying Ge are omitted, are used as the starting materials (II) for formation of the second layer (S), and layer formation can be effected following the same procedure and conditions as in formation of the first layer (G).

More specifically, in the present invention, formation of the second layer region (S) constituted of a-Si(H,X) may be carried out according to the vacuum deposition method utilizing discharging phenomenon such as the glow discharge method, the sputtering method or the ion-plating method. For example, for formation of the second layer (S) constituted of A-Si(H,X) according to the glow discharge method, the basic procedure comprises introducing a starting gas for Si supply capable of supplying silicon atoms (Si) as described above, optionally together with starting gases for introduction of hydrogen atoms (H) and/or halogen atoms (X), into a deposition chamber which can be brought internally to a reduced pressure and exciting glow discharge in said deposition chamber, thereby forming a layer comprising A-Si(H,X) on a desired substrate placed at a predetermined position. Alternatively, for formation according to the sputtering method, gases for introduction of hydrogen atoms (H) and/or halogen atoms (X) may be introduced into a deposition chamber when effecting sputtering of a target constituted of Si in an inert gas such as Ar, He, etc. or a gas mixture based on these gases.

In the present invention, the amount of hydrogen atoms (H) or the amount of halogen atoms (X) or the sum of the amounts of hydrogen atoms and halogen atoms (H+X) to be contained in the second layer (S) constituting the light-receiving layer to be formed should preferably be 1 to 40 atomic %, more preferably 5 to 30 atomic %, most preferably 5 to 25 atomic %.

In the light-receiving member 1004, by incorporating a substance (C) for controlling conductivity in at least the first layer (G) 1002 and/or the second layer (S) 1003, desired conductivity characteristics can be given to the layer containing said substance (C).

In this case, the substance (C) for controlling conductivity may be contained throughout the whole layer region in the layer containing the substance (C) or contained locally in a part of the layer region of the layer containing the substance (C).

Also, in the layer region (PN) containing said substance (C), the distribution state of said substance (C) in the layer thickness direction may be either uniform or nonuniform, but desirably be made uniform within the plane in parallel to the substrate surface. When the distribution state of the substance (C) is nonuniform in the layer thickness direction, and when the substance (C) is to be incorporated in the whole layer region of the first layer (G), said substance (C) is contained in the first layer (G) so that it may be more enriched on the substrate side of the first layer (G).

Thus, in the layer region (PN), when the distribution concentration in the layer thickness direction of the above substance (C) is made nonuniform, optical and electrical junction at the contacted interface with other layers can further be improved.

In the present invention, when the substance (C) for controlling conductivity is incorporated in the first layer (G) so as to be locally present in a part of the layer region, the layer region (PN) in which the substance (C) is to be contained is provided as an end portion layer region of the first layer (G), which is to be determined case by case suitably as desired depending on.

In the present invention, when the above substance (C) is to be incorporated in the second layer (S), it is desirable to incorporate the substance (C) in the layer region including at least the contacted interface with the first layer (G).

When the substance (C) for controlling conductivity is to be incorporated in both the first layer (G) and the second layer (S), it is desirable that the layer region containing the substance (C) in the first layer (G) and the layer region containing the substance (C) in the second layer (S) may contact each other.

Also, the above substance (C) contained in the first layer (G) may be either the same as or different from that contained in the second layer (S), and their contents may be either the same or different.

However, in the present invention, when the above substance (C) is of the same kind in the both layers, it is preferred to make the content in the first layer (G) sufficiently greater, or alternatively to incorporate substances (C) with different electrical characteristics in respective layers desired.

In the present invention; by incorporating a substance (C) for controlling conductivity in at least the first layer (G) and/or the second layer (S) constituting the light-receiving layer, conductivity of the layer region containing the substance (C) [which may be either a part or the whole of the layer region of the first layer (G) and/or the second layer (S)]can be controlled as desired. As a substance (C) for controlling conductivity characteristics, there may be mentioned so called impurities in the field of semiconductors. In the present invention, there may be included p-type impurities giving p-type condutivity characteristics and n-type impurities and/or giving n-type conductivity characteristics to A-Si(H,X) and/or A-SiGe(H,X) constituting the light receiving layer to be formed.

More specifically, there may be mentioned as p-type impurities atoms belonging to the group III of the periodic table (Group III atoms), such as B (boron), Al(aluminum), Ga(gallium), In(indium), Tl(thallium), etc., particularly preferably B and Ga.

As n-type impurities, there may be included the atoms belonging to the group V of the periodic table, such as P (phosphorus), As (arsenic), Sb (antimony), Bi (bismuth), etc., particularly preferably P and As.

In the present invention, the content of the substance (C) for controlling conductivity in the layer region (PN) may be suitably be determined depending on the conductivity required for said layer region (PN), or when said layer region (PN) is provided in direct contact with the substrate, the organic relationships such as relation with the characteristics at the contacted interface with the substrate, etc.

Also, the content of the substance (C) for controlling conductivity is determined suitably with due considerations of the relationships with characteristics of other layer regions provided in direct contact with said layer region or the characteristics at the contacted interface with said other layer regions.

In the present invention, the content of the substance (C) for controlling conductivity contained in the layer region (PN) should preferably be 0.01 to $5\times10^4$ atomic ppm, more preferably 0.5 to $1\times10^4$ atomic ppm, most preferably 1 to $5\times10^3$ atomic ppm.

In the present invention, by making the content of said substance (C) in the layer region (PN) preferably 30 atomic ppm or more, more preferably 50 atomic ppm or more, most preferably 100 atomic ppm or more, for example, in the case when said substance (C) to be incorporated is a p-type impurity as mentioned above, migration of electrons injected from the substrate side into the light-receiving layer can be effectively inhibited when the free surface of the light-receiving layer is subjected to the charging treatment to ⊕ polarity. On the other hand, when the substance to be incorporated is a n-type impurity, migration of positive holes injected from the substrate side into the light-receiving layer may be effectively inhibited when the free surface of the light-receiving layer is subjected to the charging treatment to ⊖ polarity.

In the case as mentioned above, the layer region (Z) at the portion excluding the above layer region (PN) under the basic constitution of the present invention as described above may contain a substance for controlling conductivity of the other polarity, or a substance for controlling conductivity having characteristics of the same polarity may be contained therein in an amount by far smaller than that practically contained in the layer region (PN)

In such a case, the content of the substance (C) for controlling conductivity contained in the above layer region (Z) can be determined adequately as desired depending on the polarity or the content of the substance contained in the layer region (PN), but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the layer region (PN) and the layer region (Z), the content in the layer region (Z) should preferably be 30 atomic ppm or less.

In the present invention, it is also possible to provide a layer region containing a substance for controlling conductivity having one polarity and a layer region containing a substance for controlling conductivity having the other polarity in direct contact with each other, thus providing a so called depletion layer at said contact region.

In short, for example, a layer containing the aforesaid p-type impurity and a layer region containing the aforesaid n-type impurity are provided in the light-receiving layer in direct contact with each other to form the so called p-n junction, whereby a depletion layer can be provided.

FIGS. 27 through 35 show typical examples of the depth profiles in the layer thickness direction of the substance (C) contained in the layer region (PN) in the light-receiving layer of the present invention. In each of these Figures, representations of layer thickness and concentration are shown in rather exaggerated forms for illustrative purpose, since the difference between respective Figures will be indistinct if represented by the real values as such, and it should be understood that these Figures are schematic in nature. As practical distribution, the values of ti ($1\leqq i\leqq 9$) or Ci ($1\leqq i\leqq 17$) should be chosen so as to obtain desired distribution concentration lines, or values obtained by multiplying the distribution curve as a whole with an appropriate coefficient should be used.

In FIGS. 27 through 35, the abscissa shows the distribution concentration C of the substance (C), and (PN), $t_B$ indicating the position of the end surface on the substrate side of the layer region (G) and $t_T$ the position of the end surface on the side opposite to the substrate side. Thus, layer formation of the layer region (PN) containing the substance (C) proceeds from the $t_B$ side toward side the $t_T$ side.

Figure 27:
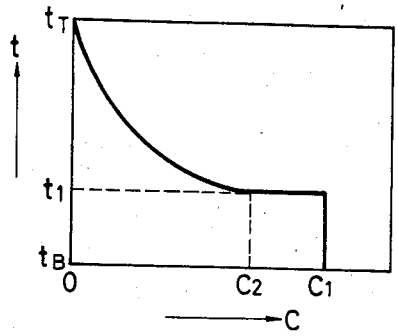
FIGS. 27 through 35 are schematic illustrations of depth profiles of the substance (C) in the layer region (PN)

FIG. 27 shows a first typical example of the depth profile of the substance (C) in the layer thickness direction contained in the layer region (PN).

In the embodiment shown in FIG. 27, from the interface position $t_B$ where the surface at which the layer region (PN) containing the substance (C) contacts the surface of said layer (G) to the position $t_1$, the substance (C) is contained in the layer region (PN) formed while the distribution concentration C of the substance (C) taking a constant value of $C_1$, and the concentration is gradually decreased from the concentration $C_2$ continuously from the position $t_1$ to the interface position $t_T$. At the interface position $t_T$, the distribution concentration C of the substance (C) is made substantially zero (here substantially zero means the case of less than detectable limit).

Figure 28:
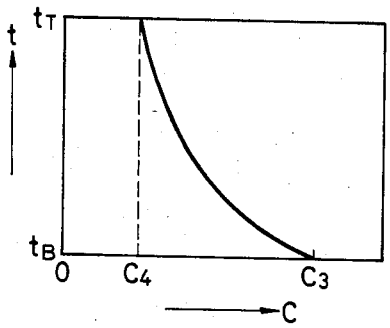

In the embodiment shown in FIG. 28, the distribution concentration C of the substance (C) contained is decreased from the position $t_B$ to the position $t_T$ gradually and continuously from the concentration $C_3$ to the concentration $C_4$ at $t_T$.

Figure 29:
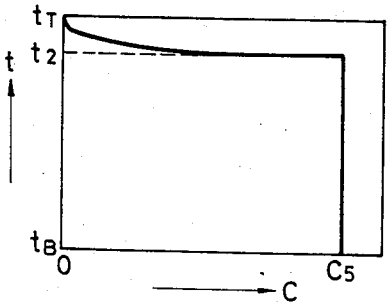

In the case of FIG. 29, from the position $t_B$ to the position $t_2$, the distribution concentration C of the substance (C) is made constantly at $C_5$, while between the position $t_2$ and the position $t_T$, it is gradually and continuously decreased, until the distribution concentration is made substantially zero at the position $t_T$.

Figure 30:
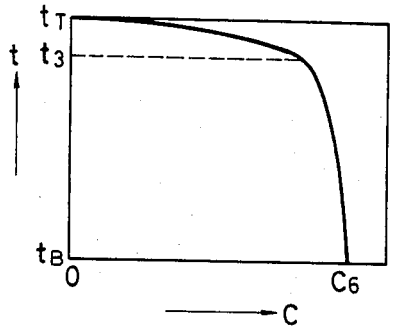

In the case of FIG. 30, the distribution concentration C of the substance (C) is first decreased continuously and gradually from the concentration $C_6$ from the position $t_B$ to the position $t_3$, from where it is abruptly decreased to substantially zero at the position $t_T$.

Figure 31:
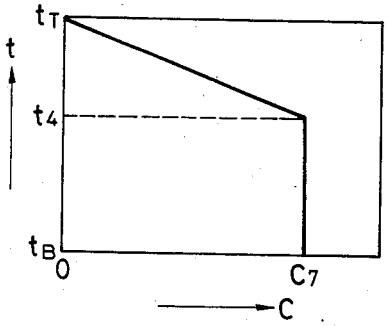

In the embodiment shown in FIG. 31, the distribution concentration of the substance (C) is constantly $C_7$ between the position $t_B$ and the position $t_T$, and the distribution concentration is made zero at the position $t_T$. Between the $t_4$ and the position $t_T$, the distribution concentration C is decreased as a first order function from the position $t_4$ to the position $t_T$.

Figure 32:
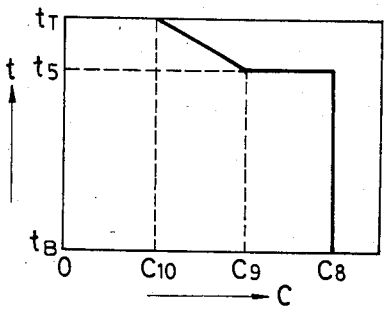

In the embodiment shown in FIG. 32, the distribution concentration C takes a constant value of $C_8$ from the position $t_B$ to the position $t_5$, while it was decreased as a first order function from the concentration $C_9$ to the concentration $C_{10}$ from the position $t_5$ to the position $t_T$.

Figure 33:
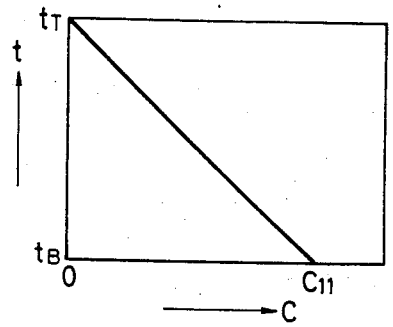

In the embodiment shown in FIG. 33, from the position $t_B$ to the position $t_T$, the distribution concentration C of the substance (C) is decreased continuously as a first order function from the concentration $C_{11}$ to zero.

Figure 34:
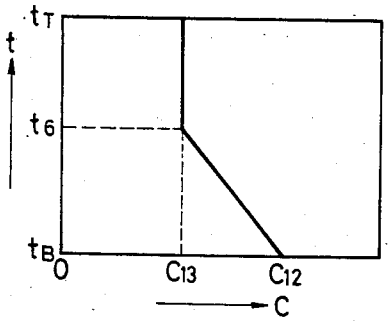

In FIG. 34, there is shown an embodiment, in which, from the position $t_B$ to the position $t_6$, the distribution concentration C of the substance C is decreased as a first order function from the concentration $C_{12}$ to the concentration $C_{13}$, and the concentration is made a constant value of $C_{13}$ between the position $t_6$ and the position $t_T$.

Figure 35:
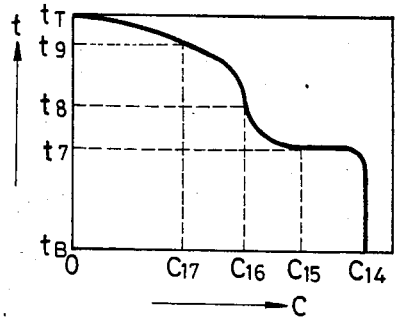

In the embodiment shown in FIG. 35 , the distribution concentration C of the substance (C) is $C_{14}$ at the position $t_B$, which is gradually decreased initially from $C_{14}$ and then abruptly near the position $t_7$, where it is made $C_{15}$ at the position $t_7$.

Between the position $t_7$ and the position $t_8$, the concentration is initially abruptly decreased and then moderately gradually, until it becomes $C_{16}$ at the position $t_8$, and between the position $t_8$ and the position $t_9$, the concentration is gradually decreased to reach $C_{17}$ at the position $t_9$. Between the position $t_9$ and the position $t_T$, the concentration is decreased from $C_{17}$, following the curve with a shape as shown in Figure, to substantially zero.

As described above by referring to some typical examples of depth profiles in the layer thickness direction of the substance (C) contained in the layer region (PN) shown FIGS. 27 through 35, it is desirable in the present invention that a depth profile of the substance (C) should be provided in the layer region (PN) so as to have a portion with relatively higher distribution concentration C of the substance (C) on the substrate side, while having a portion on the interface $t_T$ side where said distribution concentration is made considerably lower as compared with the substrate side.

The layer region (PN) constituting the light-receiving member in the present invention is desired to have a localized region (B) containing the substance (C) preferably at a relatively higher concentration on the substrate side as described above.

In the present invention, the localized region (B) as explained in terms of the symbols shown in FIGS. 27 through 35 may be desirably provided within 5 $\mu$ from the interface position $t_B$.

In the present invention, the above localized region (B) may be made to be identical with the whole of the layer region (L) from the interface position $t_B$ to the thickness of 5 $\mu$, or alternatively a part of the layer region (L).

It may suitably be determined depending on the characteristics required for the light-receiving layer to be formed whether the localized region (B) should be made a part or the whole of the layer region (L).

For formation of the layer region (PN) containing the aforesaid substance (C) by incorporating a substance (C) for controlling conductivity such as the group III atoms or the group V atoms structurally into the light-receiving layer, a starting material for introduction of the group III atoms or a starting material for introduction of the group V atoms may be introduced under gaseous state into a deposition chamber together with other starting materials for formation of the respective layers during layer formation.

As the starting material which can be used for introduction of the group III atoms, it is desirable to use those which are gaseous at room temperature under atmospheric pressure or can readily be gasified under layer forming conditions. Typical examples of such starting materials for introduction of the group III atoms, there may be included as the compounds for introduction of boron atoms boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. Otherwise, it is also possible to use $AlCl_3$, $GaCl_3$, $Ga(CH_3)_3$, $InCl_3$, $TlCl_3$ and the like.

The starting materials which can effectively be used in the present invention for introduction of the group V atoms may include, for introduction of phosphorus atoms, phosphorus hydrides such as $PH_3$, $P_2H_4$, etc., phosphorus halides such as $PH_4I$, $PF_3$, $PF_5$, $PCl_3$, $PCl_5$, $PBr_3$, $PBr_5$, $PI_3$ and the like. Otherwise, it is possible to utilize $AsH_3$, $AsF_3$, $AsCl_3$, $AsBr_3$, $AsF_5$, $SbH_3$, $SbF_3$, $SbF_5$, $SbCl_3$, $SbCl_5$, SbCl, $BiH_3$, $BiCl_3$, $BiBr_3$ and the like effectively as the starting material for introduction of the group V atoms.

In the light-receiving member of the present invention, for the purpose of obtaining higher photosensitivity and dark resistance, and further for the purpose of improving adhesion between the substrate and the light-receiving layer, at least one kind of atoms selected from oxygen atoms, carbon atoms and nitrogen atoms can be contained in the light-receiving layer in either uniform or ununiform distribution state in the layer thickness direction. Such atoms (OCN) to be contained in the light-receiving layer may be contained therein throughout the whole layer region of the light-receiving layer or localized by being contained in a part of the layer region of the light-receiving layer.

The distribution concentration C (OCN) of the atoms (OCN) should desirably be uniform within the plane parallel to the surface of the substrate.

In the present invention, the layer region (OCN) where atoms (OCN) are contained is provided so as to occupy the whole layer region of the light-receiving layer when it is primarily intended to improve photosensitivity and dark resistance, while it is provided so as to occupy the end portion layer region on the substrate side of the light-receving layer when it is primarily intended to strengthen adhesion between the substrate and the light-receiving layer.

In the former case, the content of atoms (OCN) contained in the layer region (OCN) should desirably be made relatively smaller in order to maintain high photosensitivity, while in the latter case relatively larger in order to ensure reinforcement of adhesion to the substrate.

In the present invention, the content of the atoms (OCN) to be contained in the layer region (OCN) provided in the light-receiving layer can be selected suitably in organic relationship with the characteristics required for the layer region (OCN) itself, or with the characteristic at the contacted interface with the substrate when the said layer region (OCN) is provided in direct contact with the substrate, etc.

When other layer regions are to be provided in direct contact with the layer region (OCN), the content of the atoms (OCN) may suitably be selected with due considerations about the characteristics of said other layer regions or the characteristics at the contacted interface with said other layer regions.

The amount of the atoms (OCN) contained in the layer region (OCN) may be determined as desired depending on the characteristics required for the light-receiving member to be formed, but it may preferably be 0.001 to 50 atomic %, more preferably 0.002 to 40 atomic %, most preferably 0.003 to 30 atomic %.

In the present invention, when the layer region (OCN) occupies the whole region of the light-receiving layer or, although not occupying the whole region, the proportion of the layer thickness $T_O$ of the layer region (OCN) occupied in the layer thickness T of the light-receiving layer is sufficiently large, the upper limit of the content of the atoms (OCN) contained in the layer region (OCN) should desirably be made sufficiently smaller than the value as specified above.

In the case of the present invention, when the proportion of the layer thickness $T_O$ of the layer region (OCN) occupied relative to the layer thickness T of the light-receiving layer is 2/5 or higher, the upper limit of the atoms (OCN) contained in the layer region (OCN) should desirably be made 30 atomc % or less, more preferably 20 atomic % or less, most preferably 10 atomic % or less.

According to a preferred embodiment of the present invention, it is desirable that the atoms (OCN) should be contained in at least the above first layer to be provided directly on the substrate. In short, by incorporating the atoms (OCN) at the end portion layer region on the substrate side in the light-receiving layer, it is possible to effect reinforcement of adhesion between the substrate and the light-receiving layer.

Further, in the case of nitrogen atoms, for example, under the co-presence with boron atoms, improvement of dark resistance and improvement of photosensitivity can further be ensured, and therefore they should preferably be contained in a desired amount in the light-receiving layer.

Plural kinds of these atoms (OCN) may also be contained in the light-receiving layer. For example, oxygen atoms may be contained in the first layer, nitrogen atoms in the second layer, or alternatively oxygen atoms and nitrogen atoms may be permitted to be co-present in the same layer region.

FIGS. 43 through 51 show typical examples of ununiform depth profiles in the layer thickness direction of the atoms (OCN) contained in the layer region (OCN) in the light-receiving member of the present invention.

In FIGS. 43 through 51, the abscissa indicates the distribution concentration C of the atoms (OCN), and the ordinate the layer thickness of the layer region (OCN), $t_B$ showing the position of the end surface of the layer region on the substrate side, while $t_T$ shows the position of the end face of the layer region (OCN) opposite to the substrate side. Thus, layer formation of the layer region (OCN) containing the atoms (OCN) proceeds from the $t_B$ side toward the $t_T$ side.

Figure 43:
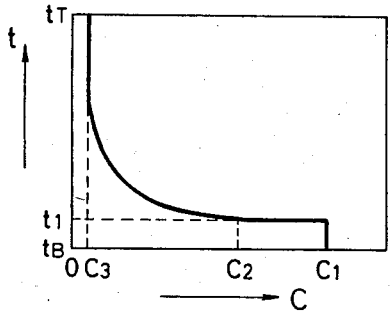
FIGS. 43 through 51 are each schematic illustrations of the depth profile of the atoms (OCN) in the layer region (OCN)

FIG. 43 shows a first typical embodiment of the depth profile in the layer thickness direction of the atoms (OCN) contained in the layer region (OCN).

In the embodiment shown in FIG. 43, from the interface position $t_B$ where the surface on which the layer region (OCN) containing the atoms (OCN) is formed contacts the surface of said layer region (OCN) to the position of $t_1$, the atoms (OCN) are contained in the layer region (OCN) to be formed while the distribution concentration of the atoms (OCN) taking a constant value of $C_1$, said distribution concentration being gradually continuously reduced from $C_2$ from the position $t_1$ to the interface position $t_T$, until at the interface position $t_T$, the distribution concentration C is made $C_3$.

Figure 44:
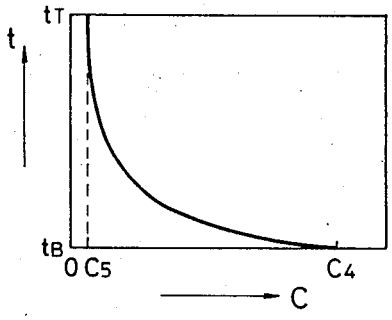

In the embodiment shown in FIG. 44, the distribution concentration C of the atoms (OCN) contained is reduced gradually continuously from the concentration $C_4$ from the position $t_B$ to the position $t_T$, at which it becomes the concentration $C_5$.

Figure 45:
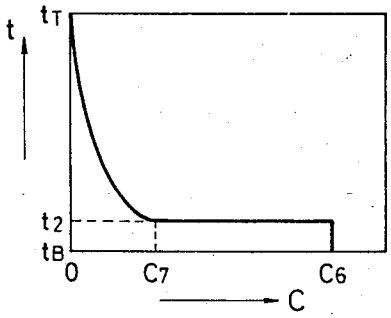

In the case of FIG. 45, from the position $t_B$ to the position $t_2$, the distribution concentration of the atoms (OCN) is made constantly at $C_6$, reduced gradually continuously from the concentration $C_7$ between the position $t_2$ and the position $t_T$, until at the position $t_T$, the distribution concentration C is made substantially zero (here substantially zero means the case of less than the detectable level).

Figure 46:
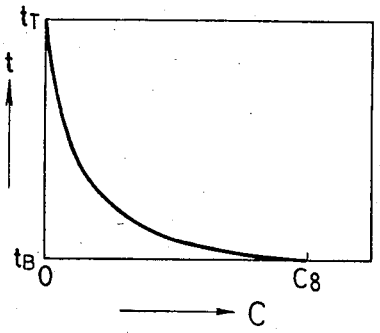

In the case of FIG. 46, the distribution concentration C of the atoms (OCN) is reduced gradually continuously from the concentration $C_8$ from the position $t_B$ up to the position $t_T$, to be made substantially zero at the position $t_T$.

Figure 47:
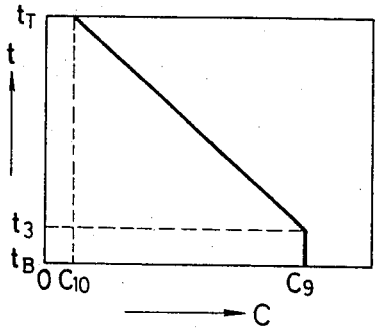

In the embodiment shown in FIG. 47, the distribution concentration C of the atoms (OCN) is made constantly $C_9$ between the position $t_B$ and the position $t_3$, and it is made the concentration $C_{10}$ at the position $t_T$. Between the position $t_3$ and the position $t_T$, the distribution concentration C is reduced from the concentration $C_9$ to substantially zero as a first order function from the position $t_3$ to the position $t_T$.

Figure 48:
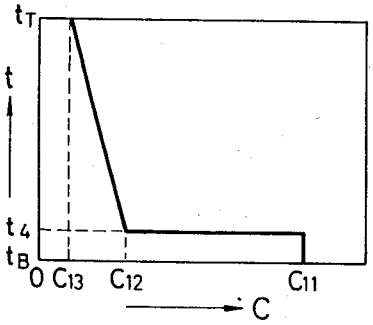

In the embodiment shown in FIG. 48, from the position $t_B$ to the position $t_4$, the distribution concentration C takes a constant value of $C_{11}$, while the distribution state is changed to a first order function in which the concentration is decreased from the concentration $C_{12}$ to the concentration $C_{13}$ from the position $t_4$ to the position $t_T$, and the concentration C is made substantially zero at the position $t_T$.

Figure 49:
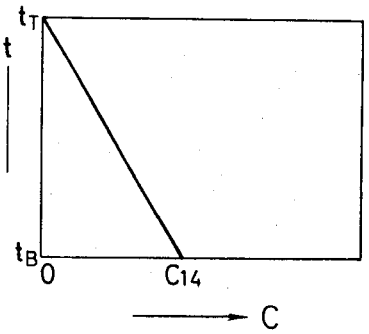

In the embodiment shown in FIG. 49, from the position $t_B$ to the position $t_T$, the distribution concentration C of the atoms (OCN) is reduced as a first order function from the concentration $C_{14}$ to substantially zero.

Figure 50:
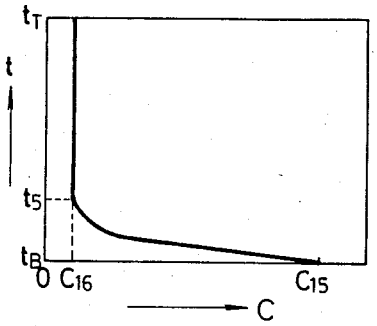

In FIG. 50, there is shown an embodiment, wherein from the position $t_B$ to the position $t_5$, the distribution concentration of the atoms (OCN) is reduced approximately as a first order function from the concentration $C_{15}$ to $C_{16}$, and it is made constantly $C_{16}$ between the position $t_5$ and the position $t_T$.

Figure 51:
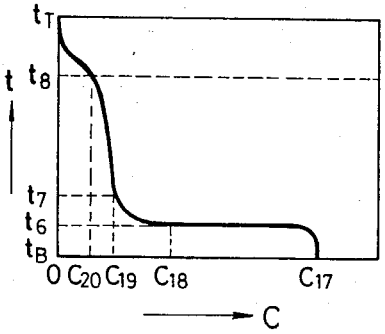

In the embodiment shown in FIG. 51, the distribution concentration C of the atoms (OCN) is $C_{17}$ position $t_B$, and, toward the position $t_6$, this $C_{17}$ is initially reduced gradually and then abruptly reduced near the position $t_6$, until it is made the concentration $C_{18}$ at the position $t_6$.

Between the position $t_6$ and the position $t_7$, the concentration is initially reduced abruptly and thereafter gently gradually reduced to become $C_{19}$ at the position $t_7$, and between the position $t_7$ and the position $t_8$, it is reduced very gradually to become $C_{20}$ at the position $t_8$. Between the position $t_8$ and the position $t_T$, the concentration is reduced from the concentration $C_{20}$ to substantially zero along a curve with a shape as shown in the Figure.

As described above about some typical examples of depth profiles in the layer thickness direction of the atoms (OCN) contained in the layer region (OCN) by referring to FIGS. 43 through 51, it is desirable in the present invention that, when the atoms (OCN) are to be contained ununiformly in the layer region (OCN), the atoms (OCN) should be distributed in the layer region (OCN) with higher concentration on the substrate side, while having a portion considerably depleted in concentration on the interface $t_T$ side as compared with the substrate side.

The layer region (OCN) containing atoms (OCN) should desirably be provided so as to have a localized region (B) containing the atoms (OCN) at a relatively higher concentration on the substrate side as described above, and in this case, adhesion between the substrate and the light-receiving layer can be further improved.

The above localized region (B) should desirably be provided within 5 $\mu$ from the interface position $t_B$, as explained in terms of the symbols indicated in FIGS. 43 through 51.

In the present invention, the above localized region (B) may be made the whole of the layer region ($L_T$) from the interface position $t_B$ to 5 $\mu$ thickness or a part of the layer region ($L_T$).

It may suitably be determined depending on the characteristics required for the light-receiving layer to be formed whether the localized region (B) is made a part or the whole of the layer region ($L_T$).

The localized region (B) should preferably be formed to have a depth profile in the layer thickness direction such that the maximum value Cmax of the distribution concentration of the atoms (OCN) may preferably be 500 atomic ppm or more, more preferably 800 atomic ppm or more, most preferably 1000 atomic ppm or more.

In other words, in the present invention, the layer region (OCN) containing the atoms (OCN) should preferably be formed so that the maximum value Cmax of the distribution concentration C may exist within 5 $\mu$ layer thickness from the substrate side (in the layer region with 5 $\mu$ thickness from $t_B$).

In the present invention, when the layer region (OCN) is provided so as to occupy a part of the layer region of the light-receiving layer, the depth profile of the atoms (OCN) should desirably be formed so that the refractive index may be changed moderately at the interface between the layer region (OCN) and other layer regions.

By doing so, reflection of the light incident upon the light-receiving layer from the interface between contacted interfaces can be inhibited, whereby appearance of interference fringe pattern can more effectively be prevented.

It is also preferred that the distribution concentration C of the atoms (OCN) in the layer region (OCN) should be changed along a line which is changed continuously and moderately, in order to give smooth refractive index change.

In this regard, it is preferred that the atoms (OCN) should be contained in the layer region (OCN) so that the depth profiles as shown, for example, in FIGS. 43 through 46, FIG. 49 and FIG. 51 may be assumed.

In the present invention, for provision of a layer region (OCN) containing the atoms (OCN) in the light-receiving layer, a starting material for introduction of the atoms (OCN) may be used together with the starting material for formation of the light-receiving layer during formation of the light-receiving layer and incorporated in the layer formed while controlling its amount.

When the glow discharge method is employed for formation of the layer region (OCN), a starting material for introduction of the atoms (OCN) is added to the material selected as desired from the starting materials for formation of the light-receiving layer as described above. For such a starting material for introduction of the atoms (OCN), there may be employed most of gaseous or gasified gasifiable substances containing at least the atoms (OCN) as the constituent atoms.

More specifically, there may be included, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$); lower siloxanes containing silicon atom (Si), oxygen atom (O) and hydrogen atom (H) as constituent atoms, such as disiloxane ($H_3SiOSiH_3$), trisiloxane ($H_3SiOSiH_2OSiH_3$), and the like; saturated hydrocarbons having 1–5 carbon atoms such as methane ($CH_4$), ethane ($C_2H_6$), propane ($C_3H_8$), n-butane (n-$C_4H_{10}$), pentane ($C_5H_{12}$); ethylenic hydrocarbons having 2–5 carbon atoms such as ethylene ($C_2H_4$), propylene ($C_3H_6$), butene-1 ($C_4H_8$), butene-2 ($C_4H_8$), isobutylene ($C_4H_8$), pentene ($C_5H_{10}$); acetylenic hydrocarbons having 2–4 carbon atoms such as acetylene ($C_2H_2$), methyl acetyllene ($C_3H_4$), butyne ($C_4H_6$); and the like; nitrogen ($N_2$), ammonia ($NH_3$), hydrazine ($H_2NNH_2$), hydrogen azide ($HN_3$), ammonium azide ($NH_4N_3$), nitrogen trifluoride ($F_3N$), nitrogen tetrafluoride ($F_4N$) and so on.

In the case of the sputtering method, as the starting material for introduction of the atoms (OCN), there may also be employed solid starting materials such as $SiO_2$, $Si_3N_4$ and carbon black in addition to those gasifiable as enumerated for the glow discharge method. These can be used in the form of a target for sputtering together with the target of Si, etc.

In the present invention, when forming a layer region (OCN) containing the atoms (OCN) during formation of the light-receiving layer, formation of the layer region (OCN) having a desired depth profile in the direction of layer thickness formed by varying the distribution concentration C of the atoms (OCN) contained in said layer region (OCN) may be conducted in the case of glow discharge by introducing a starting gas for introduction of the atoms (OCN) the distribution concentration C of which is to be varied into a deposition chamber, while varying suitably its gas flow rate according to a desired change rate curve.

For example, by the manual method or any other method conventionally used such as an externally driven motor, etc., the opening of a certain needle valve provided in the course of the gas flow channel system may be gradually varied. During this operation, the rate of variation is not necessarily required to be linear, but the flow rate may be controlled according to a variation rate curve previously designed by means of, for example, a microcomputer to give a desired content curve.

When the layer region (OCN) is formed according to the sputtering method, formation of a desired depth profile of the atoms (OCN) in the layer thickness direction by varying the distribution concentration C of the atoms (OCN) may be performed first similarly as in the case of the glow discharge method by employing a starting material for introduction of the atoms (OCN) under gaseous state and varying suitably as desired the gas flow rate of said gas when introduced into the deposition chamber. Secondly, formation of such a depth profile can also be achieved by previously changing the composition of a target for sputtering. For example, when a target comprising a mixture of Si and $SiO_2$ is to be used, the mixing ratio of Si to $SiO_2$ may be varied in the direction of layer thickness of the target.

The thickness of the surface layer having the reflection preventive function is determined as follows.

When the refractive index of the material of the surface layer is given by n and the wavelength of the irradiated light by λ, the thickness d of the surface layer having the reflection preventive function should preferred to be:

$$d=(\lambda/4n)\ m$$

(m is an odd number)

On the other hand, as the material for the surface layer 1005, when the refractive index of the second layer on which the surface layer is to be deposited is given by $n_a$, a material having the following refractive index is most preferred:

$$n=(n_a)^{\frac{1}{2}}.$$

When such optical conditions are taken into consideration, the thickness of the charge injection preventive layer should preferably be made 0.05 to 2 μm, provided that the wavelength of the irradiated light is within the wavelength region from near infrared to visible light.

In the present invention, as the material to be effectively used for the surface layer 1005 having the reflection preventive function, there may be included, for example, inorganic fluorides, inorganic oxides or inorganic nitrides such as $MgF_2$, $Al_2O_3$, $ZrO_2$, $TiO_2$, ZnS, $CeO_2$ $CeF_2$, $Ta_2O_5$, $AlF_3$, NaF, etc. or organic compounds such as polyvinyl chloride, polyamide resin, polyimide resin, vinylidene fluoride, melamine resin, epoxy resin, phenol resin, cellulose acetate, etc.

For deposition of these materials, in order to accomplish more effectively the objects of the present invention, there may be employed the vapor deposition method, the sputtering method, the plasma chemical vapor deposition method (PCVD method), the optical CvD method, the thermal CVD method and the coating method, because the layer thickness can be controlled accurately on an optical level according to these methods.

The substrate to be used in the present invention may be either electroconductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. At least one side surface of these substrates is preferably subjected to treatment for imparting electroconductivity, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 1004 in FIG. 10 is to be used as the light-receiving member for electrophotography, it may desirably be formed into an endless belt or a cylinder for use in continuous high speed copying. The substrate may have a thickness, which is conveniently determined so that the light-receiving member as desired may be formed. When the light-receiving member is required to have a flexibility, the substrate is made as thin as possible, so far as the function of a support can be exhibited. However, in such a case, the thickness is generally 10 μ or more from the points of fabrication and handling of the substrate as well as its mechanical strength.

Next, an example of the process for producing the light-receiving member of this invention is to be briefly described.

Figure 20:
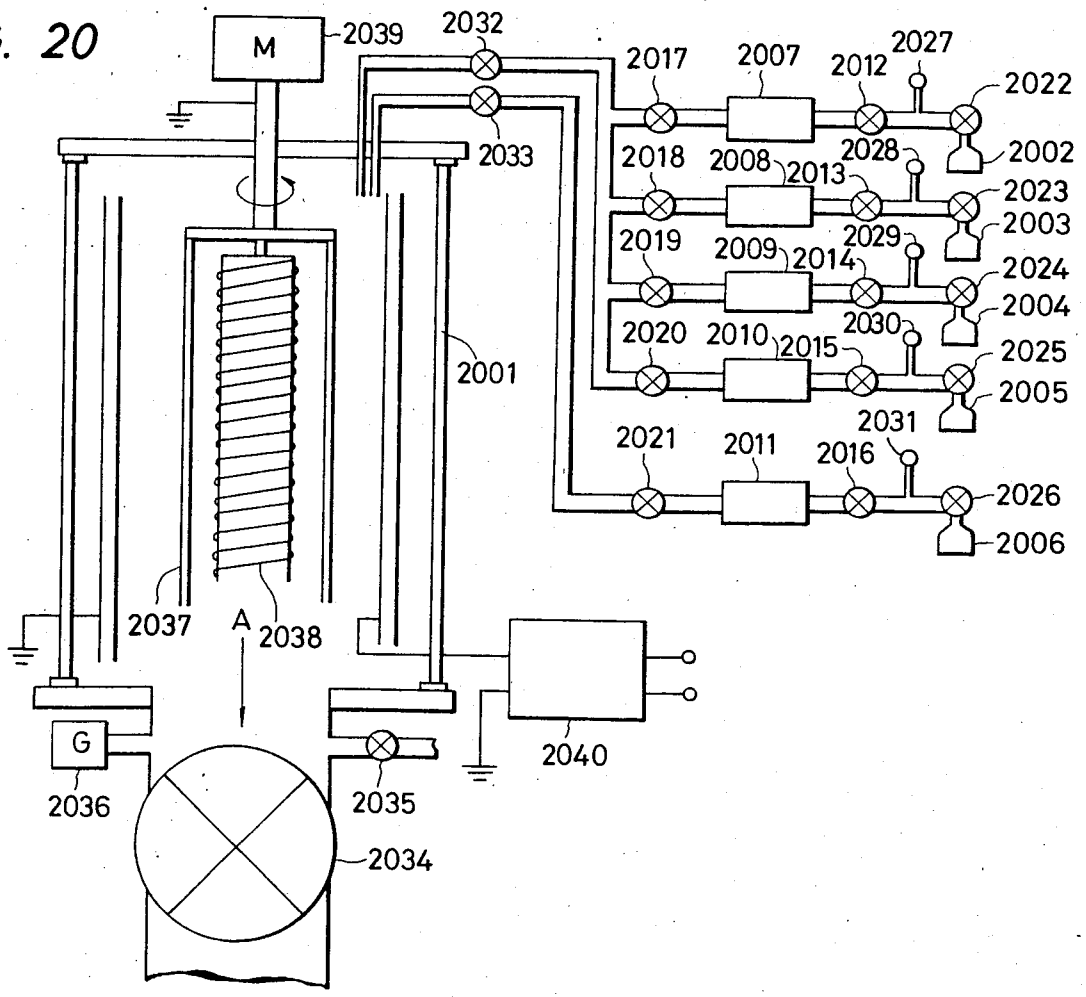
FIG. 20 and FIG. 63 each are schematic illustrations of the vacuum deposition device for preparation of the light-receiving members employed in Examples.

FIG. 20 shows one example of a device for producing a light-receiving member.

In the gas bombs 2002 to 2006, there are hermetically contained starting gases for formation of the light-receiving member of the present invention. For example, 2002 is a bomb containing $SiH_4$ gas (purity 99.999%, hereinafter abbreviated as $SiH_4$), 2003 is a bomb contaiing $GeH_4$ gas (purity 99.999%, hereinafter abbreviated as $GeH_4$), 2004 is a bomb containing NO gas (purity 99.99%, hereinafter abbreviated as NO), 2005 is bomb containing $B_2H_6$ gas diluted with $H_2$ (purity 99.999%, hereinafter abbreviated as $B_2H_6/H_2$) and 2006 is a bomb containing $H_2$ gas (purity: 99.999%).

For allowing these gases to flow into the reaction chamber 2001, on confirmation of the valves 2022 to 2026 of the gas bombs 2002 to 2006 and the leak valve 2035 to be closed, and the inflow valves 2012 to 2016, the outflow valves 2017 to 2021 and the auxiliary valves 2032 and 2033 to be opened, the main valve 2034 is first opened to evacuate the reaction chamber 2001 and the gas pipelines. As the next step, when the reading on the vacuum indicator 2036 becomes $5\times10^{-6}$ Torr, the auxiliary valves 2032, 2033 and the outflow valves 2017 to 2021 are closed.

Referring now to an example of forming a light-receiving layer on the cylindrical substrate 2037, $SiH_4$ gas from the gas bomb 2002, $GeH_4$ gas from the gas bomb 2003, NO gas from the gas bomb 2004, $B_2H_6/H_2$ gas from the gas bomb 2005 and $H_2$ gas from the gas bomb 2006 are permitted to flow into the mass-flow controllers 2007, 2008, 2009, 2010 and 2011, respectively, by opening the valves 2022, 2023, 2024, 2025 and 2026 and controlling the pressures at the output pressure gauges 2027, 2028, 2029 2030 and 2031 to 1 $Kg/cm^2$ and opening gradually the inflow valves 2012, 2013, 2014, 2015 and 2016, respectively. Subsequently, the outflow valves 2017, 2018, 2019, 2020 and 2021 and the auxiliary valves 2032 and 2033 were gradually opened to permit respective gases to flow into the reaction chamber 2001. The outflow valves 2017, 2018, 2019, 2020 and 2021 are controlled so that the flow rate ratio of $SiH_4$ gas, $GeH_4$ gas, $B_2H_6/H_2$ gas, NO gas and $H_2$ may have a desired value and opening of the main valve 2034 is also controlled while watching the reading on the vacuum indicator 2036 so that the pressure in the reaction chamber 2001 may reach a desired value. And, after confirming that the temperature of the substrate 2037 is set at 50° to 400° C. by the heater 2038, the power source 2040 is set at a desired power to excite glow discharge in the reaction chamber 2001, simultaneously with controlling of the distributed concentrations of germanium atoms and boron atoms to be contained in the layer formed by carrying out the operation to change gradually the openings of the valves 2018, 2020 by the manual method or by means of an externally driven motor, etc. thereby changing the flow rates of $GeH_4$ gas and $B_2H_6$ gas according to previously designed change rate curves.

By maintaining the glow discharge as described above for a desired period time, the first layer (G) is formed on the substrate 2037 to a desired thickness. At the stage when the first layer (G) is formed to a desired thickness, the second layer (S) containing substantially no germanium atom can be formed on the first layer (G) by maintaining glow discharge according to the same conditions and procedure as those in formation of the first layer (G) except for closing completely the outflow valve 2018 and changing, if desired, the discharging conditions. Also, in the respective layers of the first layer (G) and the second layer (S), by opening or closing as desired the outflow valves 2019 or 2020, oxygen atoms or boron atoms may be contained or not, or oxygen atoms or boron atoms may be contained only in a part of the layer region of the respective layers.

When nitrogen atoms or carbon atoms are to be contained in place of oxygen atoms, layer formation may be conducted by replacing NO gas in the gas bomb 2004 with $NH_3$ or $CH_4$. Also, when the kinds of the gases employed are desired to be increased, bombs of desirable gases may be provided additionally before carrying out layer formation similarly.

Next, in order to deposit a surface layer on the second layer (S), for example, the hydrogen ($H_2$) gas bomb 2006 is replaced with an argon (Ar) gas bomb, the deposition device is cleaned, and a material for the surface layer are placed on the whole surface of the cathode electrode. Then, a light-receiving member having layers up to the second layer (S) formed thereon is set in the deposition device, and the device is evacuated, followed by introduction of argon gas. Then, glow discharge is generated to sputter the surface layer material to form the surface layer to a desired thickness. During layer formation, for uniformization of the layer formation, it is desirable to rotate the substrate 2037 by means of a motor 2039 at a constant speed.

The present invention is described in more detail by referring to the following Examples.

EXAMPLE 1

In this Example, a semiconductor laser (wavelength: 780 nm) with a spot size of 80 μm was employed. Thus, on a cylindrical aluminum substrate [length (L) 357 mm, outer diameter (r) 80 mm] on which A-Si:H is to be deposited, a spiral groove at a pitch (P) of 25 μm and a depth (D) of 0.8 s was prepared by a lathe. The shape of the groove is shown in FIG. 9.

Figure 63:
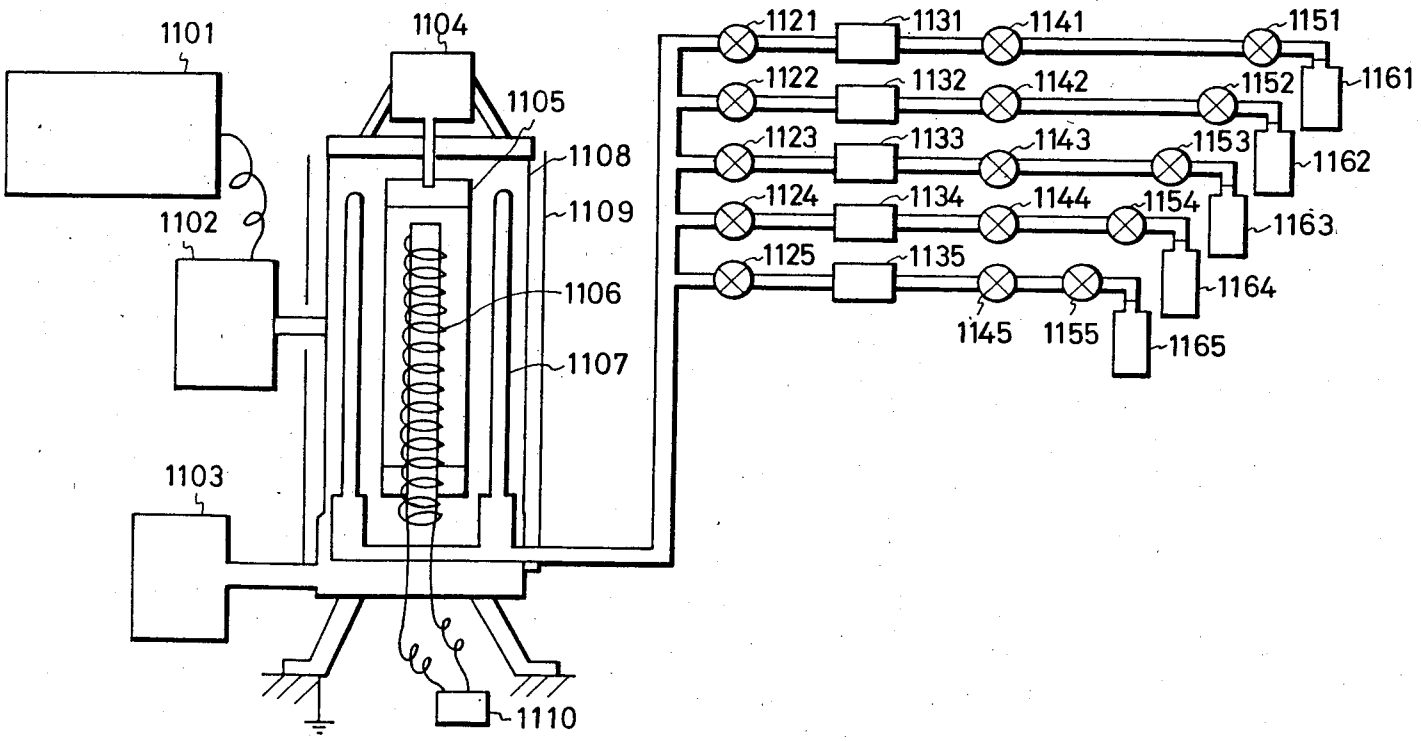

On this aluminum substrate, the charge injection preventive layer and the photosensitive layer were deposited by means of the device as shown in FIG. 63 in the following manner.

First, the constitution of the device is to be explained. 1101 is a high frequency power source, 1102 is a matching box, 1103 is a diffusion pump and a mechanical booster pump, 1104 is a motor for rotation of the aluminum substrate, 1105 is an aluminum substrate, 1106 is a heater for heating the aluminum substrate, 1107 is a gas inlet tube, 1108 is a cathode electrode for introduction of high frequency, 1109 is a shield plate, 1110 is a power source for heater, 1121 to 1125, 1141 to 1145 are valves, 1131 to 1135 are mass flow controllers, 1151 to 1155 are regulators, 1161 is a hydrogen ($H_2$) bomb, 1162 is a silane ($SiH_4$) bomb, 1163 is a diboroane ($B_2H_6$) bomb, 1164 is a nitrogen monoxide (NO) bomb and 1165 is a methane ($CH_4$) bomb.

Next, the preparation procedure is to be explained. All of the main cocks of the bombs 1161–1165 were closed, all the mass flow controllers and the valves were opened and the deposition device was internally evacuated by the diffusion pump 1103 to $10^{-7}$ Torr. At the same time, the aluminum substrate 1105 was heated by the heater 1106 to 250° C. and maintained constantly at 250° C. After the aluminum substrate 1105 became constantly at 250° C., the valves 1121–1125, 1141–1145 and 1151–1155 were closed, the main cocks of bombs 1161–1165 opened and the diffusion pump 1103 was changed to the mechanical booster pump. The secondary pressure of the valve equipped with regulators 1151–1155 was set at 1.5 $Kg/cm^2$. The mass flow controller 1131 was set at 300 SCCM, and the valves 1141 and 1121 were successively opened to introduce $H_2$ gas into the deposition device.

Next, by setting the mass flow controller 1132 at 150 SCCM, $SiH_4$ gas in 1161 was introduced into the deposition device according to the same procedure as introduction of $H_2$ gas. Then, by setting the mass flow controller 1133 so that $B_2H_6$ gas flow rate of the bomb 1163 may be 1600 Vol. ppm relative to $SiH_4$ gas flow rate, $B_2H_6$ gas introduced into the deposition device according to the same procedure as introduction of $H_2$ gas.

And, when the inner pressure in the deposition device was stabilized at 0.2 Torr, the high frequency power source 1101 was turned on and glow discharge was generated between the aluminum substrate 1105 and the cathode electrode 1108 by controlling the matching box 1102, and an A-Si:H:B layer (p-type A-Si:H layer containing B) was deposited to a thickness of 5 μm at a high frequency power of 150 W (charge injection preventive layer). After deposition of the 5 μm thick A-Si:H:B layer (p-type), inflow of $B_2H_6$ was stopped by closing the valves 1123 without discontinuing discharging.

And, an A-Si:H layer (non-doped) with a thickness of 20 μm was deposited at a high frequency power of 150 W (photosensitive layer). Then, with the high frequency power source and all the valves being closed, the deposition device was evacuated, the temperature of the aluminum substrate lowered to room temperature and the substrate having formed the light-receiving layer thereon was taken out.

According to the same method, 22 cylinders having formed layers up to the photosensitive layer thereon were prepared.

Next, the hydrogen ($H_2$) bomb 1161 was replaced with argon (Ar) gas bomb, the deposition device cleaned and a target comprising the surface layer material as shown in Table 1A (condition No. 101 A) was placed over the entire surface of the cathode electrode. One of the substrates having formed layers to the above photosensitive layer was set in the device, and the deposition device was sufficiently evacuated by means of a diffusion pump. Thereafter, argon gas was introduced to 0.015 Torr, and glow discharge was excited at a high frequency power of 150 W to effect sputtering of the surface material, thereby depositing a surface layer 6505 of Table 1A (Condition No. 101 A) on the above substrate (Sample No. 101 A). For remaining 21 substrates, the surface layers were formed under the conditions as shown in Table 1A (condition Nos. 102A–122A) to deposit surface layers thereon (Sample Nos. 102A–122A).

Figure 64:
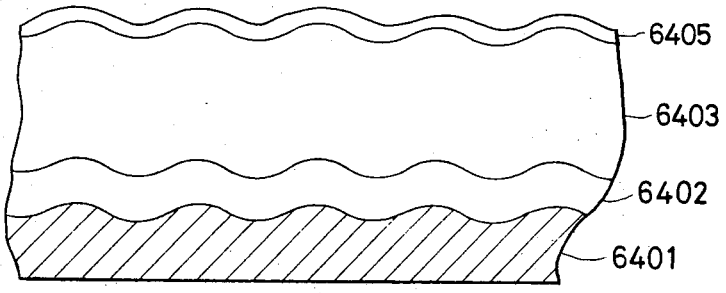
FIGS. 64, 65, 82 and 83 are illustrations of the structures of the light-receiving members prepared in Examples.

Separately, on the cylindrical aluminum substrate with the same surface characteristic, the charge injection preventive layer, photosensitive layer and surface layer were formed in the same manner as described above except for changing the high frequency power to 50 W. As the result, as shown in FIG. 64, the surface of the photosensitive layer 6403 was found to be in parallel to the surface of the substrate 6401. In this case, the difference in the total thickness between the center and both ends of the aluminum substrate was found to be 1 μm.

Also, in the cases where the high frequency power was 150 W as described above, as shown in FIG. 65, the surface of the photosensitive layer 6503 was found to be non-parallel to the surface of the substrate 6501. In this case, the difference in the total thickness between the center and both ends of the aluminum substrate was found to be 2 μm.

Figure 26:
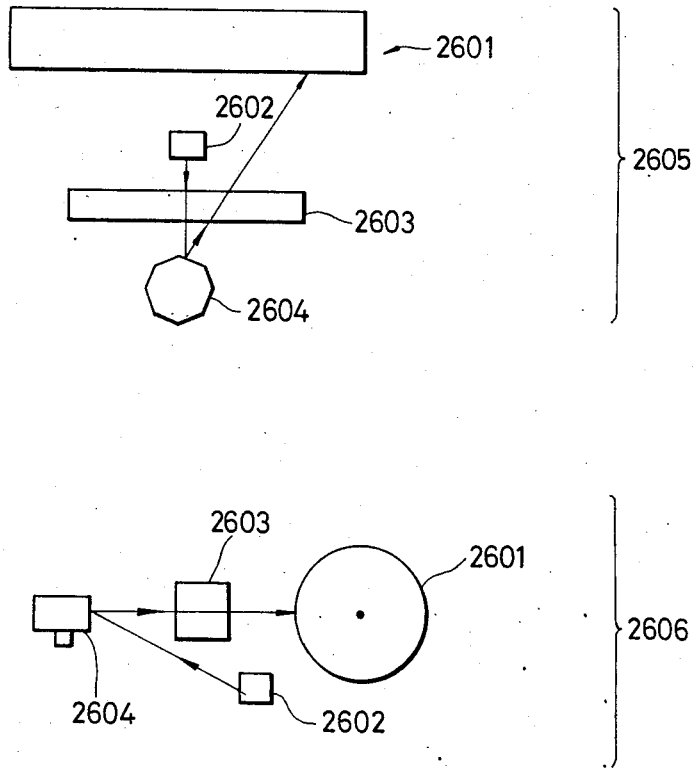
FIG. 26 is a schematic illustration of a device for image exposure employed in Examples.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 at a high frequency power of 50 W during layer preparation, an interference fringe pattern was observed.

Figure 65:
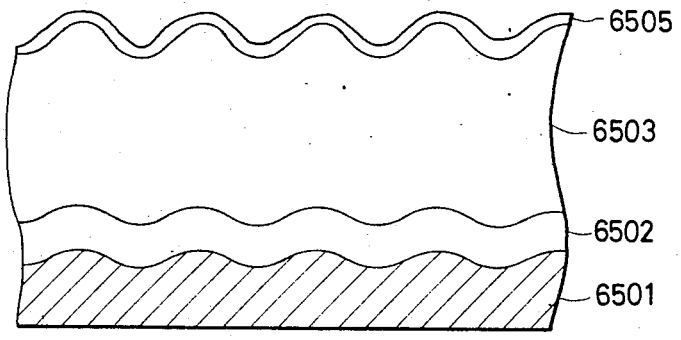

On the other hand, in the light-receiving member having the surface characteristic as shown in FIG. 65, no interference fringe pattern was observed and the member obtained exhibited practically satisfactory electrophotographic characteristics.

EXAMPLE 2

By means of a lathe, the surface of a cylindrical aluminum substrate was worked as shown in Table 2A. On these cylindrical aluminum substrates (Nos. 201A–208A), under the same condition as in the case when no interference fringe pattern was observed (high frequency power: 150 W) in Example 1, light-receiving members for electrophotography were prepared (Sample Nos. 211A–218A). The difference in average layer thickness between the center and the both ends of the aluminum substrate of the light-receiving members for electrophotography was found to be 2 μm.

The cross-sections of these light-receiving members for electrophotography were observed by electron microscope and the difference within the pitch of the photosensitive layer was measured to give the results as shown in Table 3A. For these light-receiving members, image exposure was effected by means of the device shown in FIG. 26 with a semiconductor laser with a wavelength of 780 nm at a spot diameter of 80 μm similarly as in Example 1 to obtain the results shown in Table 3A.

EXAMPLE 3

Except for the following points, light-receiving members were prepared under the same conditions as in Example 2. The layer thickness of the charge injection preventive layer was made 10 μm. The difference in average layer thickness between the center and both ends of the charge injection preventive layer was found to be 1 μm, and that of the photosensitive layer 2 μm. The thicknesses of the respective layers of Nos. 211A–218A were measured to obtain the results as shown in Table 4A. For these light-receiving members, in the same image exposure device as in Example 1, image exposure was effected to obtain the results as shown in Table 4A.

EXAMPLE 4

On cylindrical aluminum substrates having the surface characteristics as shown in Table 5A (Sylinder Nos. 401A–407A), light-receiving members having a silicon oxide layer provided thereon as a charge injection preventive layer were prepared in the following manner.

The silicon oxide layer was formed to a thickness of 0.2 μm by controlling the flow rate of $SiH_4$ at 50 SCCM and that of NO at 60 SCCM, following otherwise the same conditions as in preparation of the charge injection preventive layer as in Example 2.

On the silicon oxide layer were formed a photosensitive layer with a thickness of 20 μm and a surface layer under the same conditions as in Example 2.

The difference in average layer thickness between the center and the both ends of the light-receiving member for electrophotography was found to be 1 μm.

When these light-receiving members were observed by an electron microscope, the difference in layer thickness of the silicon oxide layer within the pitch on the surface of the aluminum cylinder was found to be 0.06 μm. Similarly, the difference in layer thickness of the A-Si:H photosensitive layer was found to give the results shown in Table 6A. When these light-receiving members for electrophotography were subjected to image exposure by laser beam similarly as in Example 1, the results shown in Table 6A were obtained.

EXAMPLE 5

On cylindrical aluminum substrates having the surface characteristics as shown in Table 5A (Nos. 401A–407A), light-receiving members having a silicon nitride layer provided thereon as a charge injection preventive layer were prepared in the following manner.

The silicon nitride layer was formed to a thickness of 0.2 μm by replacing NO gas in Example 4 with $NH_3$ gas and controlling the flow rate of $SiH_4$ at 30 SCCM and that of $NH_3$ at 200 SCCM, following otherwise the same conditions as in preparation of the charge injection preventive layer as in Example 2.

On the nitride oxide layer were formed a photosensitive layer with a thickness of 20 μm and a surface layer under the same conditions as in Example 2 except for applying a high frequency power of 100 W.

The difference in average layer thickness between the center and the both ends of the light-receiving member for electrophotography thus prepared was found to be 1 μm.

When these light-receiving members were observed by an electron microscope, the difference in layer thickness of the silicon nitride layer within each pitch was found to be 0.05 μm or less. Similarly, the difference in layer thickness of the A-Si:H photosensitive layer within each pitch was found to give the results shown in Table 7A. When these light-receiving members for electrophotography (Nos. 511A–517A) were subjected to image exposure by laser beam similarly as in Example 1, the results shown in Table 7A were obtained.

EXAMPLE 6

On cylindrical aluminum substrates having the surface characteristics as shown in Table 5A (Nos. 401A–407A), light-receiving members having a silicon carbide layer provided thereon as a charge injection preventive layer were prepared in the following manner.

The silicon carbide layer was formed by employing $CH_4$ gas and $SiH_4$ gas and controlling the flow rate of $SiH_4$ at 20 SCCM and that of $CH_4$ at 600 SCCM, following otherwise the same conditions as in preparation of the charge injection preventive layer as in Example 2.

On the silicon carbide layer were formed the A-Si:H photosensitive layer with a thickness of 20 μm and a surface layer under the same conditions as in Example 2.

The difference in average layer thickness between the center and the both ends of the light-receiving member for electrophotography thus prepared was found to be 1.5 μm.

When these A-Si:H light-receiving members were observed by an electron microscope, the difference in layer thickness of the silicon carbide layer within each pitch was found to be 0.07 μm or less. On the other hand, the difference in layer thickness of the A-Si:H photosensitive layer within each pitch was found to give the results shown in Table 8A. When these light-receiving members for electrophotography (Nos. 611A–617A) were subjected to image exposure by laser beam similarly as in Example 1, the results shown in Table 8A were obtained.

COMPARATIVE EXAMPLE 1

As a comparative test, an A-Si light-receiving member for electrophotography was prepared in entirely the same manner as in the case when the high frequency power was 150 W in Example 1 as described above except for employing an aluminum substrate roughened on its surface by the sand blasting method in place of the aluminum substrate used in preparation of the light-receiving member for electrography in Example 1. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 1, clear interference fringe was found to be formed in the black image over all the surface.

EXAMPLE 7

In this Example, a semiconductor laser (wavelength: 780 nm) with a spot size of 80 μm was employed. Thus, on a cylindrical aluminum substrate [length (L) 357 mm, outer diameter (r) 80 mm] on which A-Si:H is to be deposited, a spiral groove at a pitch (P) of 25 μm and a depth (D) of 0.8 s was prepared by a lathe. The shape of the groove is shown in FIG. 9.

On this aluminum substrate, the charge injection preventive layer and the photosensitive layer were deposited by means of the device as shown in FIG. 63 in the following manner.

First, the constitution of the device is to be explained. 1101 is a high frequency power source, 1102 is a matching box, 1103 is a diffusion pump and a mechanical booster pump, 1104 is a motor for rotation of the aluminum substrate, 1105 is an aluminum substrate, 1106 is a heater for heating the aluminum substrate, 1107 is a gas inlet tube, 1108 is a cathode electrode for introduction of high frequency, 1109 is a shield plate, 1110 is a power source for heater, 1121 to 1125, 1141 to 1145 are valves, 1131 to 1135 are mass flow controllers, 1151 to 1155 are regulators, 1161 is a hydrogen ($H_2$) bomb, 1162 is a silane ($SiH_4$) bomb, 1163 is a diboroane ($B_2H_6$) bomb, 1164 is a monenitrogen oxide (NO) bomb and 1165 is a methane ($CH_4$) bomb.

Next, the preparation procedure is to be explained. All of the main cocks of the bombs 1161–1165 were closed, all the mass flow controllers and the valves were opened and the deposition device was internally evacuated by the diffusion pump 1103 to $10^{-7}$ Torr. At the same time, the aluminum substrate 1105 was heated by the heater 1106 to 250° C. and maintained constantly at 250° C. After the aluminum substrate 1105 became constantly at 250° C., the valves 1121–1125, 1141–1145 and 1151–1155 were closed, the main cocks of bombs 1161–1165 opened and the diffusion pump 1103 was changed to the mechanical booster pump. The secondary pressure of the valve equipped with regulators 1151–1155 was set at 1.5 Kg/cm$^2$. The mass flow controller 1131 was set at 300 SCCM, and the valves 1141 and 1121 were successively opened to introduce $H_2$ gas into the deposition device.

Next, by setting the mass flow controller 1132 at 150 SCCM, $SiH_4$ gas in 1161 was introduced into the deposition device according to the same procedure as introduction of $H_2$ gas. Then, by setting the mass flow controller 1133 so that $B_2H_6$ gas flow rate of the bomb 1163 may be 1600 Vol. ppm relative to $SiH_4$ gas flow rate, $B_2H_6$ gas was introduced into the deposition device according to the same procedure as introduction of $H_2$ gas.

Then, by setting the mass flow controller 134 so as to control the flow rate of NO gas of 1164 at 3.4 Vol. % based on $SiH_4$ gas flow rate, NO gas was introduced into the deposition device according to the same procedure as introduction of $H_2$.

And, when the inner pressure in the deposition device was stabilized at 0.2 Torr, the high frequency power source 1101 was turned on and glow discharge was generated between the aluminum substrate 1105 and the cathode electrode 1108 by controlling the matching box 1102, and an A-Si:H:B:0 layer (p-type A-Si:H layer containing B:O) was deposited to a thickness of 5 μm at a high frequency power of 150 W (charge injection preventive layer). After deposition of the 5 μm thick A-Si:H:B:0 layer (p-type), inflow of $B_2H_6$ was stopped by closing the valves 1123 without discontinuing discharging.

And, an A-Si:H layer (non-doped) with a thickness of 20 μm was deposited at a high frequency power of 150 W (photosensitive layer). Then, with the high frequency power source and all the valves being closed, the deposition device was evacuated, the temperature of the aluminum substrate lowered to room temperature and the substrate having formed the light-receiving layer thereon was taken out.

According to the same method, 22 cylinders having formed layers up to the photosensitive layer thereon were prepared.

Next, the hydrogen ($H_2$) bomb 1161 was replaced with argon (Ar) gas bomb, the deposition device cleaned and a target comprising the surface layer material as shown in Table 1A (condition No. 101 A) was placed over the entire surface of the cathode electrode. One of the substrates having formed layers to the above photosensitive layer was set, and the deposition device was sufficiently evacuated by means of a diffusion pump. Thereafter, argon gas was introduced to 0.015 Torr, and glow discharge was excited at a high frequency power of 150 W to effect sputtering of the surface material, thereby depositing a surface layer 6505 of Table 1A (Condition No. 101 A) on the above substrate (Sample No. 101 B). For remaining 21 substrates, the surface layers were formed under the conditions as shown in Table 1A (condition Nos. 102 A–122 A) to deposit surface layers thereon (Sample Nos. 102 B–122 B).

Separately, on the cylindrical aluminum substrate with the same surface characteristic, the charge injection preventive layer, photosensitive layer and the surface layer were formed in the same manner as described above except for changing the high frequency power to 40 W. As the result, as shown in FIG. 64, the surface of the photosensitive layer 6403 was found to be in parallel to the surface of the substrate 6401. In this case, the difference in the total thickness between the center and both ends of the aluminum substrate was found to be 1 μm.

Also, in the case when the high frequency power was 150 W, as shown in FIG. 65, the surface of the photosensitive layer 6503 was found to be non-parallel to the surface of the substrate 6501. In this case, the difference in the total thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 at the high frequency power of 40 W during layer preparation, an interference fringe pattern was observed.

On the other hand, in the light-receiving member having the surface characteristic as shown in FIG. 65, no interference fringe pattern was observed and the member obtained exhibited practically satisfactory electrophotographic characteristics.

EXAMPLE 8

By means of a lathe, the surface of a cylindrical aluminum substrate was worked as shown in Table 2B. On these cylindrical aluminum substrates (No. 201 B–208 B), under the same condition as in the case when no interference fringe pattern was observed (high frequency power 160 W) in Example 7, light-receiving members for electrophotography were prepared Sample Nos. 211 B–218 B). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the photosensitive layer was measured to give the results as shown in Table 3B. For these light-receiving members, image exposure was effected by means of the device shown in FIG. 26 with a semiconductor laser with a wavelength of 780 nm at a spot diameter of 80 μm similarly as in Example 7 to obtain the results shown in Table 3B.

EXAMPLE 9

Except for the following points, light-receiving members (Nos. 311 B –318 B) were prepared under the same conditions as in Example 8. The layer thickness of the charge injection preventive layer was made 10 μm. The difference in average layer thickness between the center and both ends of the charge injection preventive layer was found to be 1.2 μum, and that of the photosensitive layer 2.3 μm. The thicknesses of the respective layers of Nos. 311 B–318 B were measured to obtain the results as shown in Table 4B. For these light-receiving members, in the same image exposure device as in Example 7, image exposure was effected to obtain the results as shown in Table 4B.

EXAMPLE 10

On cylindrical aluminum substrates having the surface characteristics shown in Table 2B (Nos. 201 B–208 B), light-receiving members having charge injection preventive layers containing nitrogen provided thereon were prepared under the conditions shown in Table 5B (Nos. 401 B–408 B).

The cross-sections of the light-receiving members prepared under the above conditions were observed with an electron microscope. The difference in average layer thickness between the center and the both ends of the charge injection preventive layer was found to be 0.09 μm. The difference in average layer thickness of the photosensitive layer was found to be 3 μm.

The layer thickness difference within the short range of the photosensitive layer in each light-receiving member was found to have the value shown in Table 6B.

For respective light-receiving members, image exposure was effected by laser beam similarly as in Example 7 to obtain the results as shown in Table 6B.

EXAMPLE 11

On cylindrical aluminum substrates having the surface characteristics shown in Table 2B (Nos. 201 B–208B), charge injection preventive layers containing nitrogen were prepared under the conditions shown in Table 7B (Nos. 501 B–508B).

The cross-sections of the light-receiving members prepared under the above conditions were observed with an electron microscope. The difference in average layer thickness between the center and the both ends of the charge injection preventive layer was found to be 0.3 μm. The difference in average layer thickness of the photosensitive layer was found to be 3.2 μm.

The layer thickness difference within the short range of the photosensitive layer in each light-receiving member was found to have the value shown in Table 8B.

For respective light-receiving members, image exposure was effected by laser beam similarly as in Example 7 to obtain the results as shown in Table 8B.

EXAMPLE 12

On cylindrical aluminum substrates having the surface characteristics shown in Table 2B (Nos. 201 B–208 B), charge injection preventive layers containing carbon were prepared under the conditions shown in Table 9B (Nos. 1001 B–1008 B).

The cross-sections of the light-receiving members prepared under the above conditions were observed with an electron microscope. The difference in average layer thickness between the center and the both ends of the charge injection preventive layer was found to be 0.08 μm. The difference in average layer thickness of the photosensitive layer was found to be 2.5 μm.

The layer thickness difference within the short range of the photosensitive layer in each light-receiving member was found to have the value shown in Table 10B.

For respective light-receiving members, image exposure was effected by laser beam similarly as in Example 7 to obtain the results as shown in Table 10B.

EXAMPLE 13

On cylindrical aluminum substrates having the surface characteristics shown in Table 2B (Nos. 201 B–208 B), charge injection preventive layers containing carbon were prepared under the conditions shown in Table 11B (Nos. 1201 B–1208 B).

The cross-sections of the light-receiving members prepared under the above conditions were observed with an electron microscope. The difference in average layer thickness between the center and the both ends of the charge injection preventive layer was found to be 1.1 μm. The difference in average layer thickness of the photosensitive layer was found to be 3.4 μm.

The layer thickness difference within the short range of the photosensitive layer in each light-receiving member was found to have the value shown in Table 12B.

For respective light-receiving members, image exposure was effected by laser beam similarly as in Example 7 to obtain the results as shown in Table 12B.

COMPARATIVE EXAMPLE 2

As a comparative test, an a-Si light-receiving member for electrophotography was prepared in entirely the same manner as in the case when the high frequency power was 150 W in Example 7 as described above except for employing an aluminum substrate roughened on its surface by the sand blasting method in place of the aluminum substrate used in preparation of the light-receiving member for electrography in Example 7. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 7, clear interference fringe was found to be formed in the black image over all the surface.

EXAMPLE 14

In this Example, a semiconductor laser (wavelength: 780 nm) with a spot size of 80 μm was employed. Thus, on a cylindrical aluminum substrate [length (L) 357 mm, outer diameter (r) 80 mm] on which A-Si:H is to be deposited, a spiral groove at a pitch (P) of 25 μm and a depth (D) of 0.8 s was prepared by a lathe. The shape of the groove is shown in FIG. 9.

On this aluminum substrate, the charge injection preventive layer and the photosensitive layer were deposited by means of the device as shown in FIG. 63 in the following manner.

First, the constitution of the device is to be explained. 1101 is a high frequency power source, 1102 is a matching box, 1103 is a diffusion pump and a mechanical booster pump, 1104 is a motor for rotation of the aluminum substrate, 1105 is an aluminum substrate, 1106 is a heater for heating the aluminum substrate, 1107 is a gas inlet tube, 1108 is a cathode electrode for introduction of high frequency, 1109 is a shield plate, 1110 is a power source for heater, 1121 to 1125, 1141 to 1145 are valves, 1131 to 1135 are mass flow controllers, 1151 to 1155 are requlators, 1161 is a hydroqen ($H_2$) bomb, 1162 is a silane ($SiH_4$bomb 1163 is a diboroane ($B_2H_6$) bomb, 1164 is a nitrogen oxide (NO) bomb and 1165 is a methane ($CH_4$) bomb.

Next, the preparation procedure is to be explained. All of the main cocks of the bombs 1161–1165 were closed, all the mass flow controllers and the valves were opened and the deposition device was internally evacuated by the diffusion pump 1103 to $10^{-7}$ Torr. At the same time, the aluminum substrate 1105 was heated by the heater 1106 to 250° C. and maintained constantly at 250° C. After the aluminum substrate 1105 became constantly at 250° C., the valves 1121–1125, 1141–1145 and 1151–1155 were closed, the main cocks of bombs 1161–1165 opened and the diffusion pump 1103 was changed to the mechanical booster pump. The secondary pressure of the valve equipped with regulators 1151–1155 was set at 1.5 Kg/cm$^2$. The mass flow controller 1131 was set at 300 SCCM, and the valves 1141 and 1121 were successively opened to introduce $H_2$ gas into the deposition device.

Next, by setting the mass flow controller 1132 at 150 SCCM, $SiH_4$ gas in 1161 was introduced into the deposition device according to the same procedure as introduction of $H_2$ gas. Then, by setting the mass flow controller 1133 so that $B_2H_6$ gas flow rate of the bomb 1163 may be 1600 Vol. ppm relative to $SiH_4$ gas flow rate, $B_2H_6$ gas was introduced into the deposition device according to the same procedure as introduction of $H_2$ gas.

Then, by setting the mass flow controller 1134 so as to control the flow rate of NO gas of 1164 at 3.4 Vol. % based on $SiH_4$ gas flow rate, NO gas was introduced into the deposition device according to the same procedure as introduction of $H_2$.

And, when the inner pressure in the deposition device was stabilized at 0.2 Torr, the high frequency power source 1101 was turned on and glow discharge was generated between the aluminum substrate 1105 and the cathode electrode 1108 by controlling the matching box 1102, and an A-Si:H:B:O layer (p-type A-Si:H layer containing B; O) was deposited to a thickness of 5 μm at a high frequency power of 160 W (charge injection preventive layer).

NO gas flow rate was changed relative to $SiH_4$ gas flow rate as shown in FIG. 49 until the NO gas flow rate become zero on completion of layer formation. After deposition of the 5 μm thick A-Si:H:B:O layer (p-type), inflow of $B_2H_6$ and NO was stopped by closing the valves 1123 and 1124 without discontinuing discharging.

And, an A-Si:H layer (non-doped) with a thickness of 20 μm was deposited at a high frequency power of 160 W (photosensitive layer). Then, with the high frequency power source and all the valves being closed, the deposition device was evacuated, the temperature of the aluminum substrate lowered to room temperature and the substrate having formed the light-receiving layer thereon was taken out (Sample No. 1-1C).

According to the same method, 22 cylinders having formed layers up to the photosensitive layer thereon were prepared.

Next, the hydrogen ($H_2$) bomb 1161 was replaced with argon (Ar) gas bomb, the deposition device cleaned and a target comprising the surface layer material as shown in Table 1A (condition No. 101 A) was placed over the entire surface of the cathode electrode. One of the substrates having formed layers to the above photosensitive layer was set, and the deposition device was sufficiently evacuated by means of a diffusion pump. Thereafter, argon gas was introduced to 0.015 Torr, and glow discharge was excited at a high frequency power of 150 W to effect sputtering of the surface material, thereby depositting a surface layer 6505 of Table 1A (Condition No. 101 A) on the above substrate (Sample No. 101 C). For remaining 21 substrates, the surface layers were formed under the conditions as shown in Table 1A (condition Nos. 102 A–122 A) to deposit surface layers thereon (Sample Nos. 102 C–122 C).

Separately, on the cylindrical aluminum substrate with the same surface characteristic, the charge injection preventive layer, the photosensitive layer and the surface layer were formed in the same manner as described above except for changing the high frequency power to 40 W. As the result, as shown in FIG. 64, the surface of the photosensitive layer 6403 was found to be in parallel to the surface of the substrate 6401. In this case, the difference in the total thickness between the center and both ends of the aluminum substrate was found to be 1 μm (Sample No. 1-2C).

Also, in the case when the above high frequency power was 160 W (Sample No. 1-1C), as shown in FIG. 65, the surface of the photosensitive layer 6503 was found to be non-parallel to the surface of the substrate 6501. In this case, the difference in the total thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 (Sample No. 1-2C) at the high frequency power was 40 W during layer preparation, an interference fringe pattern was observed.

On the other hand, in the light-receiving member having the surface characteristic as shown in FIG. 65 (Sample No. 1-1C), no interference fringe pattern was observed and the member obtained exhibited practically satisfactory electrophotographic characteristics.

EXAMPLE 15

By means of a lathe, the surface of a cylindrical aluminum substrate was worked as shown in Table 2C. On these cylindrical aluminum substrates (Nos. 201 C–208 C), under the same condition as in the case when no interference fringe pattern was observed (high frequency power 160 W) in Example 14, light-receiving members for electrophotography were prepared (Sample Nos. 211 C–218 C). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the photosensitive layer was measured to give the results as shown in Table 3C. For these light-receiving members, image exposure was effected by means of the device shown in FIG. 26 with a semiconductor laser with a wavelength of 780 nm at a spot diameter of 80 μm similarly as in Example 14 to obtain the results shown in Table 3C.

EXAMPLE 16

Except for the following points, light-receiving members (Nos. 311 C–318 C) were prepared under the same conditions as in Example 15. The layer thickness of the charge injection preventive layer was made 10 μm. The difference in average layer thickness between the center and both ends of the charge injection preventive layer was found to be 1.2 μm, and that of the photosensitive layer 2.3 μm. The thicknesses of the respective layers of Nos. 311 C–318 C were measured to obtain the results as shown in Table 4C. For these light-receiving members, in the same image exposure device as in Example 14, image exposure was effected to obtain the results as shown in Table 4C.

EXAMPLE 17

On cylindrical aluminum substrates having the surface characteristics shown in Table 2C (Nos. 201 C–208 C), light-receiving members having charge injection preventive layers containing nitrogen provided thereon were prepared under the conditions shown in Table 5C (Nos. 401 C–408 C).

The cross-sections of the light-receiving members prepared under the above conditions were observed with an electron microscope. The difference in average layer thickness between the center and the both ends of the charge injection preventive layer was found to be 0.09 μm. The difference in average layer thickness of the photosensitive layer was found to be 3 μm.

The layer thickness difference within the short range of the photosensitive layer in each light-receiving member was found to have the value shown in Table 6C.

For respective light-receiving members, image exposure was effected by laser beam similarly as in Example 14 to obtain the results as shown in Table 6C.

EXAMPLE 18

On cylindrical aluminum substrates having the surface characteristics shown in Table 2C (Nos. 201 C–208 C), charge injection preventive layers containing nitrogen were prepared under the conditions shown in Table 7C (Nos. 501 C–508 C).

The cross-sections of the light-receiving members prepared under the above conditions were observed with an electron microscope. The difference in average layer thickness between the center and the both ends of the charge injection preventive layer was found to be 0.3 μm. The difference in average layer thickness of the photosensitive layer was found to be 3.2 μm.

The layer thickness difference within the short range of the photosensitive layer in each light-receiving member was found to have the value shown in Table 8C.

For respective light-receiving members, image exposure was effected by laser beam similarly as in Example 14 to obtain the results as shown in Table 8C.

EXAMPLE 19

On cylindrical aluminum substrates having the surface characteristics shown in Table 2C (Nos. 201 C–208 C), charge injection preventive layers containing carbon were prepared under the conditions shown in Table 9C (Nos. 1001 C–1008 C).

The cross-sections of the light-receiving members prepared under the above conditions were observed with an electron microscope. The difference in average layer thickness between the center and the both ends of the charge injection preventive layer was found to be 0.08 μm. The difference in average layer thickness of the photosensitive layer was found to be 2.5 μm.

The layer thickness difference within the short range of the photosensitive layer in each light-receiving member was found to have the value shown in Table 10C.

For respective light-receiving members, image exposure was effected by laser beam similarly as in Example 14 to obtain the results as shown in Table 10C.

EXAMPLE 20

On cylindrical aluminum substrates having the surface characteristics shown in Table 2C (Nos. 201 C–208 C), charge injection preventive layers containing carbon were prepared under the conditions shown in Table 11C (Nos. 1201 C–1208 C).

The cross-sections of the light-receiving members prepared under the above conditions were observed with an electron microscope. The difference in average layer thickness between the center and the both ends of the charge injection preventive layer was found to be 1.1 μm. The difference in average layer thickness of the photosensitive layer was found to be 3.4 μm.

The layer thickness difference within the short range of the photosensitive layer in each light-receiving member was found to have the value shown in Table 12C.

For respective light-receiving members, image exposure was effected by laser beam similarly as in Example 14 to obtain the results as shown in Table 12C.

EXAMPLE 21

By means of the device shown in FIG. 63, layer formations were performed on cylindrical aluminum substrate (Cylinder No. 105 A) by changing the gas flow rate ratio of NO to $SiH_4$ according to the change rate curves of gas flow rate ratio shown in FIGS. 66 through 69 under the respective conditions shown in Tables 13C to 16C with lapse of time for layer formation, following otherwise the same conditions and the procedure as in Example 14 to prepare respective light-receiving members for electrophotography (Sample Nos. 1301 C–1304 C).

The light-receiving members thus obtained were evaluated following the same procedure under the same conditions as in Example 14. As the result, no interference fringe pattern was observed at all with naked eyes, and sufficiently good electrophotographic characteristics were exhibited as suited for the objects of the present invention.

EXAMPLE 22

Figure 66:
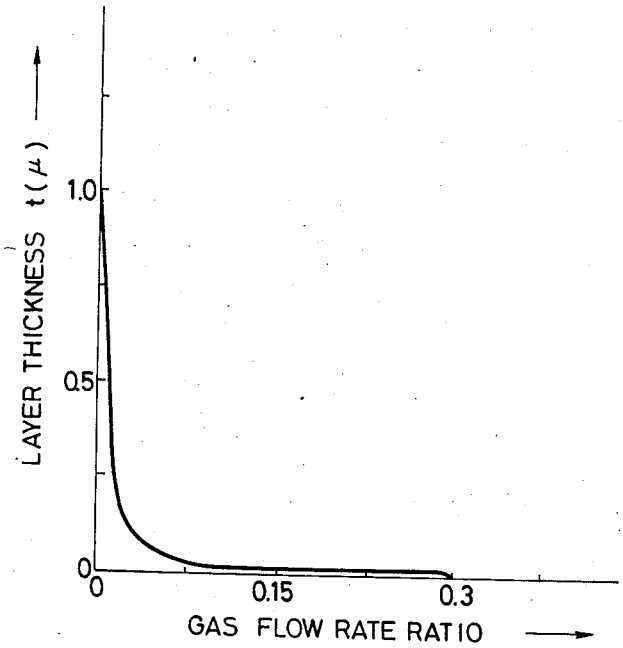
Figure 67:
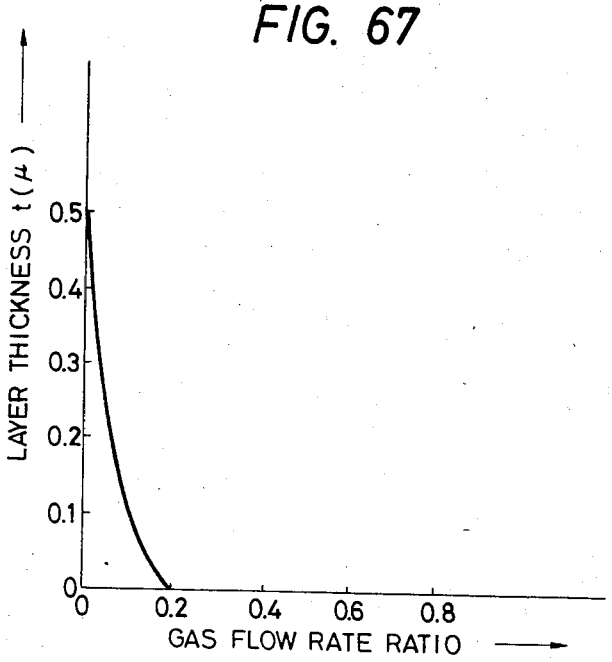

By means of the device shown in FIG. 63, layer formations were performed on cylindrical aluminum substrate (Cylinder No. 105 A) by changing the gas flow rate ratio of NO to $SiH_4$ according to the change rate curves of gas flow rate ratio shown in FIGS. 66 under the respective conditions shown in Table 17C with lapse of time for layer formation, following otherwise the same conditions and the procedure as in Example 14 to prepare light-receiving members for electrophotography.

The light-receiving members thus obtained were evaluated following the same procedure under the same conditions as in Example 14. As the result, no interference fringe pattern was observed at all with naked eyes, and sufficiently good electrophotographic characteristics were exhibited as suited for the objects of the present invention.

COMPARATIVE EXAMPLE 3

As a comparative test, an a-Si light-receiving member for electrophotography was prepared in entirely the same manner as in the case when the high frequency power was 150 W in Example 14 as described above except for employing an aluminum substrate roughened on its surface by the sand blasting method in place of the aluminum substrate used in preparation of the light-receiving member for electrography in Example 14. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 14 , clear interference fringe was found to be formed in the black image over all the surface.

EXAMPLE 23

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, an a-Si light-receiving layer was deposited on the above aluminum substrate following various procedures under the condition No. 101 A in Table 1A and the conditions as shown in Table 4D using the deposition device as shown in FIG. 20 (Sample No. 1–1D).

Formation of the surface layer was carried out as follows. After formation of the second layer, the hydrogen ($H_2$) bomb was replaced with argon (Ar) gas bomb, the deposition device cleaned and the surface layer material as shown in the condition 101 A in table 1A was placed on the entire surface of the cathode electrode. The above light-receiving member was set and, the deposition device was brought to reduced pressure sufficiently by means of a diffusion pump. Then, argon gas was introduced to 0.015 Torr and glow discharging excited at a high frequency power of 150 W to sputter the surface layer material, thereby forming the surface layer of the condition No. 101 A in Table 1A.

Figure 82:
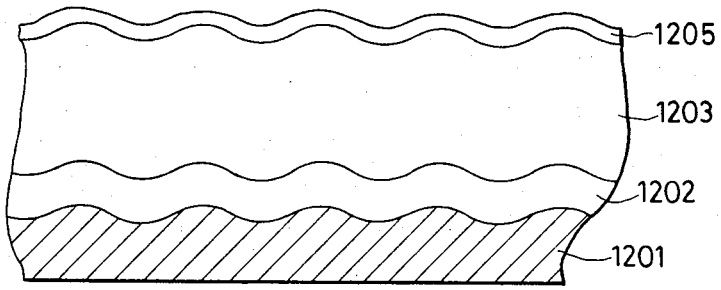

Separately, on the cylindrical aluminum substrate having the same characteristic, a light-receiving layer was formed similarly as in the above case except for changing the discharging power in formation of both the first layer and the second ayer to 50 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2D).

Figure 83:
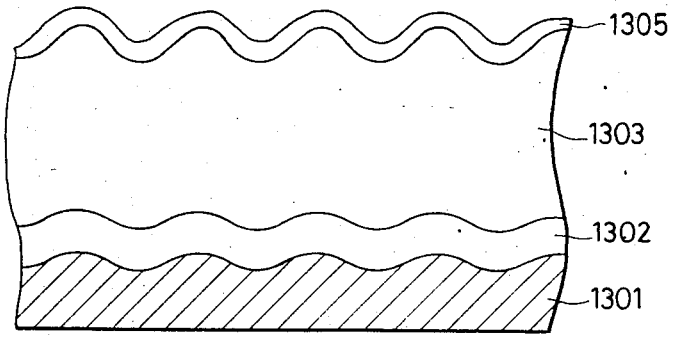

On the other hand, in the case of the above Sample No. 1-1 D, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

Light-receiving members were prepared according to the same method as described above except for forming the surface layer under the condition Nos. 102 A-122 A in Table 1A.

The light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 24

By means of a lathe, the surface of a cylindrical aluminum substrate was worked as shown in Table 2D. On these cylindrical aluminum substrates (Cylinder Nos. 101 D-108 D), under the same condition as in the case of the Sample No. 1-1 D in Example 23, light-receiving members for electrophotography were prepared (Sample Nos. 111 D-118 D). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3D. For these light-receiving members, image exposure was effected by means of the device shown in FIG. 26 with a semiconductor conductor laser with a wavelength of 780 nm at a spot diameter of 80 μm to obtain the results shown in Table 3D.

EXAMPLE 25

Light-receiving members for electrophotography were formed in the same manner as in the case of Sample No. 1-1 D in Example 23 under the conditions as shown in Table 5D.

For these light-receiving members for electrophotography, by means of the same image exposure device as in Example 23, image exposure was effected, followed by development, transfer and fixing to obtain visible images on plain papers.

The images obtained in this case were free from any interference fringe pattern observed, exhibiting practically satisfactory characteristics.

EXAMPLE 26

Light-receiving members for electrophotography were formed in the same manner as in the case of Sample No. 1-1 D in Example 23 under the conditions as shown in Table 6D.

For these light-receiving members for electrophotography, by means of the same image exposure device as in Example 23, image exposure was effected, followed by development, transfer and fixing to obtain visible images on plain papers.

The images obtained in this case were free from any interference fringe pattern observed, exhibiting practically satisfactory characteristics.

EXAMPLE 27

Light-receiving members for electrophotography were formed in the same manner as in the case of Sample No. 1-1 D in Example 23 under the conditions as shown in Table 7D.

For these light-receiving members for electrophotography, by means of the same image exposure device as in Example 23, image exposure was effected, followed by development, transfer and fixing to obtain visible images on plain papers.

The images obtained in this case were free from any interference fringe pattern observed, exhibiting practically satisfactory characteristics.

COMPARATIVE EXAMPLE 4

As a comparative test, an a-Si light-receiving member for electrophotography was prepared in entirely the same manner as in the case of Sample No. 1-1 D in Example 23 as described above except for employing an aluminum substrate roughened on its surface by the sand blasting method in place of the aluminum substrate used in preparation of the light-receiving member for electrography in Example 23. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 23, clear interference fringe was found to be formed in the black image over all the surface.

EXAMPLE 28

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving layers were deposited on the above aluminum substrate following various procedures under the condition No. 101 A in Table 1A and the conditions as shown in Table 4E using the deposition device as shown in FIG. 20 (Sample No. 1-1E).

Figure 22:
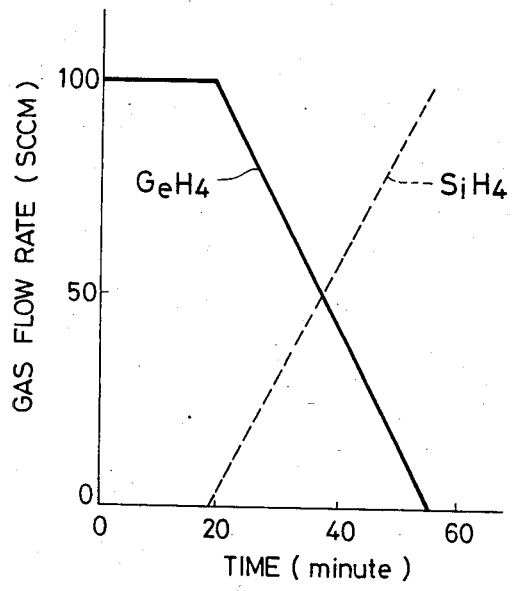
FIGS. 22 through 25, FIGS. 36 through 42, FIGS. 52 through 62 and FIGS. 66 through 81 are schematic illustrations showing changes in gas flow rates of respective gases in Examples.

In preparation of the first layer of a-(Si:Ge):H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

Formation of the surface layer was carried out as follows. After formation of the second layer, the hydrogen ($H_2$) bomb was replaced with argon (AR) gas bomb, the deposition device cleaned and the surface layer material as shown in the condition No. 101 A in Table 1A was placed on the entire surface of the cathode electrode. The above light-receiving member was set and, the deposition device was brought to reduced pressure sufficiently by means of a diffusion pump. Then, argon gas was introduced to 0.015 Torr and glow discharging excited at a high frequency power of 150 W to sputter the surface layer material, thereby forming the surface layer of the condition No. 101 A in Table 1A.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2 E).

On the other hand, in the case of the above Sample No. 1-1 E, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

Light-receiving members were prepared according to the same method as described above except for forming the surface layer under the conditions Nos. 102 A-122 A in Table 1A.

The light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 29

By means of a lathe, the surface of a cylindrical aluminum substrate was worked as shown in Table 2E. On these cylindrical aluminum substrates (Cylinder Nos. 101 E-108 E), under the same condition as in the case of the Sample No. 1-1 E in Example 28, light-receiving members for electrophotography were prepared (Sample Nos. 111 E-118 E). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3E. For these light-receiving members, image exposure was effected by means of the device shown in FIG. 26 with a semiconductor laser with a wavelength of 780 nm at a spot diameter of 80 μm similarly as in Example 28 to obtain the results shown in Table 3E.

EXAMPLE 30

Light-receiving members for electrophotography were formed in the same manner as in the case of Sample No. 1-1 E in Example 28 under the conditions as shown in Table 4E.

Figure 23:
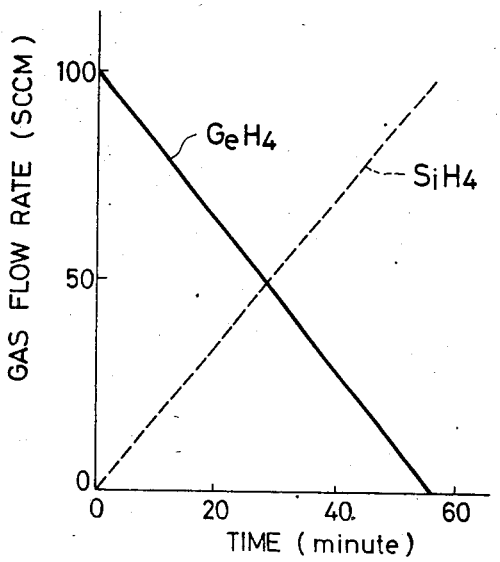

In preparation of the first layer of a-(Si: Ge):H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same image exposure device as in Example 28, image exposure was effected, followed by development, transfer and fixing to obtain visible images on plain papers.

The images obtained in this case were free from any interference fringe pattern observed, exhibiting practically satisfactory characteristics.

EXAMPLE 31

Light-receiving members for electrophotography were formed in the same manner as in the case of Sample No. 1-1E in Example 28 under the conditions as shown in Table 5E.

Figure 24:
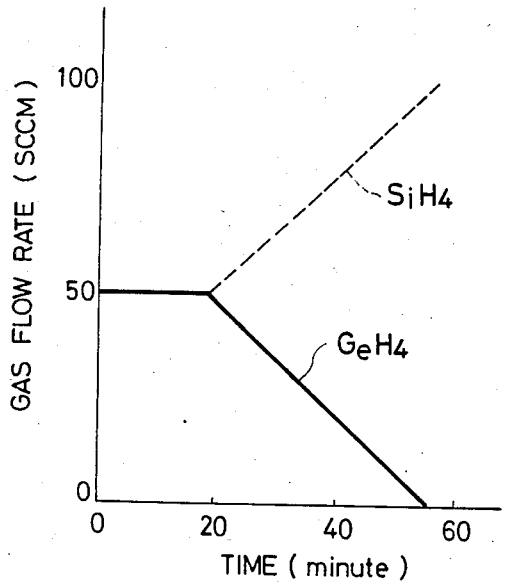

In preparation of the first layer of a-(Si: Ge):H layer, the mass flow controllers 2007 and 2008 for $GeH_4$ and $SiH_4$ were controlled by a computer (HP 9845B) so that the flow rates of $GeH_4$ and $SiH_4$ might be as shown in FIG. 24.

For these light-receiving members for electrophotography, by means of the same image exposure device as in Example 28, image exposure was effected, followed by development, transfer and fixing to obtain visible images on plain papers.

The images obtained in this case were free from any interference fringe pattern observed, exhibiting practically satisfactory characteristics.

EXAMPLE 32

Light-receiving members for electrophotography were formed in the same manner as in the case of Sample No. 1-1E in Example 28 under the conditions as shown in Table 5E.

Figure 25:
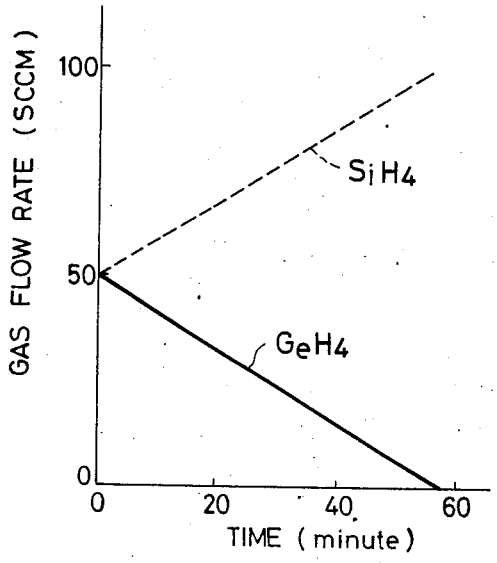

In preparation of the first layer of a-(Si: Ge):H layer, the mass flow controllers 2007 and 2008 for $GeH_4$ and $SiH_4$ were controlled by a computer (HP 9845B) so that the flow rates of $GeH_4$ and $SiH_4$ might be as shown in FIG. 25.

For these light-receiving members for electrophotography, by means of the same image exposure device as in Example 28, image exposure was effected, followed by development, transfer and fixing to obtain visible images on plain papers.

The images obtained in this case were free from any interference fringe pattern observed, exhibiting practically satisfactory characteristics.

COMPARATIVE EXAMPLE 5

As a comparative test, an a-Si light-receiving member for electrophotography was prepared in entirely the same manner as in the case of Sample No. 1-1E in Example 28 as described above except for employing an aluminum substrate roughened on its surface by the sand blasting method in place of the aluminum substrate used in preparation of the light-receiving member for electrography in Example 28. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 28, clear interference fringe was found to be formed in the black image over all the surface.

EXAMPLE 33

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving layers were deposited on the above aluminum substrate following various procedures under the condition No. 101A in Table 1A and the conditions as shown in Table 4F using the deposition device as shown in FIG. 20 (Sample No. 1-1F).

Formation of the surface layer was carried out as follows. After formation of the second layer, the hydrogen ($H_2$) bomb was replaced with argon (Ar) gas bomb, the deposition device cleaned and the surface layer material as shown in the condition No. 101A in Table 1A was placed on the entire surface of the cathode electrode. The above light-receiving member was set and, the deposition device was brought to reduced pressure sufficiently by means of a diffusion pump. Then, argon gas was introduced to 0.015 Torr and glow discharging excited at a high frequency power of 150 W to sputter the surface layer material, thereby forming the surface layer of the condition No. 101 A in Table 1A.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2F).

On the other hand, in the case of the above Sample No. 1-1F, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

Light-receiving members were prepared according to the same method as described above except for forming the surface layer under the conditions Nos. 102A-122A in Table 1A.

The light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 34

By means of a lathe, the surface of a cylindrical aluminum substrate was worked as shown in Table 2F. On these cylindrical aluminum substrates (Cylinder Nos. 101F-108F), under the same condition as in the case of the Sample No. 1-1F in Example 33, light-receiving members for electrophotography were prepared (Sample Nos. 111F-118F). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3F. For these light-receiving members, image exposure was effected by means of the device shown in FIG. 26 with a semiconductor laser with a wavelength of 780 nm at a spot diameter of 80 μm similarly as in Example 33 to obtain the results shown in Table 3F.

EXAMPLE 35

Light-receiving members for electrophotography were formed in the same manner as in the case of Sample No. 1-1F in Example 33 under the conditions as shown in Table 5F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 36

Light-receiving members for electrophotography were formed in the same manner as in the case of Sample No. 1-1F in Example 33 under the conditions as shown in Table 6F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 37

Light-receiving members for electrophotography were formed in the same manner as in the case of Sample No. 1-1F in Example 33 under the conditions as shown in Table 7F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 38

Light-receiving members for electrophotography were formed in the same manner as in the case of Sample No. 1-1F in Example 33 under the conditions as shown in Table 8F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 39

Light-receiving members for electrophotography were formed in the same manner as in the case of Sample No. 1-1F in Example 33 under the conditions as shown in Table 9F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 40

Light-receiving members for electrophotography were formed in the same manner as in the case of Sample No. 1-1F in Example 33 under the conditions as shown in Table 10F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 41

Light-receiving members for electrophotography were formed in the same manner as in the case of Sample No. 1-1F in Example 33 under the conditions as shown in Table 11F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 42

Light-receiving members for electrophotography were formed in the same manner as in the case of Sample No. 1-1F in Example 33 under the conditions as shown in Table 12F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 43

Light-receiving members for electrophotography were formed in the same manner as in the case of Sample No. 1-1F in Example 33 under the conditions as shown in Table 13F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 44

Light-receiving members for electrophotography were formed in the same manner as in the case of Sample No. 1-1F in Example 33 under the conditions as shown in Table 14F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 45

Light-receiving members for electrophotography were formed in the same manner as in the case of Sample No. 1-1F in Example 33 under the conditions as shown in Table 15F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 46

Light-receiving members for electrophotography were formed in the same manner as in the case of Sample No. 1-1F in Example 33 under the conditions as shown in Table 16F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 47

Light-receiving members for electrophotography were formed in the same manner as in the case of Sample No. 1-1F in Example 33 under the conditions as shown in Table 17F.

For these light-receiving members for electrophotography, by means of the same image exposure device as in Example 33, image exposure was effected, followed by development, transfer and fixing to obtain visible images on plain papers.

The images obtained in this case were free from any interference fringe pattern observed, exhibiting practically satisfactory characteristics.

EXAMPLE 48

The case of Sample No. 1-1F in Example 33 and Examples 35 to 47 were repeated except that $PH_3$ gas diluted to 3000 vol ppm with $H_2$ was employed in place of $R_2H_6$ gas diluted to 3000 vol ppm with $H_2$ to prepare light-receiving members for electrophotography respectively.

Other preparation conditions were the same as the case of Sample No. 1-1F in Example 33 and in Examples 35 to 47.

For these light-receiving members for electrophotography, image exposure was effected by means of an image exposure device as shown in FIG. 26 (wavelength of laser beam 780 nm, spot diameter 80 μm), followed by development and transfer, to obtain images. All of the images were free from interference fringe pattern and practically satisfactory.

COMPARATIVE EXAMPLE 6

As a comparative test, an a-Si light-receiving member for electrophotography was prepared in entirely the same manner as in the case of Sample No. 1-1F in Example 33 as described above except for employing an aluminum substrate roughened on its surface by the sand blasting method in place of the aluminum substrate used in preparation of the light-receiving member for electrography in Example 33. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 33, clear interference fringe was found to be formed in the black image over all the surface.

EXAMPLE 49

An aluminum substrate having the shape as shown in FIG. 9 (spiral groove surface shape with length (L): 357 mm, outerdiameter (r): 80 mm; pitch (P) 25 μm, depth (D) 0.8 μm) was prepared.

Next, a-Si light-receiving layers were deposited on the above aluminum substrate following various procedures under the condition No. 101A in Table 1A and the conditions as shown in Table 4G using the deposition device as shown in FIG. 20 (Sample No. 1-1G).

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

Formation of the surface layer was carried out as follows. After formation of the second layer, the hydrogen ($H_2$) bomb was replaced with argon (Ar) gas bomb, the deposition device cleaned and the surface layer material as shown in the condition No. 101A in Table 1A was placed on the entire surface of the cathode electrode. The above light-receiving member was set and, the deposition device was brought to reduced pressure sufficiently by means of a diffusion pump. Then, argon gas was introduced to 0.015 Torr and glow discharging excited at a high frequency power of 150 W to sputter the surface layer material, thereby forming the surface layer of the condition No. 101A in Table 1A.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2G).

On the other hand, in the case of the above Sample No. 1-1G, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

Light-receiving members were prepared according to the same method as described above except for forming the surface layer under the conditions Nos. 102A-122A in Table 1A.

The light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 50

By means of a lathe, the surface of a cylindrical aluminum substrate was worked as shown in Table 2G. On these cylindrical aluminum substrates (Cylinder Nos. 101G–108G), under the same condition as in the case of the Sample No. 1–1G in Example 49, light-receiving members for electrophotograhy were prepared (Sample Nos. 111G–118G). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3G. For these light-receiving members, image exposure was effected by means of the device shown in FIG. 26 with a semiconductor laser with a wavelength of 780 nm at a spot diameter of 80 μm similarly as in Example 49 to obtain the results shown in Table 3G.

EXAMPLE 51

Light-receiving members for electrophotography were formed in the same manner as in the case of Sample No. 1–1G in Example 49 under the conditions as shown in Table 4G.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same image exposure device as in Example 49, image exposure was effected, followed by development, transfer and fixing to obtain visible images on plain papers.

The images obtained in this case were free from any interference fringe pattern observed, exhibiting practically satisfactory characteristics.

EXAMPLE 52

Light-receiving members for electrophotography were formed in the same manner as in the case of Sample No. 1–1G in Example 49 under the conditions as shown in Table 5G.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

For these light-receiving members for electrophotography, by means of the same image exposure device as in Example 49, image exposure was effected, followed by development, transfer and fixing to obtain visible images on plain papers.

The images obtained in this case were free from any interference fringe pattern observed, exhibiting practically satisfactory characteristics.

EXAMPLE 53

Light-receiving members for electrophotography were formed in the same manner as in the case of Sample No. 1–1G in Example 49 under the conditions as shown in Table 5G.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same image exposure device as in Example 49, image exposure was effected, followed by development, transfer and fixing to obtain visible images on plain papers.

The images obtained in this case were free from any interference fringe pattern observed, exhibiting practically satisfactory characteristics.

EXAMPLE 54

Light-receiving members for electrophotography were formed in the same manner as in the case of Sample No. 1–1G in Example 49 under the conditions as shown in Table 6G.

In preparation of the first layer of a-(Si:Ge):H:B layer, the mass flow controllers 2007 and 2008 for $GeH_4$ and $SiH_4$ were controlled by a computer ($HP_{9845}B$) so that the flow rates of $GeH_4$ and $SiH_4$ might be as shown in FIG. 22.

For these light-receiving members for electrophotography, by means of the same image exposure device as in Example 49, image exposure was effected, followed by development, transfer and fixing to obtain visible images on plain papers.

The images obtained in this case were free from any interference fringe pattern observed, exhibiting practically satisfactory characteristics.

EXAMPLE 55

Light-receiving members for electrophotography were formed in the same manner as in the case of Sample No. 1–1G in Example 49 under the conditions as shown in Table 7G.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$and $SiH_4$ might be as shown in FIG. 24.

For these light-receiving members for electrophotography, by means of the same image exposure device as in Example 49, image exposure was effected, followed by development, transfer and fixing to obtain visible images on plain papers.

The images obtained in this case were free from any interference fringe pattern observed, exhibiting practically satisfactory characteristics.

EXAMPLE 56

Light-receiving members for electrophotography were formed in the same manner as in the case of Sample No. 1–1G in Example 49 under the conditions as shown in Table 8G.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$and $SiH_4$ might be as shown in FIG. 25.

For these light-receiving members for electrophotography, by means of the same image exposure device as in Example 49, image exposure was effected, followed by development, transfer and fixing to obtain visible images on plain papers.

The images obtained in this case were free from any interference fringe pattern observed, exhibiting practically satisfactory characteristics.

EXAMPLE 57

Light-receiving members for electrophotography were formed in the same manner as in the case of Sample No. 1-1G in Example 49 under the conditions as shown in Table 9G.

In preparation of the first layer of a-(Si:Ge):H:B layer, the mass controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same image exposure device as in Example 49, image exposure was effected, followed by development, transfer and fixing to obtain visible images on plain papers.

The images obtained in this case were free from any interference fringe pattern observed, exhibiting practically satisfactory characteristics.

EXAMPLE 58

The case of Sample No. 1-1G in Example 49 and Examples 51 to 57 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as the case of Sample No. 1-1G in Example 49 and in Examples 51 to 57.

For these light-receiving members for electrophotography, image exposure was effected by means of an image exposure device as shown in FIG. 26 (wavelength of laser beam 780 nm, spot diameter 80 μm), followed by development and transfer, to obtain images. All of the images were free from interference fringe pattern and practically satisfactory.

COMPARATIVE EXAMPLE 7

As a comparative test, an a-Si light-receiving member for electrophotography was prepared in entirely the same manner as in the case of Sample No. 1-1G in Example 49 as described above except for employing an aluminum substrate roughened on its surface by the sand blasting method in place of the aluminum substrate used in preparation of the light-receiving member for electrography in Example 49. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 49, clear interference fringe was found to be formed in the black image over all the surface.

EXAMPLE 59

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving layers were deposited on the above aluminum substrate following various procedures under the condition No. 101A in Table 1A and the conditions as shown in Table 4H using the deposition device as shown in FIG. 20 (Sample No. 1-1H).

Formation of the surface layer was carried out as follows. After formation of the second layer, the hydrogen ($H_2$) bomb was replaced with argon (Ar) gas bomb, the deposition device cleaned and the surface layer material as shown in the condition No. 101A in Table 1A was placed on the entire surface of the cathode electrode. The above light-receiving member was set and, the deposition device was brought to reduced pressure sufficiently by means of a diffusion pump. Then, argon gas was introduced to 0.015 Torr and glow discharging excited at a high frequency power of 150 W to sputter the surface layer material, thereby forming the surface layer of the condition No. 101A in Table 1A.

Separately, on the cylindrical aluminum substrate having the same characteristic, a light-receiving layer was formed silimarly as in the above case except for changing the discharging power in formation of both the first layer and the second layer to 50 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2H).

On the other hand, in the case of the above Sample No. 1-1H, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

Light-receiving members were prepared according to the same method as described above except for forming the surface layer under the conditions Nos. 102A-122A in Table 1A.

The light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 60

By means of a lathe, the surface of a cylindrical aluminum substrate was worked as shown in Table 2H. On these cylindrical aluminum substrates (Cylinder Nos. 101H-108H), under the same condition as in the case of the Sample No. 1-1H in Example 59, light-receiving members for electrophotography were prepared (Sample Nos. 111H-118H). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3H. For these light-receiving members, image exposure was effected by means of the device shown in FIG. 26 with a semiconductor laser with a wavelength of 780 nm at a spot diameter of 80 μm similarly as in Example 59 to obtain the results shown in Table 3H.

EXAMPLE 61

Light-receiving members for electrophotography were formed in the same manner as in the case of Sample No. 1-1H in Example 59 under the conditions as shown in Table 5H.

For these light-receiving members for electrophotography, by means of the same image exposure device as in Example 59, image exposure was effected, followed by development, transfer and fixing to obtain visible images on plain papers.

The images obtained in this case were free from any interference fringe pattern observed, exhibiting practically satisfactory characteristics.

EXAMPLE 62

Light-receiving members for electrophotography were formed in the same manner as in the case of Sample No. 1-1H in Example 59 under the conditions as shown in Table 6H.

For these light-receiving members for electrophotography, by means of the same image exposure device as in Example 59, image exposure was effected, followed by development, transfer and fixing to obtain visible images on plain papers.

The images obtained in this case were free from any interference fringe pattern observed, exhibiting practically satisfactory characteristics.

EXAMPLE 63

Light-receiving members for electrophotography were formed in the same manner as in the case of Sample No. 1-1H in Example 59 under the conditions as shown in Table 7H.

For these light-receiving members for electrophotography, by means of the same image exposure device as in Example 59, image exposure was effected, followed by development, transfer and fixing to obtain visible images on plain papers.

The images obtained in this case were free from any interference fringe pattern observed, exhibiting practically satisfactory characteristics.

EXAMPLE 64

Light-receiving members for electrophotography were formed in the same manner as in the case of Sample No. 1-1H in Example 59 under the conditions as shown in Table 8H.

Figure 60:
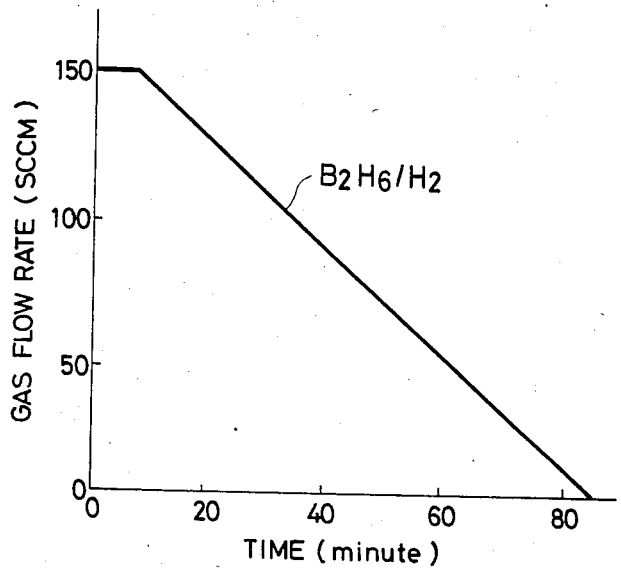

The boron containing layer was formed by controlling the mass flow controller 2010 for $B_2H_6/H_2$ by a computer (HP9845B) so that the flow rate of $B_2H_6/H_2$ may become as shown in FIG. 60.

For these light-receiving members for electrophotography, by means of the same image exposure device as in Example 59, image exposure was effected, followed by development, transfer and fixing to obtain visible images on plain papers.

The images obtained in this case were free from any interference fringe pattern observed, exhibiting practically satisfactory characteristics.

EXAMPLE 65

Light-receiving members for electrophotography were formed in the same manner as in the case of Sample No. 1-1H in Example 59 under the conditions as shown in Table 9H.

Figure 61:
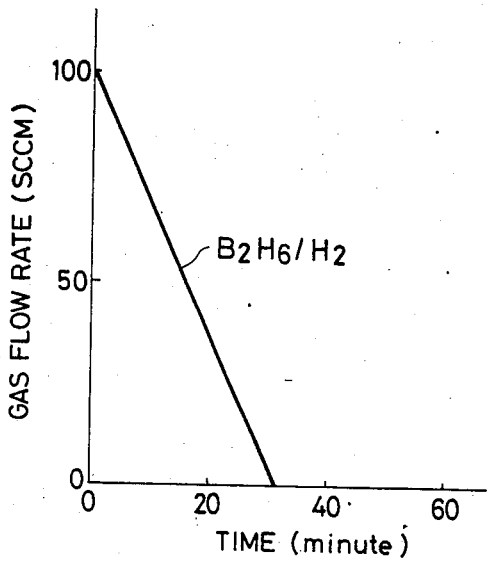

The boron containing layer was formed by controlling the mass flow controller 2010 for $B_2H_6/H_2$ by a computer (HP9845B) so that the flow rate of $B_2H_6/H_2$ may become as shown in FIG. 61.

For these light-receiving members for electrophotography, by means of the same image exposure device as in Example 59, image exposure was effected, followed by development, transfer and fixing to obtain visible images on plain papers.

The images obtained in this case were free from any interference fringe pattern observed, exhibiting practically satisfactory characteristics.

EXAMPLE 66

Light-receiving members for electrophotography were formed in the same manner as in the case of Sample No. 1-1H in Example 59 under the conditions as shown in Table 10H.

Figure 78:
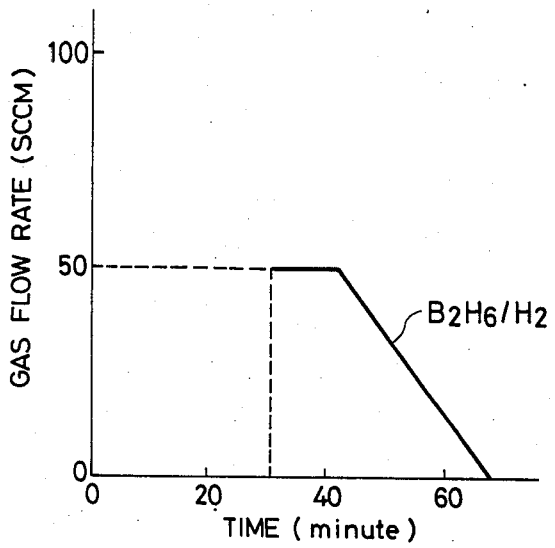

The boron containing layer was formed by controlling the mass flow controller 2010 for $B_2H_6/H_2$ by a computer (HP9845B) so that the flow rate of $B_2H_6/H_2$ may become as shown in FIG. 78.

For these light-receiving members for electrophotography, by means of the same image exposure device as in Example 59, image exposure was effected, followed by development, transfer and fixing to obtain visible images on plain papers.

The images obtained in this case were free from any interference fringe pattern observed, exhibiting practically satisfactory characteristics.

EXAMPLE 67

Light-receiving members for electrophotography were formed in the same manner as in the case of Sample No. 1-1H in Example 59 under the conditions as shown in Table 11H.

Figure 81:
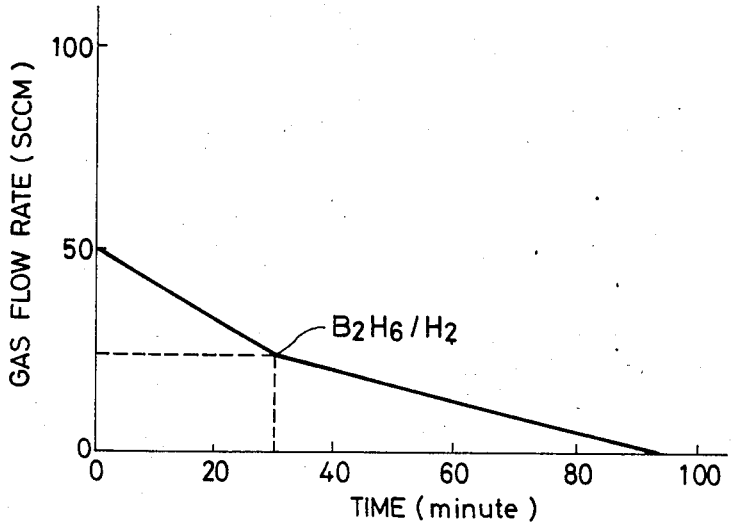

The boron containing layer was formed by controlling the mass flow controller 2010 for $B_2H_6/H_2$ by a computer (HP9845B) so that the flow rate of $B_2H_6/H_2$ may become as shown in FIG. 81.

For these light-receiving members for electrophotography, by means of the same image exposure device as in Example 59, image exposure was effected, followed by development, transfer and fixing to obtain visible images on plain papers.

The images obtained in this case were free from any interference fringe pattern observed, exhibiting practically satisfactory characteristics.

EXAMPLE 68

The case of Sample No. 1-1H in Example 59 and Examples 61 to 67 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as the case of Sample No. 1-1H in Example 59 and in Examples 61 to 67.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 8

As a comparative test, an a-Si light-receiving member for electrophotography was prepared in entirely the same manner as in the case of Sample No. 1-1H in Example 59 as described above except for employing an aluminum substrate roughened on its surface by the sand blasting method in place of the aluminum substrate used in preparation of the light-receiving member for electrography in Example 59. The surface conditions of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 59, clear interference fringe was found to be formed in the black image over all the surface.

EXAMPLE 69

An aluminum substrate having the shape as shown in FIG. 9 (spiral groove surface shape with length (L): 357 mm, outer diameter (r): 80 mm; pitch (P) 25 μm; depth (D) 0.8 μm) was prepared.

Next, a-Si light-receiving layers were deposited on the above aluminum substrate following various procedures under the condition No. 101A in Table 1A and the conditions as shown in Table 4I using the deposition device as shown in FIG. 20 (Sample No. 1-1I).

Figure 36:
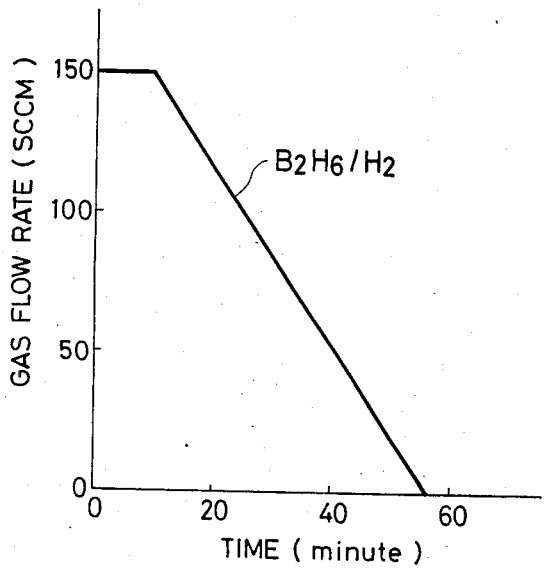

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 22 and FIG. 36.

Formation of the surface layer was carried out as follows. After formation of the second layer, the hydrogen ($H_2$) bomb was replaced with argon (Ar) gas bomb, the deposition device cleaned and the surface layer material as shown in the condition No. 101A in Table 1A was placed on the entire surface of the cathode electrode. The above light-receiving member was set and, the deposition device was brought to reduced pressure sufficiently by means of a diffusion pump. Then, argon gas was introduced to 0.015 Torr and glow discharging excited at a high frequency power of 150 W to sputter the surface layer material, thereby forming the surface layer of the condition No. 101A in Table 1A.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2I).

On the other hand, in the case of the above Sample No. 1-1I, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

Light-receiving members were prepared according to the same method as described above except for forming the surface layer under the conditions Nos. 102A-122A in Table 1A.

The light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 70

By means of a lathe, the surface of a cylindrical aluminum substrate was worked as shown in Table 2I. On these cylindrical aluminum substrates (Cylinder Nos. 101I-108I), under the same condition as in the case of the Sample No. 1-1I in Example 69, light-receiving members for electrophotography were prepared (Sample Nos. 111I-118I). The difference in average layer thickness between the center and the both ends of the aluminum substrate of the light-receiving members for electrophotography was found to be 2.2 μm.

The cross-sections of these light-receiving members for electrophotograhy were observed by electron microscope and the difference within the pitch of the light-receiving layer was measured to give the results as shown in Table 3I. For these light-receiving members, image exposure was effected by means of the device shown in FIG. 26 with a semiconductor laser with a wavelength of 780 nm at a spot diameter of 80 μm similarly as in Example 69 to obtain the results shown in Table 3I.

EXAMPLE 71

Light-receiving members for electrophotography were formed in the same manner as in the case Sample No. 1-1I in Example 69 under the conditions as shown in Table 4I.

Figure 37:
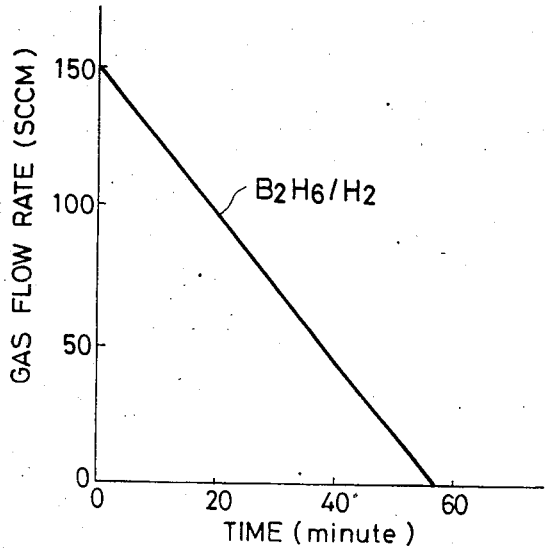

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 23 and FIG. 37.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 72

Light-receiving members for electrophotography were formed in the same manner as in the case of Sample No. 1-1I in Example 69 under the conditions as shown in Table 5I.

Figure 38:
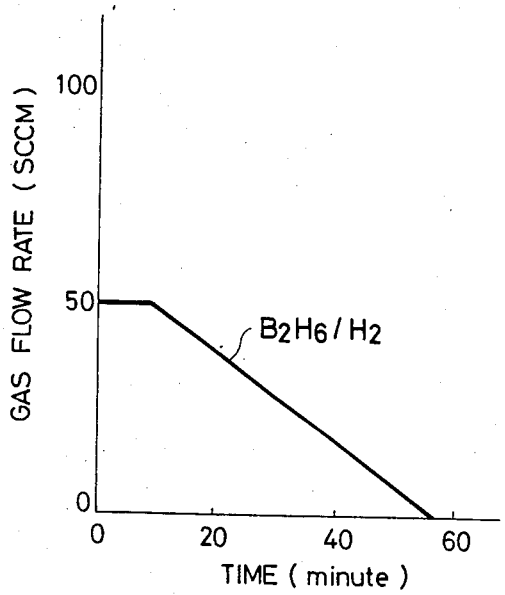

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 24 and FIG. 38.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 73

Light-receiving members for electrophotography were formed in the same manner as in the case of Sample No. 1-1I in Example 69 under the conditions as shown in Table 5I.

Figure 39:
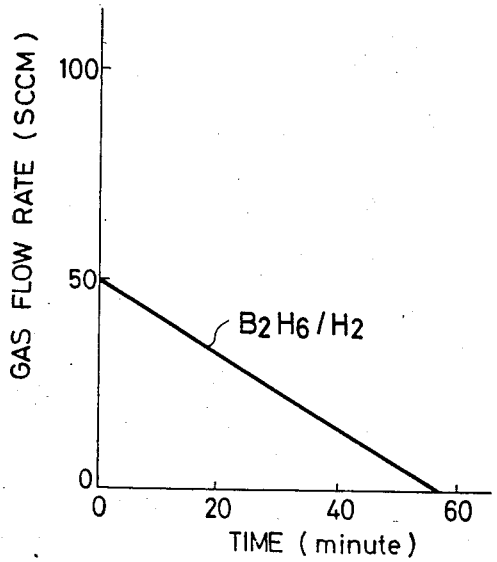

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 25 and 39.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 74

Light-receiving members for electrophotography were formed in the same manner as in the case of Sample No. 1-1I in Example 69 under the conditions as shown in Table 6I.

Figure 40:
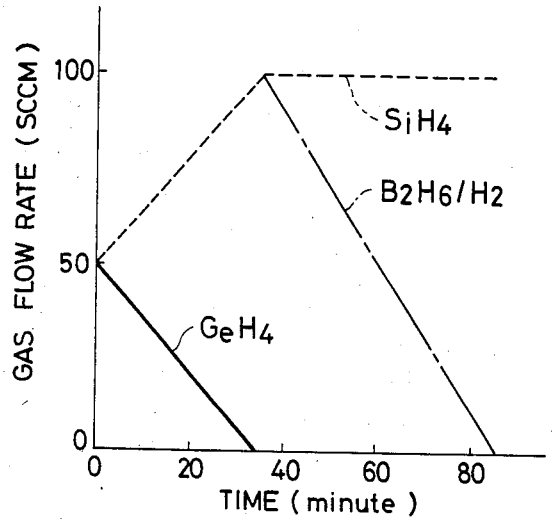

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 40.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 75

Light-receiving members for electrophotography were formed in the same manner as in the case of Sample No. 1-1I in Example 69 under the conditions as shown in Table 7I.

Figure 41:
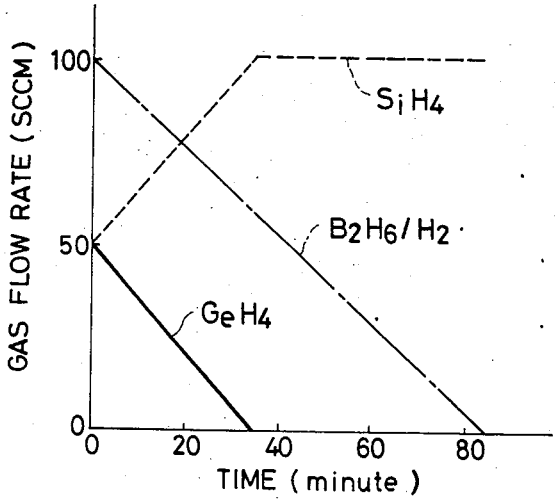

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 41.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 76

Light-receiving members for electrophotography were formed in the same manner as in the case of Sample No. 1-1I in Example 69 under the conditions as shown in Table 8I.

Figure 42:
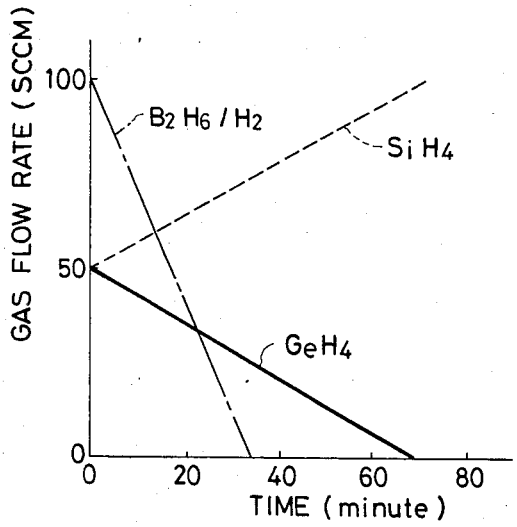

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 42.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

COMPARATIVE EXAMPLE 9

As a comparative test, an a-Si light-receiving member for electrophotography was prepared in entirely the same manner as in the case of Sample No. 1-1I in Example 69 as described above except for employing an aluminum substrate roughened on its surface by the sand blasting method in place of the aluminum substrate used in preparation of the light-receiving member for electrography in Example 69. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 $\mu$m.

When the same measurement was conducted by mounting the light-receiving member for electrophotography for comparative purpose on the device shown in FIG. 26 employed in Example 69, clear interference fringe was found to be formed in the black image over all the surface.

EXAMPLE 77

In this Example, a semiconductor laser (wavelength: 780 nm) with a spot size of 80 $\mu$m was employed. Thus, on a cylindrical aluminum substrate [length (L) 357 mm, outer diameter (r) 80 mm] to which a-Si:H was to be deposited a spiral groove was formed with pitch (P) 25 m and depth (D) 0.8 S was formed. The form of the groove is shown in FIG. 9.

Next, under the conditions as shown in Table 1aJ, by use of the film deposition device as shown in FIG. 20, an a-Si type light-receiving member for electrography having a surface layer laminated thereon was prepared following predetermined operational procedures (Sample No. 1-1J).

NO gas was introduced, while controlling the flow rate by setting the mass flow controller so that its initial value may be 3.4 vol % based on the sum of $SiH_4$ gas flow rate and $GeH_4$ gas flow rate. The surface layer was formed by placing $ZrO_2$ on all over the surface of the cathode electrode in the device of FIG. 20 in this Example, replacing $H_2$ gas employed during formation of the first layer and the second layer with Ar gas, then evacuating internally the device to a vacuum of about $5\times10^{-6}$ Torr, subsequently exciting glow discharge at a high frequency power of 300 W with introduction of Ar gas and sputtering $ZrO_2$ on the cathode electrode. In the Examples shown below, the surface layers were formed in the same manner as in this Example except for changing the surface layer forming materials.

Separately, on the cylindrical aluminum substrate having the same characteristic, a light-receiving layer was formed similarly as in the above case except for changing the discharging power in formation of the first layer, the second layer and the surface layer to 40 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2J).

On the other hand, in the case when the above high frequency power was made 160 W, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82 obtained at a high frequency power of 40 W during layer formation, an interference fringe pattern was observed.

On the other hand, in the light-receiving member having the surface characteristic as shown in FIG. 83, no interference fringe pattern was observed to give practically satisfactory electrophotographic characteristics.

EXAMPLE 78

By means of a lathe, the surface of a cylindrical aluminum substrate was worked as shown in Table 2J. On these cylindrical aluminum substrates (Cylinder Nos. 101J-108J), under the same condition as in the case when NO interference fringe pattern was observed (high frequency power 160 W) in Example 77, light-receiving members for electrophotography were prepared (Sample Nos. 111J-118J). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the second layer was measured to give the results as shown in Table 3J. For these light-receiving members, image exposure was effected by means of the device shown in FIG. 26 with a semiconductor laser with a wavelength of 780 nm at a spot diameter of 80 μm similarly as in Example 77 to obtain the results shown in Table 3J.

EXAMPLE 79

Light-receiving members for electrophotography were formed in the same manner as in the case of Sample No 1-1J in Example 77 under the conditions as shown in Table 4J.

For these light-receiving members for electrophotography, by means of the same image exposure device as in Example 77, image exposure was effected, followed by development and transfer to obtain visible images.

The images obtained in this case were free from any interference fringe pattern observed, exhibiting practically satisfactory electrophotographic characteristics.

EXAMPLE 80

Light-receiving members for electrophotography were formed in the same manner as in the case of Sample No. 1-1J in Example 77 under the conditions as shown in Table 5J.

For these light-receiving members for electrophotography, by means of the same image exposure device as in Example 77, image exposure was effected, followed by development and transfer ot obtain visible images.

The images obtained in this case were free from any interference fringe pattern observed, exhibiting practically satisfactory electrophotographic characteristics.

EXAMPLE 81

Light-receiving members for electrophotography were formed in the same manner as in the case of Sample No. 1-1J in Example 77 under the conditions as shown in Table 6J.

For these light-receiving members for electrophotography, by means of the same image exposure device as in Example 77, image exposure was effected, followed by development and transfer to obtain visible images.

The images obtained in this case were free from any interference fringe pattern observed, exhibiting practically satisfactory electrophotographic characteristics.

EXAMPLE 82

Light-receiving members for electrophotography were formed in the same manner as in the case of Sample No. 1-1J in Example 77 under the conditions as shown in Table 7J.

For these light-receiving members for electrophotography, by means of the same image exposure device as in Example 77, image exposure was effected, followed by development and transfer to obtain visible images.

The images obtained in this case were free from any interference fringe pattern obaseved, exhibiting practically satisfactory electrophotographic characteristics.

EXAMPLE 83

During formation of the first layer, NO gas flow rate was changed relative to the sum of $SiH_4$ gas flow rate and $GeH_4$ gas flow rate as shown in FIG. 49 until the NO gas flow rate became zero on completion of layer formation, following the same conditions as in the case of a high frequency power of 160 W in Example 77, to prepare a light-receiving member for electrophotography. Separately, using the same conditions and preparation means as in the above case except for changing the high frequency power to 40 W, the first layer, the second layer and the surface layer were formed on the substrate. As the result, the surface of the surface layer was found to be in parallel to the surface of the substrate 1301 as shown in FIG. 82. In this case, the difference in the whole layer thickness between the center and the both ends of the aluminum substrate 1303 was found to be 1 μm.

On the other hand, in the case when the above high frequency power was made 160 W, the surface of the light-receiving layer and the surface of the substrate 1301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82 obtained at a high frequency power of 40 W during layer formation, an interference fringe pattern was observed.

On the other hand, in the light-receiving member having the surface characteristic as shown in FIG. 83, no interference fringe pattern was observed to give practically satisfactory electrophotographic characteristics.

EXAMPLE 84

Light-receiving members for electrophotography were formed in the same manner as in the case of Sample No. 1-1J in Example 77 under the conditions as shown in Table 8J.

For these light-receiving members for electrophotography, by means of the same image exposure device as in Example 77, image exposure was effected, followed by development and transfer to obtain visible images.

The images obtained in this case were free from any interference fringe pattern observed, exhibiting practically satisfactory electrophotographic characteristics.

EXAMPLE 85

Light-receiving members for electrophotography were formed in the same manner as in the case of Sample No. 1-1J in Example 77 under the conditions as shown in Table 9J.

For these light-receiving members for electrophotography, by means of the same image exposure device as in Example 77, image exposure was effected, followed by development and transfer to obtain visible images.

The images obtained in this case were free from any interference fringe pattern observed, exhibiting practically satisfactory electrophotographic characteristics.

EXAMPLE 86

Light-receiving members for electrophotography were formed in the same manner as in the case of Sample No. 1-1J in Example 77 under the conditions as shown in Table 10J.

For these light-receiving members for electrophotography, by means of the same image exposure device as in Example 77, image exposure was effected, followed by development and transfer to obtain visible images.

The images obtained in this case were free from any interference fringe pattern observed, exhibiting practically satisfactory electrophotographic characteristics.

EXAMPLE 87

Light-receiving members for electrophotography were formed in the same manner as in the case of Sample No. 1-1J in Example 77 under the conditions as shown in Table 11J.

For these light-receiving members for electrophotography, by means of the same image exposure device as in Example 77, image exposure was effected, followed by development and transfer to obtain visible images.

The images obtained in this case were free from any interference fringe pattern observed, exhibiting practically satisfactory electrophotographic characteristics.

EXAMPLE 88

Light-receiving members for electrophotography were formed in the same manner as in the case of Sample No. 1-1J in Example 77 under the conditions as shown in Table 12J to 15J. During the layer formation, the flow rate ratio of NO gas flow rate to the sum of $SiH_4$ gas flow rate and $GeH_4$ gas flow rate was changed according to the change rate curves as shown in FIGS. 66 through 69. The surface layer was formed by use of $ZrO_2$ as its material similarly as in Example 77.

For these light-receiving members for electrophotography, by means of the same image exposure device as in Example 77, image exposure was effected, followed by development and transfer to obtain visible images.

The images obtained in this case were free from any interference fringe pattern observed, exhibiting practically satisfactory electrophotographic characteristics.

EXAMPLE 89

Light-receiving members for electrophotography were formed in the same manner as in the case of Sample No. 1-1J in Example 77 under the conditions as shown in Table 16J. During the layer formation, the flow rate ratio of NO gas flow rate to the sum of $SiH_4$ gas flow rate and $GeH_4$ gas flow rate was changed according to the change rate curves as shown in FIG. 66. The surface layer was formed by use of $ZrO_2$ as its material similarly as in Example 77.

For these light-receiving members for electrophotography, by means of the same image exposure device as in Example 77, image exposure was effected, followed by development and transfer to obtain visible images.

The images obtained in this case were free from any interference fringe pattern observed, exhibiting practically satisfactory electrophotographic characteristics

EXAMPLE 90

Figure 68:
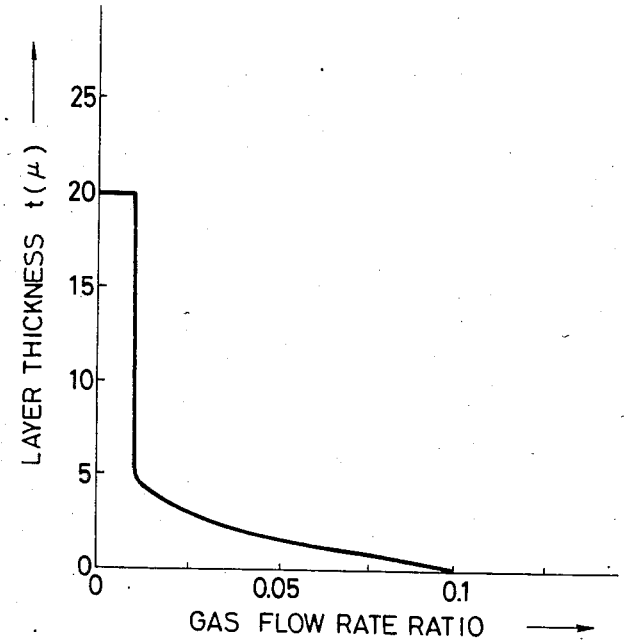
Figure 69:
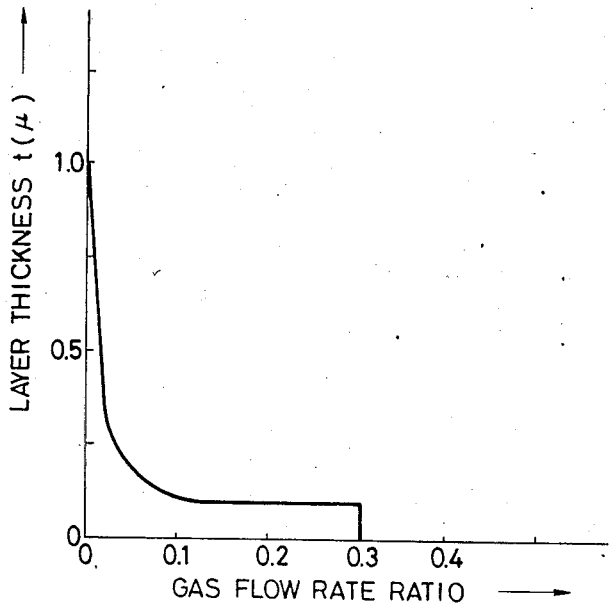

Light-receiving members for electrophotography were formed in the same manner as in the case of Sample No. 1-1J in Example 77 under the conditions as shown in Tables 17J and 18J. During the layer formation, the flow rate ratio of $NH_3$ gas or $SiH_4$ gas flow rate to $CH_4$ gas and $SiH_4$ gas flow rate was changed according to the change rate curves as shown in FIG. 68. The surface layer was formed by use of $ZrO_2$ as its material similarly as in Example 77.

For these light-receiving members for electrophotography, by means of the same image exposure device as in Example 77, image exposure was effected, followed by development and transfer to obtain visible images.

The images obtained in this case were free from any interference fringe pattern observed, exhibiting practically satisfactory electrophotographic characteristics.

EXAMPLE 91

Except for using the same substrate as used in Example 77, changing the surface layer material to various materials shown in Table 1A and employing two kinds of surface layer forming time (one is the same as in Example 77, the other is above twice as long as that in Example 77), the same conditions and procedures as in Example 77 were followed to prepare a-Si type light-receiving members for electrophotography (Sample Nos. 101J–122J).

These light-receiving members for electrophotography as prepared above were subjected to image exposure by means of a device as shown in FIG. 26 (wavelength of laser beam: 780 nm, spot diameter 80 μm), followed by development and transfer to obtain imaqes. In any of the images of Sample Nos. 101J–122J, no interference fringe pattern was observed to give practically satisfactory electrophotographic characteristics.

COMPARATIVE EXAMPLE 10

As a comparative test, an a-Si light-receiving member for electrophotography was prepared in entirely the same manner as in the case of Sample No. 1–1J in Example 77 as described above except for employing an aluminum substrate roughened on its surface by the sand blasting method in place of the aluminum substrate used in preparation of the light-receiving member for electrography in Example 77. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 77, clear interference fringe was found to be formed in the black image over all the surface.

EXAMPLE 92

An alminum substrate haveing the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving layers were deposited on the above aluminum substrate following various procedures under the conditions as shown in Table 1K using the film deposition device as shown in FIG. 20 (Sample No. 1–1K).

In preparation of the first layer, the mass flow controllers 2007 and 2008 for $GeH_4$ and $SiH_4$ were controlled by a computer (HP9854B) so that the flow rates of $GeH_4$ and $SiH_4$ might be as shown in FIG. 22.

Also, the surface layer was formed by placing $ZrO_2$ selected from the plates (thickness 3 mm) of various materials as shown in Table 1A all of various materials over the surface of the cathode electrode in the device of FIG. 20 in this Example, replacing $H_2$ gas employed during formation of the first layer and the second layer with Ar gas, then evacuating internally the device to a vaccum of about $5\times10^{-6}$ Torr, subsequently exciting glow discharge at a high frequency power of 300 W with introduction of Ar gas and sputtering $ZrO_2$ on the cathode electrode. In the Examples shown below, the surface layers were formed in the same manner as in this Example except for changing the surface layer forming materials.

Separately, on the cylindrical aluminum substrate having the same characteristic, a light-receiving layer was formed similarly as in the above case except changing the discharging power in formation of both the first layer and the second layer to 50 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1–2K).

Also in the case of Sample No. 1–1K, the surface of the surface of layer 1305 and the surface of the substrate 1301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 with a semiconductor laser (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 93

By means of a lathe, the surface of a cylindrical aluminum substrate was worked as shown in Table 2K. On these cylindrical aluminum substrates (Cylinder Nos. 101K–108K), under the same condition as in the case of the Sample No. 1–1K in Example 92, light-receiving members for electrophotography were prepared Sample Nos. 111K–118K). The difference in average layer thickness between the center and the both ends of the aluminum substrate of the light-receiving members for electrophotography was found to be 2.2 μm.

The cross-sections of these light-receiving member for electrophotography were observed by electron microscope and the difference within the pitch of the light-receiving layer was measured to give the results as shown in Table 3K. For these light-receiving members, image exposure was effected by means of the device shown in FIG. 26 with a semiconductor laser with a wavelength of 780 nm at a spot diameter of 80 μm similarly as in Example 92 to obtain the results shown in Table 3K.

EXAMPLE 94

Light-receiving member for electrophotography were formed in the same manner as in the case of Sample No. 1–1K in Example 92 under the conditions as shown in Table 4K.

In preparation of the first layer, the mass flow controllers 2007 and 2008 were controlled by a computer (HP9845B) so that the flow rates of $GeH_4$ and $SiH_4$ might be as shown in FIG. 23.

For these light-receiving members for electrophotography, by means of the same image exposure device as in Example 92, image exposure was effected followed by development, transfer and fixing to obtain visible images on plain papers.

The images obtained in this case were free from any interference fringe pattern observed, exhibiting practically satisfactory characteristics.

EXAMPLE 95

Light-receiving members for electrophtography were formed in the same manner as in the case of Sample No. 1-1K in Example 92 under the conditions as shown in Table 5K.

In preparation of the first layer, the mass flow controllers 2007 and 2008 were controlled by a computer (HP9845B) so that the flow rates of $GeH_4$ and $SiH_4$ might be as shown in FIG. 24.

For these light-receiving members for electrophotography, by means of the same image exposure device as in Example 92, image exposure was effected, followed by development, transfer and fixing to obtain visible images on plain papers.

The images obtained in this case were free from any interference fringe pattern observed, exhibiting practically satisfactory characteristics.

EXAMPLE 96

Light-receiving members for electrophotography were formed in the same manner as in the case of Sample No 1-1K in Example 92 under the conditions as shown in Table 6K.

In preparation of the first layer, the mass flow controllers 2007 and 2008 were controlled by a computer (HP9854B) so that the flow rates of $GeH_4$ and $SiH_4$ might be as shown in FIG. 25.

For these light-receiving members for electrophotography, by means of the same image exposure device as in Example 92, image exposure was effected, followed by development, transfer and fixing to obtain visible images on plain papers.

The images obtained in this case were free from any interference fringe pattern observed, exhibiting practically satisfactory characteristics.

EXAMPLE 97

A light-receiving member for electrophotography was prepared following the same condition and the procedure as described in Example 96 except for changing $NH_3$ gas employed in Example 96 to NO gas.

For these light-receiving members for electrophography, by means of the same image exposure device as in Example 92, image exposure was effected, followed by development, transfer and fixing to obtain visible images on plain papers.

The images obtained in this case were free from any interference fringe pattern observed, exhibiting practically satisfactory characteristics.

EXAMPLE 98

A light- receiving member for electrophotography was prepared following the same condition and the procedure as described in Example 96 except for changing $NH_3$ gas employed in Example 96 to $CH_4$ gas.

For these light-receiving members for electrophotography, by means of the same image exposure device as in Example 92, image exposure was effected, followed by development, transfer and fixing to obtain visible images on plain papers.

The images obtained in this case were free from any interference fringe pattern observed, exhibiting practically satisfactory characteristics.

EXAMPLE 99

Figure 70:
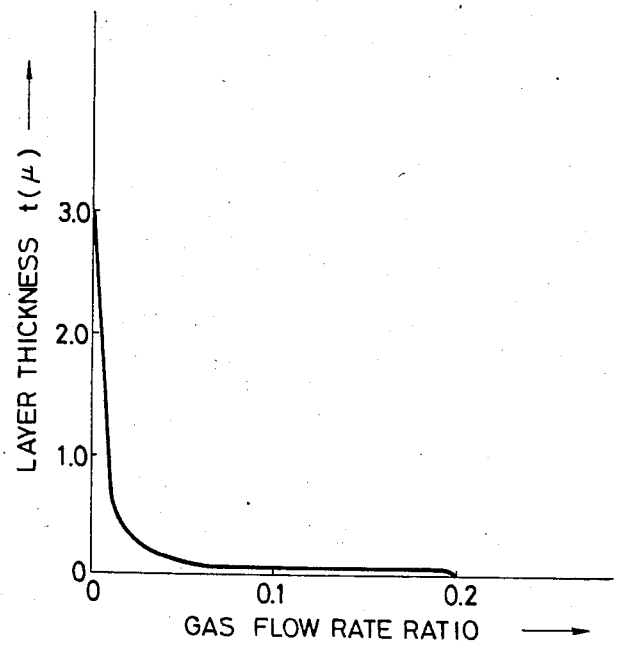

A light-receiving member for electrophotography was prepared following the same procedure as in the case of Sample No. 1-1K in Example 92 except for changing the flow rate ratio of NO gas according to the change rate curve of gas flow rate ratio shown in FIG. 70 under the conditions as shown in Table 7K with lapse of layer formation time.

For these light-receiving members for electrophotography, by means jof the same image exposure device as in Example 92, image exposure was effected, followed by development, transfer and fixing to obtain visible images on plain papers.

The images obtained in this case were free from any interference fringe pattern observed, exhibiting practically satisfactory characteristics.

EXAMPLE 100

Figure 71:
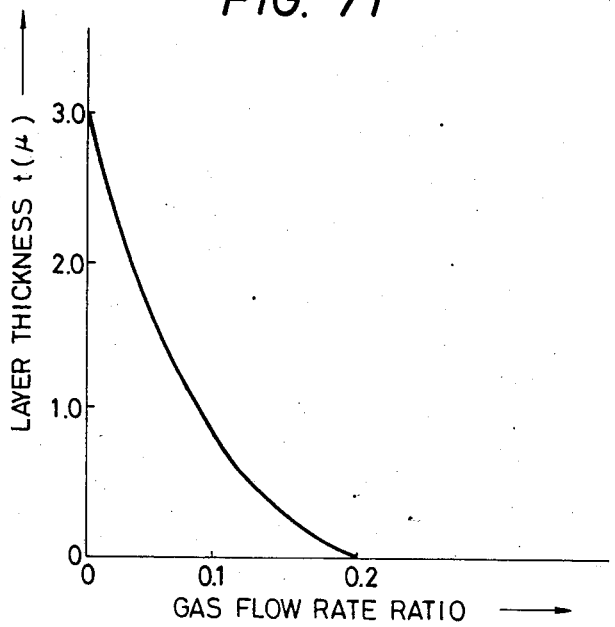

A light-receiving member for electrophotography was prepared following the same procedure as in the case of Sample No. 1-1K in Example 92 except for changing the flow rate ratio of $NH_3$ gas according to the change rate curve of gas flow rate ratio shown in FIG. 71 under the conditions as shown in Table 8K with lapse of layer formation time.

For these light-receiving members for electrophotography, by means of the same image exposure device as in Example 92, image exposure was effected followed by development transfer and fixing to obtain visible images on plain papers.

The images obtained in this case were free from any interference fringe pattern observed, exhibiting practically satisfactory characteristics.

EXAMPLE 101

Figure 58:
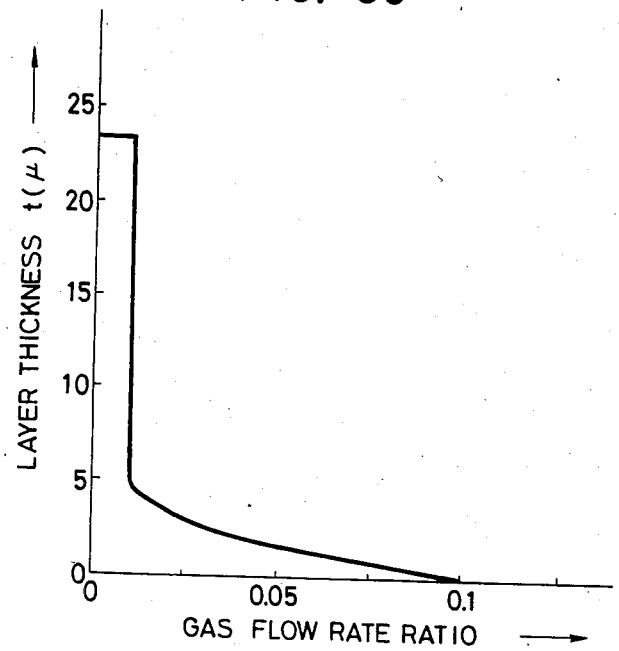

A light-receiving member for electrophotography was prepared following the same procedure as in the case of Sample No. 1-1K in Example 92 except for changing the flow rate ratio of NO gas according to the change rate curve of gas flow rate ratio shown in FIG. 58 under the conditions as shown in Table 9K with lapse of layer formation time.

For these light-receiving members for electrophotography, by means of the same image exposure device as in Example 92, image exposure was effect followed by development, transfer and fixing to obtain visible images on plain papers.

The images obtained in this case were free from any interference fringe pattern observed, exhibiting practically satisfactory characteristics.

EXAMPLE 102

A light-receiving member for electrophotography was prepared following the same condition and the procedure as described in Example 101 except for changing NO gas employed in Example 101 to $NH_3$ gas.

For these light-receiving members for electrophotography, by means of the same image exposure device as in Example 92, image exposure was effected, followed by development, transfer and fixing to obtain visible images on plain papers.

The images obtained in this case were free from any interference fringe pattern observed, exhibiting practically satisfactory characteristics.

EXAMPLE 103

A light-receiving member for electrophotography was prepared following the same condition and the procedure as described in Example 101 except for changing NO gas employed in Example 101 to $CH_4$ gas.

For these light-receiving members for electrophotography, by means of the same image exposure device as in Example 92, image exposure was effected, followed by development, transfer and fixing to obtain visible images on plain papers.

The images obtained in this case were free from any interference fringe pattern observed, exhibiting practically satisfactory characteristics.

EXAMPLE 104

Figure 72:
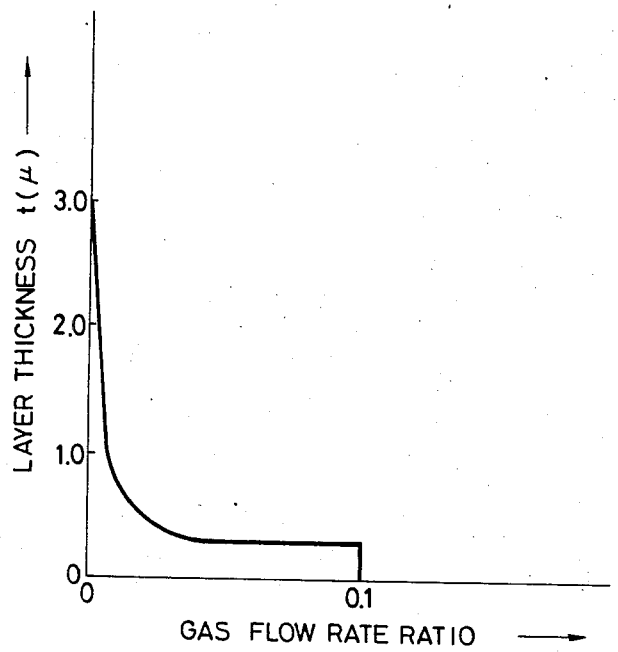

A light-receiving member for electrophotography was prepared following the same procedure as in the case of Sample No. 1-1K in Example 92 except for changing the flow rate ratio of $CH_4$ gas according to the change rate curve of gas flow rate ratio shown in FIG. 72 under the condictions as shown in Table 10K with lapse of layer formation time.

For these light-receiving members for electrophotography, by means of the same image exposure device as in Example 92, image exposure was effected, followed by development, transfer and fixing to obtain visible images on plain papers.

The images obtained in this case were free from any interference fringe pattern observed, exhibiting practically satisfactory characteristics.

EXAMPLE 105

Under the same conditions as in Sample No. 1-1K Example 92 except for changing the material and the layer thickness for the surface layer as shown in Table 1A, light-receiving members for electrophotography were prepared following various operational procedures by means of the device shown in FIG. 20 (Sample Nos. 101K-122K)

The respective light-receiving member for electrophotographt as prepared above were subjected to image exposure by means of a device as shown in FIG. 26 (wavelength of laser beam: 780 nm, spot diameter 80 μm), followed by development and transfer to obtain images. Any of the images of Samples Nos. 101J-122J) was found to be free from any interference fringe pattern observed, thus being practically satisfactory.

COMPARATIVE EXAMPLE 11

As a comparative test, an a-Si light-receiving member for electrophotography was prepared in entirely the same manner as in the case of Sample No. 1-1K in Example 92 as described above except for employing an aluminum substrate roughened on its surface by the sand blasting method in place of the alminum substrate used in preparation of the light-receiving member for electrography in Example 92. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 92, clear interference fringe was found to be formed in the black image over all the surface.

EXAMPLE 106

An aluminum substrate having the shape as shown in FIG. 9 (spiral groove shape with length (L): 357 mm, outerdiameter (r): 80 mm; pitch (P) 25 μm; depth (D) 0.8 μm) was prepared.

Next, a-Si light-receiving layers were deposited on the above aluminum substrate following various procedures under the conditions as shown in Table 1L using the deposition device as shown in FIG. 20 (Sample No. 1-1L).

The surface layer was formed by placing $ZrO_2$ selected from the plates (thickness 3 mm) of various materials as shown in Table 17L all over the surface of the cathode electrode in the device of FIG. 10 in this Example, replacing $H_2$ gas employed during formation of the first layer and the second layer with Ar gas, then evacuating internally the device to a vacuum of about $5\times10^{-6}$ Torr, subsequently exciting glow discharge at a high frequency power of 300 W with introduction of Ar gas and sputtering $ZrO_2$ on the cathode electrode. In the Examples shown below, the surface layers were formed in the same manner as in this Example except for changing the surface layer forming materials.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 1205 was found to be inparallel to the surface of the substrate 1201 as shown in FIG. 82. In this case, the difference in the whole layer between the center and the both ends of the aluminum substrate was found to be 1 μm (Sample No. 1-2L).

On the other hand, in the case of Sample No. 1-1L, the surface of the surface layer 1305 and the surface of the substrate 1301 were found to be nonparallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 21 with semiconductor laser (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 107

By means of a lathe, the surface of a cylindrical aluminum substrate was worked as shown in Table 2L. On these cylindrical aluminum substrates (Cylindrical Nos. 101L-108L), under the same condition as in the case of the Sample No. 1-1L in Example 106, light-receiving members for electrophotography were prepared (Sample Nos. 111L-118L). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3L. For these light-receiving members, image exposure was effected by means of the device shown in FIG. 26 with a semiconductor laser with a wavelength of 780 nm at spot diameter of 80 μm similarly as in Example 106 to obtain the results shown in Table 3L.

EXAMPLE 108

Light-receiving members for electrophotography were formed in the same manner as in the case of Sample No. 1-1L in Example 106 under the conditions as shown in Table 4L.

For these light-receiving members for electrophotography, by means of the same image exposure device as in Example 106, image exposure was effected, followed by development, transfer and fixing to obtain visible images on plain papers.

The images obtained in this case were free from any interference fringe pattern observed, exihibiting practically satisfactory characteristics.

EXAMPLE 109

Light-receiving members for electrophotography were formed in the same manner as in the case of Sample No. 1-1L in Example 106 under the conditions as shown in Table 5L.

For these light-receiving members for electrophotography, by means of the same image exposure device as in Example 106, iamge exposure was effected, followed by development, transfer and fixing to obtain visible images on plain papers.

The images obtained in this case were free from any interference firnge pattern observed, exhibiting practically satisfactory characteristics.

EXAMPLE 110

Light-receiving members for electrophotography were formed in the same manner as in the case of Sample No. 1-1L in Example 106 under the conditions as shown in Table 6L.

For these light-receiving members for electrophotography, by means of the same image exposure device as in Example 106, image exposure was effected, followed by development, transfer and fixing to obtain visible images on plain papers.

The images obtained inthis case were free from any interference fringe pattern observed, exhibiting practically satisfactory characteristics.

EXAMPLE 111

Light-receiving members for electrophotography were formed in the same manner as in the case of Sample No. 1-1L in Example 106 under the conditions as shown in Table 7L.

For these light-receiving members for electrophotography, by means of the same image exposure device as in Example 106, image exposure was effected, followed by development, transfer and fixing to obtain visible images on plain papers.

The image obtained in this case were free from any interference fringe pattern observed, exhibiting practically satisfactory characteristics.

EXAMPLE 112

Light-receiving members for electrophotography were formed in the same manner as in the case of Sample No. 1-1L in Example 106 under the conditions as shown in Table 8L.

For these light-receiving members for electrophotography, by means of the same image exposure device as in Example 106, image exposure was effected, followed by development, transfer and fixing to obtain visible images on plain papers.

The images obtained in this case were free from any interference fringe pattern observed, exhibiting practically satisfactory characteristics.

EXAMPLE 113

Figure 74:
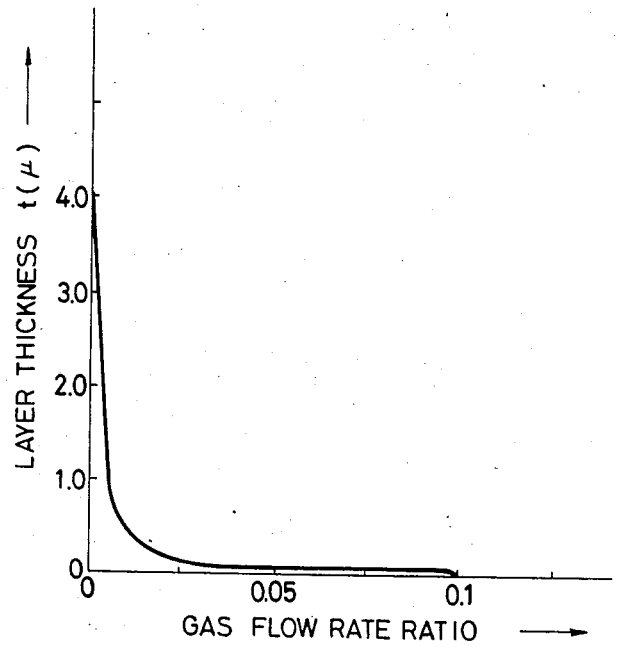

Light-receiving members for electrophotography were formed in the same manner as in the case of Sample No. 1-1L in Example 106 under the conditions as shown in Table 9L. During the layer formation, the flow rate ratio of NO gas flow rate of the sum of $GeH_4$ gas flow rate and $SiH_4$ gas flow rate was changed according to the change rate curves as shown in FIG. 74.

For these light-receiving members for electrophotography, by means of the same image exposure device as in Example 106, image exposure was effected, followed by development, transfer and fixing to obtain visible images on plain papers.

The images obtained in this case were free from any interference fringe pattern observed, exhibiting practically satisfactory characteristics.

EXAMPLE 114

Figure 75:
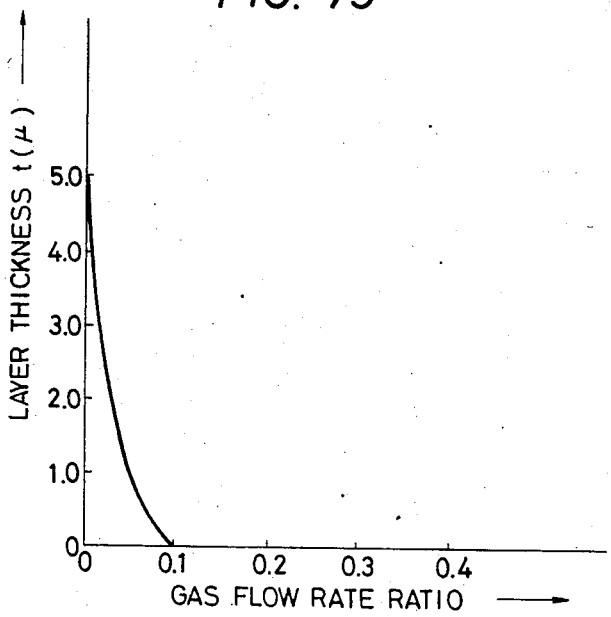

Light-receiving members for electrophotography were formed in the same manner as in the case of Sample No. 1-1L in Example 106 under the conditions as shown in Table 10L. During the layer formation, the flow rate ratio of $NH_3$ gas flow rate relative to the sum of $GeH_4$ gas flow rate and $SiH_4$ gas flow rate was changed according to the change rate curves as shown in FIG. 75.

For these light-receiving members for electrophotography, by means of the same image exposure device as in Example 106, image exposure was effected, followed by development, transfer and fixing to obtain visible images on plain papers.

The images obtained in this case were free from any interference fringe pattern observed, exhibiting practically satisfactory characteristics.

EXAMPLE 115

Figure 57:
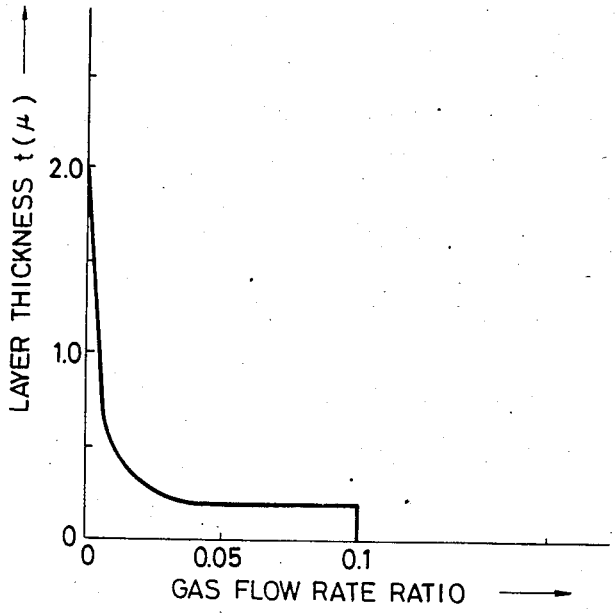

Light-receiving members for electrophotography were formed in the same manner as in the case of Sample No. 1-1L in Example 106 under the conditions as shown in Table 11L. During the layer formation, the flow rate ratio of $CH_4$ gas flow rate to the sum of $GeH_4$ gas flow rate and $SiH_4$ gas flow rate was changed according to the change rate curves as shown in FIG. 57.

For these light-receiving members for electrophotography, by means of the same image exposure device as in Example 106, image exposure was effected, followed by development, transfer and fixing to obtain visible images on plain papers.

The images obtained in this case were free from any interference fringe pattern observed, exhibiting practically satisfactory characteristics.

EXAMPLE 116

Figure 76:
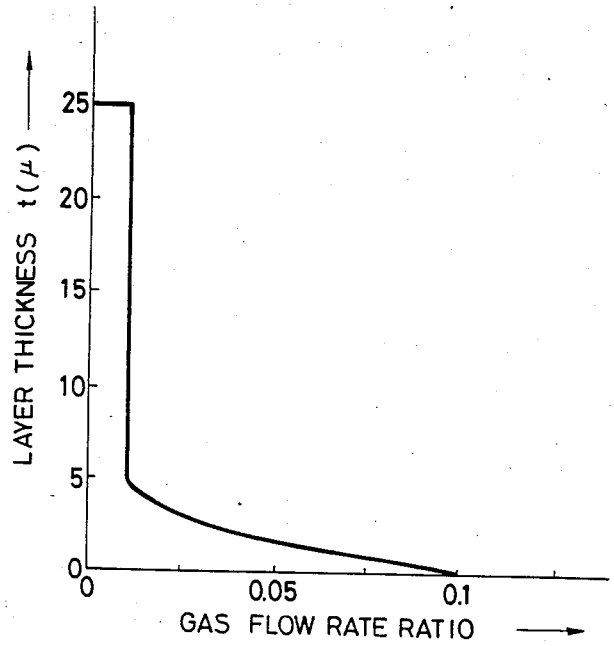

Light-receiving members for electrophotography were fromed in the same manner as in the case of Sample No. 1-1L in Example 106 under the conditions as shown in Table 12L. During the layer formation, the flow rate ratio of NO gas flow rate relative to the sum of $GeH_4$ gas flow rate and $SiH_4$ gas flow rate was changed according to the change rate curves as shown in FIG. 76.

For these light-receiving members for electrophotography, by means of the same image exposure device as in Example 106, image exposure was effected, followed by development, transfer and fixing to obtain visible images on plain papers.

The images obtained in this case were free from any interference fringe pattern observed, exhibiting practically satisfactory characteristics.

EXAMPLE 117

Figure 77:
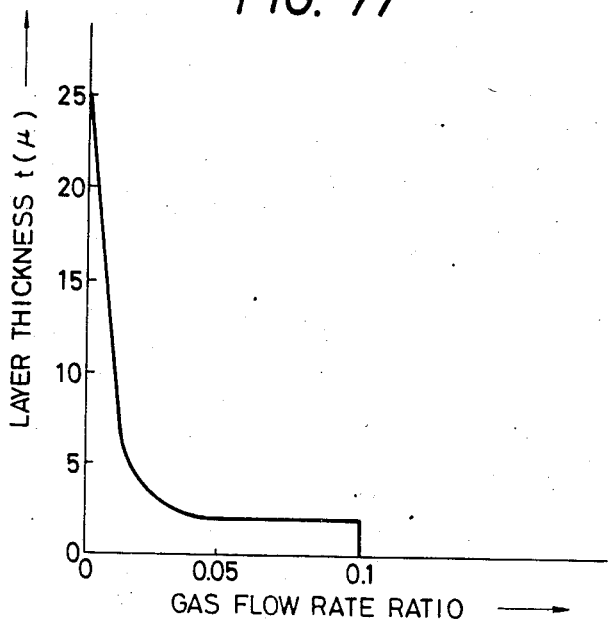

Light-receiving members for electrophotography were formed in the same manner as in the case of Sample No. 1-1L in Example 106 under the conditions as shown in Table 13L. During the layer formation, the flow rate ratio of $NH_3$ gas flow rate relative to the sum of $GeH_4$ gas flow rate and $SiH_4$ gas flow rate was changed according to the change rate curves as shown in FIG. 77.

For these light-receiving members for electrophotography, by means of the same image exposure device as in Example 106, image exposure was effected, followed by development, transfer and fixing to obtain visible images on plain papers.

The images obtained in this case where free from any interference fringe pattern observed, exhibiting practically satisfactory characteristics.

EXAMPLE 118

Figure 73:
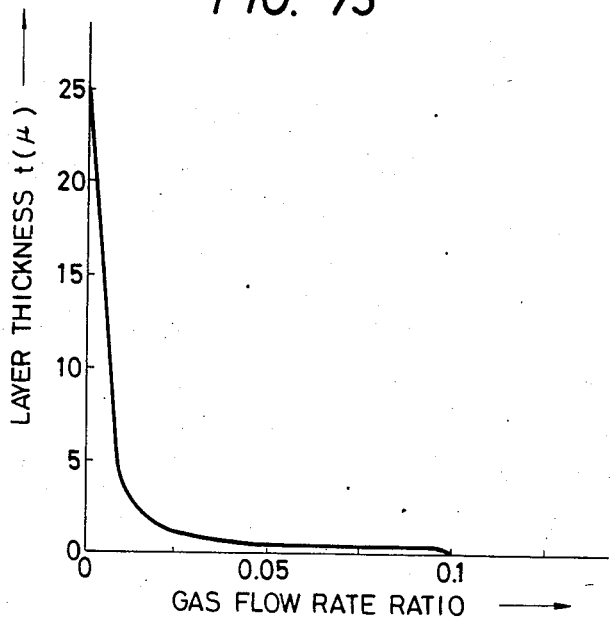

Light-receiving members for electrophotography were formed in the same manner as in the case of Sample No. 1-1L in Example 106 under the conditions as shown in Table 14L. During the layer formation, the flow rate ratio of $CH_4$ gas flow rate relative to the sum of $GeH_4$ gas flow rate and $SiH_4$ gas flow rate was changed according to the change rate curves as shown in FIG. 73.

For these light-receiving members for electrophotography, by means of the same image exposure device as in Example 106, image exposure was effected, followed by development, transfer and fixing to obtain visible images on plain papers.

The images obtained in this case were free from any interference fringe pattern observed, exhibiting practically satisfactory characteristics.

EXAMPLE 119

Light-receiving members for electrophotography were formed in the same manner as in the case of Sample No. 1-1L in Example 106 under the conditions as shown in Table 15L.

For these light-receiving members for electrophotography, by means of the same image exposure device as in Example 106, image exposure was effected, followed by development, transfer and fixing to obtain visible images on plain papers.

The images obtained in this case were free from any interference fringe pattern observed, exhibiting practically satisfactory characteristics.

EXAMPLE 120

Light-receiving members for electrophotography were formed in the same manner as in the case of Sample No. 1-1L in Example 106 under the conditions as shown in Table 16L.

For these light-receiving members for electrophotography, by means of the same image exposure device as in Example 106, image exposure was effected, followed by development, transfer and fixing to obtain visible images on plain papers.

The images obtained in this case were free from any interference fringe pattern observed, exhibiting practically satisfactory characteristics.

EXAMPLE 121

The case of Sample No. 1-1L in Example 106 and Examples 108 to 120 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as the case of Sample No. 1-1L in Example 106 and in Examples 108 to 120.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

EXAMPLE 122

Under the same conditions as in Sample No. 1-1L in Example 106 except for changing the material and the layer thickness for the surface layer as shown in Table 1A, light-receiving members for electrophotography were prepared following various operational procedures by means of the device shown in FIG. 20 (Sample Nos. 101L-122L).

The respective light-receiving members for electrophotography as prepared above were subjected to image exposure by means of a device as shown in FIG. 26 (wavelength of laser beam: 780 nm, spot diameter 80 μm), followed by development and transfer to obtain images. Any of the resulting images was found to be free from any interference fringe pattern observed, thus being practically satisfactory.

COMPARATIVE EXAMPLE 12

As a comparative test, an a-Si light-receiving member for electrophotography was prepared in entirely the same manner as in the case of Sample No. 1-1L in Example 106 as described above except for employing an aluminum substrate roughened on its surface by the sand blasting method in place of the aluminum substrate used in preparation of the light-receiving member for electrophotography in Example 106. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 106, clear interference fringe was found to be formed in the black image over all the surface.

EXAMPLE 123

On a cylindrical aluminum substrate (length (L) 357 mm, outer diameter (r) 80 mm) a spiral groove was formed with pitch (P) 25 μm and depth (D) 0.8 S was formed. The form of the groove is shown in FIG. 9.

Next, under the conditions as shown in Table 3M, by use of the film deposition device as shown in FIG. 20, an a-Si type light-receiving member for electrophotography was prepared following predetermined operational procedures Sample No. 1-1M.

In preparation of the first layer of a-Si Ge:H:B:O layer, the mass flow controllers 2007, 2008 and 2010 were controlled by a computer (HP9845B) so that the flow rates of $GeH_4$ and $SiH_4$ might be as shown in FIG. 22.

The surface layer was formed by placing $ZrO_2$ all over the surface of the cathode electrode in the device of FIG. 20 in this Example, replacing $H_2$ gas employed during formation of the first layer and the second layer with Ar gas, then evacuating internally the device to a vacuum of about $5\times10^{-6}$ Torr, subsequently exciting glow discharge at a high frequency power of 300 W with introduction of Ar gas and sputtering $ZrO_2$ on the cathode electrode.

Separately, on the cylindrical aluminum substrate having the same characteristic, a light-receiving layer was formed similarly as in the above case except for changing the discharging power in formation of the first layer, the second layer and the surface layer to 40 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2M).

On the other hand, in the case when the above high frequency power was made 160 W, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82 obtained at a high frequency power of 40 W during layer formation, an interference fringe pattern was observed.

On the other hand, in the light-receiving member having the surface characteristic as shown in FIG. 83, no interference fringe pattern was observed to give practically satisfactory electrophotographic characteristics.

EXAMPLE 124

By means of a lathe, the surface of a cylindrical aluminum substrate was worked as shown in Table 1M. On these cylindrical aluminum substrates (Cylinder Nos. 101M-108M), under the same condition as in the case when no interference fringe pattern was observed (high frequency power 160 W) in Example 123, light-receiving members for electrophotography were prepared (Sample Nos. 111M-118M). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the second layer was measured to give the results as shown in Table 2M. For these light-receiving members, image exposure was effected by means of the device shown in FIG. 26 with a semiconductor laser with a wavelength of 780 nm at a spot diameter of 80 μm similarly as in Example 123 to obtain the results shown in Table 2M.

EXAMPLE 125.

In formation of the first layer of a-SiGe:H:B:O layer under the conditions shown in Table 3M, except 2007 or controlling the mass flow controllers 2008 and 2007 for $GeH_4$ and $SiH_4$ so that the flow rates of $GeH_4$ and $SiH_4$ may be as shown in FIG. 23, the same procedure in the case of the sample No. 1-1M in Example 123 was followed to prepare a light-receiving layer for electrophotography.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 126

A light-receiving member for electrophotography was prepared following the same condition and the procedure as described in Example 125 except for changing NO gas employed in Example 125 to $NH_3$ gas.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 127

A light-receiving member for electrophotography was prepared following the same condition and the procedure as described in Example 125 except for changing NO gas employed in Example 125 to $CH_4$ gas.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 128

Light-receiving members for electrophotography were formed in the same manner as in the case of Sample No. 1-1M in Example 123 under the conditions as shown in Table 4M.

In preparation of the first layer of a-Si Ge:H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 24.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 129

Light-receiving members for electrophotography were formed in the same manner as in the case of Sample No. 1-1M in Example 123 under the conditions as shown in Table 4M.

In preparation of the first layer of a-Si Ge:H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 25.

For these light-receiving members for electrophotography, by means of the same image exposure device as in Example 123, image exposure was effected, followed by development, transfer and fixing to obtain visible images on plain papers.

The images obtained in this case were free from any interference fringe pattern observed, exhibiting practically satisfactory electrophotographic characteristics.

EXAMPLE 130

A light-receiving member for electrophotography was prepared following the same condition and the procedure as described in Example 128 except for changing $NH_3$ gas employed in Example 128 to NO gas.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 131

A light-receiving member for electrophotography was prepared following the same condition and the procedure as described in Example 128 except for changing $NH_3$ gas employed in Example 128 to $CH_4$ gas.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 132

Light-receiving members for electrophotography were formed in the same manner as in the case of Sample No. 1-1M in Example 123 under the conditions as shown in Table 5M. In preparation of the first layer of a-SiGe:H:B:C layer, the mass flow controllers 2008 and 2007 for $GeH_4$ and $SiH_4$ were controlled by a computer (HP9845B) so that the flow rates of $GeH_4$ and $SiH_4$ might be as shown in FIG. 22.

During the layer formation, the flow rate ratio of $CH_4$ gas relative to the sum of $GeH_4$ gas and $SiH_4$ gas was changed according to the change rate curve shown in FIG. 72.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 133

A light-receiving member for electrophotography was prepared following the same condition and the procedure as described in Example 132 except for changing $CH_4$ gas employed in Example 132 to NO gas.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 134

A light-receiving member for electrophotography was prepared following the same condition and the procedure as described in Example 132 except for changing $CH_4$ gas employed in Example 132 to $NH_3$ gas.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 135

Light-receiving members for electrophotography were formed in the same manner as in the case of Sample No. 1-1M in Example 123 under the conditions as shown in Table 6M. In preparation of the first layer of a-SiGe:H:B:O layer, the mass flow controllers 2008 and 2007 for $GeH_4$ and $SiH_4$ were controlled by a computer (HP9845B) so that the flow rates of $GeH_4$ and $SiH_4$ might be as shown in FIG. 24.

During the layer formation, the flow rate ratio of NO gas relative to the sum of $GeH_4$ gas and $SiH_4$ gas was changed according to the change rate curve shown in FIG. 58.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 136

Light-receiving members for electrophotography were formed in the same manner as in the case of Sample No. 1-1M in Example 123 under the conditions as shown in Table 7M. In preparation of the first layer of a-SiGe:H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 25.

Figure 79:
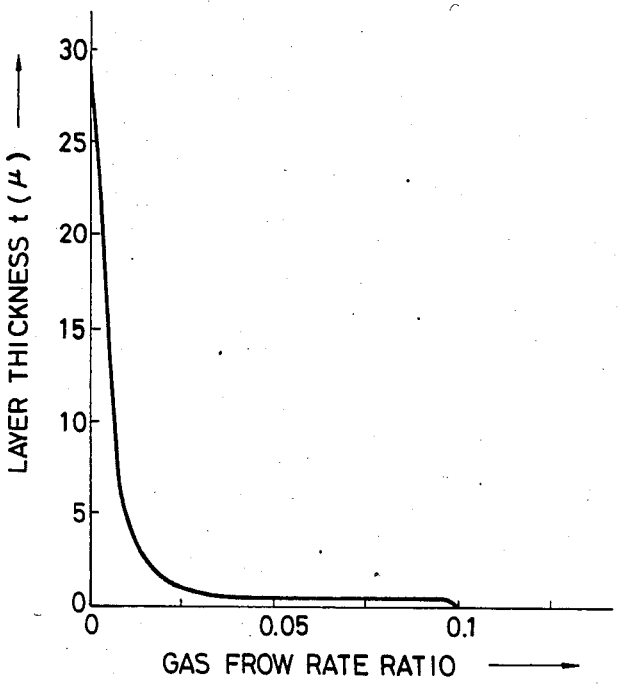

During the layer formation, the flow rate ratio of $NH_3$ gas relative to the sum of $GeH_4$ gas and $SiH_4$ gas was changed according to the change rate curve shown in FIG. 79.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 137

Light-receiving members for electrophotography were formed in the same manner as in the case of Sample No. 1-1M in Example 123 under the conditions as shown in Table 8M. In preparation of the first layer of a-SiGe:H:B:C layer, the mass flow controllers 2008 and 2007 for $GeH_4$ and $SiH_4$ were controlled by a computer (HP9845B) so that the flow rates of $GeH_4$ and $SiH_4$ might be as shown in FIG. 23.

Figure 80:
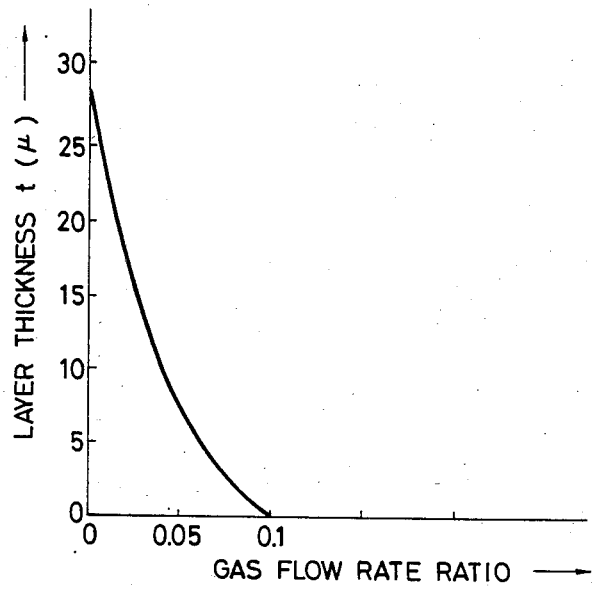

During the layer formation, the flow rate ratio of $CH_4$ gas relative to the sum of $GeH_4$ gas and $SiH_4$ gas was changed according to the change rate curve shown in FIG. 80.

For these light-receiving members for electrophotography, by means of the same image exposure device as in Example 123, image exposure was effected, followed by development and transfer to obtain visible images.

The images obtained in this case were free from any interference fringe pattern observed, exhibiting practically satisfactory electrophotographic characteristics.

EXAMPLE 138

Examples 125 to 137 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as in Examples 125 to 137.

For these light-receiving members for electrophotography, image exposure was effected by means of an image exposure device as shown in FIG. 26 (wavelength of laser beam 780 nm spot diameter 80 μm), followed by development and transfer, to obtain images. All of the images were free from interference fringe pattern and practically satisfactory.

EXAMPLE 139

Except for using the same substrate as used in Example 123, changing the surface layer material to various materials shown in Table 1A and employing two kinds of surface layer forming time (one is the same as in Example 123, the other is above twice as long as that in Example 123), the same conditions and procedures as in Example 123 were followed to prepare a-Si type light-receiving members for electrophotography (Sample Nos. 101M-122M).

These light-receiving members for electrophotography as prepared above were subjected to image exposure by means of a device as shown in FIG. 26 (wavelength of laser beam: 780 nm, spot diameter 80 μm), followed by development and transfer to obtain images. In any of the images of Sample Nos. 101M-122M), no interference fringe pattern was observed to give practically satisfactory electrophotographic characteristics.

COMPARATIVE EXAMPLE 13

As a comparative test, an a-Si light-receiving member for electrophotography was prepared in entirely the same manner as in the case of Sample No. 1-1M in Example 123 as described above except for employing an aluminum substrate roughened on its surface by the sand blasting method in place of the aluminum substrate used in preparation of the light-receiving member for electrograpy in Example 123. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 123, clear interference fringe was found to be formed in the black image over all the surface.

EXAMPLE 140

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving members for electrophotography procedures under the conditions as shown in Table 1N using the film deposition device as shown in FIG. 20 (Sample No. 1-1N).

The surface layer was formed by placing $ZrO_2$ selected from the plates (thickness 3 mm) of various materials as shown in Table 1A all over the surface of the cathode electrode in the device of FIG. 20 in this Example, replacing $H_2$ gas employed during formation of the first layer and the second layer with Ar gas, then evacuating internally the device to a vacuum of about $5\times10^{-6}$ Torr, subsequently exciting glow discharge at a high frequency power of 300 W with introduction of Ar gas and sputtering $ZrO_2$ on the cathode electrode. In the Examples shown below, the surface layers were formed in the same manner as in this Example except for changing the surface layer forming materials.

Separately, on the cylindrical aluminum substrate having the same characteristic, a light-receiving layer was formed similarly as in the above case except for changing the discharging power in formation of both the first layer and the second layer to 50 W. As the reuslt, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2N).

On the other hand, in the case of the above Sample No. 1-1N, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

The light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 141

By means of a lathe, the surface of a cylindrical aluminum substrate was worked as shown in Table 2N. On these cylindrical aluminum substrates (Cylinder Nos. 101N–108N), under the same condition as in the case of the Sample No. 1–1N in Example 140, light-receiving members for electrophotography were prepared (Sample Nos. 111N–118N). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3N. For these light-receiving members, image exposure was effected by means of the device shown in FIG. 26 with a semiconductor laser with a wavelength of 780 nm at a spot diameter of 80 μm similarly as in Example 140 to obtain the results shown in Table 3N.

EXAMPLE 142

Light-receiving members for electrophotography were formed in the same manner as in the case of Sample No. 1–1N in Example 140 under the conditions as shown in Table 4N.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 143

Light-receiving members for electrophotography were formed in the same manner as in the case of Sample No. 1–1N in Example 140 under the conditions as shown in Table 5N.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 144

Light-receiving members for electrophotography were formed in the same manner as in the case of Sample No. 1–1N in Example 140 under the conditions as shown in Table 6N.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 145

A light-receiving member for electrophotography was prepared following the same condition and the procedure as described in Example 143 except for changing $CH_4$ gas employed in Example 143 to $NH_3$ gas.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 146

A light-receiving member for electrophotography was prepared following the same condition and the procedure as described in Example 144 except for changing NO gas employed in Example 144 to $CH_4$ gas.

For these light-receiving member for electrophotography, by means of the same image exposure device as in Example 140, image exposure was effected, followed by development, transfer and fixing to obtain visible images on plain papers.

The images obtained in this case were free from any interference characteristics.

EXAMPLE 147

Light-receiving members for electrophotography were formed in the same manner as in the case of No. 1–1N in Example 140 under the conditions as shown in Table 7N.

Figure 56:
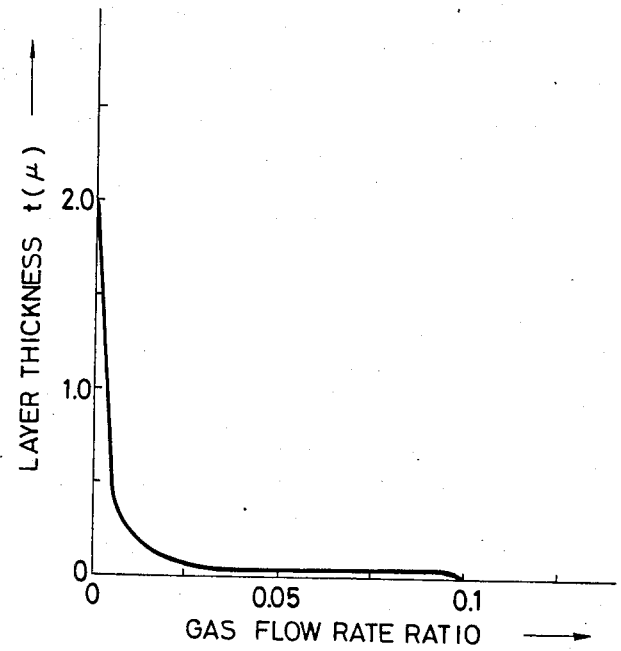

In formation of the boron containing layer, the respective mass flow controllers for $B_2H_6/H_2$ and $NH_3$ 2010 and 2009 were controlled by a computer (HP9845B) so that the flow rate of $B_2H_6/H_2$ might be as shown in FIG. 60 and the flow rate of $NH_3$ as shown in FIG. 56.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 148

A light-receiving member for electrophotography was prepared following the same condition and the procedure as described in Example 147 except for changing $NH_3$ gas employed in Example 147 to NO gas.

For these light-receiving members for electrophotography, by means of the same image exporure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 149

A light-receiving member for electrophotography was prepared following the same condition and the procedure as described in Example 147 except for changing $NH_3$ gas employed in Example 147 to $CH_4$ gas.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 150

Light-receiving members for electrophotography were formed in the same manner as in the case of Sample No. 1-1N in Example 140 under the conditions as shown in Table 8N.

In formation of the boron containing layer, the respective mass flow controllers for $B_2H_6/H_2$ and $CH_4$ 2010 and 2009 were controlled by a computer (HP9845B) so that the flow rate of $B_2H_6/H_2$ might be as shown in FIG. 61 and the flow rate of $CH_4$ as shown in FIG. 57.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 151

A light-receiving member for electrophotography was prepared following the same condition and the procedure as described in Example 150 except for changing $CH_4$ gas employed in Example 150 to NO gas.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 152

A light-receiving member for electrophotography was prepared following the same condition and the procedure as described in Example 150 except for changing $CH_4$ gas employed in Example 150 to $NH_3$ gas.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 153

Light-receiving members for electrophotography were formed in the same manner as in the case of Sample No. 1-1N in Example 140 under the conditions as shown in Table 9N.

Figure 62:
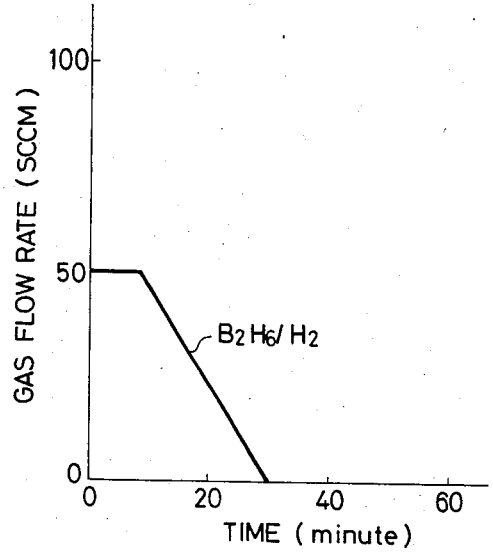

In formation of the boron containing layer, the respective mass flow controllers for $B_2H_6/H_2$ and NO 2010 and 2009 were controlled by a computer (HP9845) so that the flow rate of $B_2H_6/H_2$ might be as shown in FIG. 62 and the flow rate of NO as shown in FIG. 58.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 154

A light-receiving member for electrophotography was prepared following the same condition and the procedure as described in Example 153 except for changing NO gas employed in Example 153 to $NH_3$ gas.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 155

A light-receiving member for electrophotography was prepared following the same condition and the procedure as described in Example 153 except for changing NO gas employed in Example 153 to $CH_4$ gas.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 156

Light-receiving members for electrophotography were formed in the same manner as in the case of Sample No. 1-1N in Example 140 under the conditions as shown in Table 10N.

Figure 59:
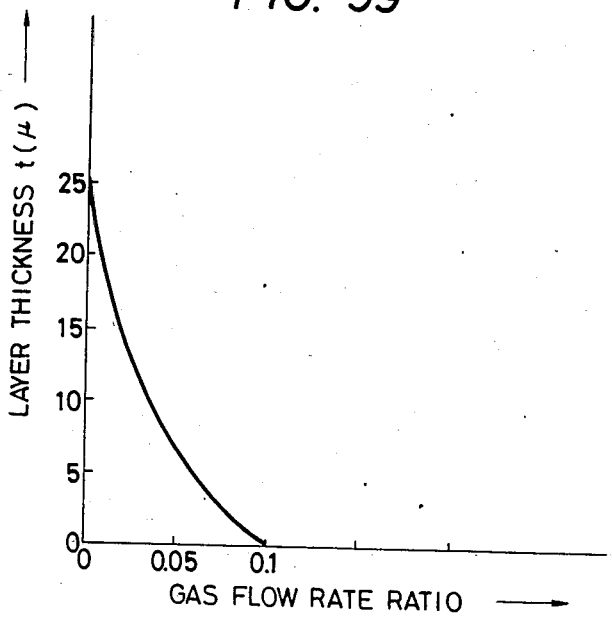

In formation of the boron containing layer, the respective mass flow controllers for $B_2H_6/H_2$ and $NH_3$ 2010 and 2009 were controlled by a computer (HP9845B) so that the flow rate of $B_2H_6/H_2$ might be as shown in FIG. 39 and the flow rate of $NH_3$ as shown in FIG. 59.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 157

A light-receiving member for electrophotography was prepared following the same condition and the procedure as described in Example 156 except for changing $NH_3$ gas employed in Example 156 to NO gas.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 158

A light-receiving member for electrophotography was prepared following the same condition and the procedure as described in Example 156 except for changing $NH_3$ gas employed in Example 156 to $CH_4$ gas.

For these light-receiving members for electrophotography, by means of the same image exposure device as in Example 140, image exposure was effected, followed by development, transfer and fixing to obtain visible images on plain papers.

The images obtained in this case were free from any interference fringe pattern observed, exhibiting practically satisfactory characteristics.

EXAMPLE 159

The case of Sample No. 1-1N in Example 140 and Examples 142 to 158 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as the case of Sample No. 1-1N in Example 140 and in Examples 142 to 158.

For these light-receiving members for electrophotography, image exposure was effected by means of an image exposure device as shown in FIG. 26 (wavelength of laser beam: 780 nm, spot diameter 80 μm ), followed by development and transfer, to obtain images. All of the images were free from interference fringe pattern and practically satisfactory.

EXAMPLE 160

Under the same conditions as in Sample No. 1-1N in Example 140 except for changing the material and the layer thickness for the surface layer as shown in Table 1A, light-receiving members for electrophotography were prepared following various operational procedures by means of the device shown in FIG. 20 (sample Nos. 101A-122N).

The respective light-receiving members for electrophotography as prepared above were subjected to image exposure by means of a device as shown in FIG. 26 (wavelength of laser beam: 780 nm, spot diameter 80 μm), followed by development and transfer to obtain images. Any of the resulting images was found to be free from any interference fringe pattern observed, thus being practically satisfactory.

COMPARATIVE EXAMPLE 14

As a comparative test, an a-Si light-receiving member for electrophotography was prepared in entirely the same manner as in the case of Sample No. 1-1N in Example 140 as described above except for employing an aluminum substrate roughened on its surface by the sand blasting method in place of the aluminum substrate used in preparation of the light-receiving member for electrophotography in Example 140. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 140, clear interference fringe was found to be formed in the black image over all the surface.

EXAMPLE 161

An aluminum substrate having the shape as shown in FIG. 9 (spiral groove surface shape with length (L): 357 nm, outerdiameter (r): 80 mm; pitch (P) 25 μm; depth (D) 0.8 μm) was prepared.

Next, a-Si light-receiving members for electrophotography were deposited on the above aluminum substrate following various procedures under the conditions as shown in Table 1P using the film deposition device as shown in FIG. 20 (Sample No. 1-1P).

In preparation of the first layer, the mass flow controllers 2007, 2008 and 2010 were controlled by a computer (HP9845B) so that the flow rates of $CeH_4$, $SiH_4$ and $B_2H_6/H_2$ might be as shown in FIG. 22 and FIG. 26.

The surface layer was formed by placing $ZrO_2$ selected from the plates (thickness 3 mm) of various materials as shown in Table 1A all over the surface of the cathode electrode in the device of FIG. 20 in this Example, replacing $H_2$ gas employed during formation of the first layer and the second layer with Ar gas, then evacuating internally the device to a vacuum of about $5\times10^{-6}$ Torr, subsequently exciting glow discharge at a high frequency power of 300 W with introduction of Ar gas and sputtering $ZrO_2$ on the cathod electrode. In the Examples shown below, the surface layers were formed in the same manner as in this Example except for changing the surface layer forming materials.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 1205 was found to be in parallel to the surface of the substrate 1201 as shown in FIG. 82. In this case, the difference in the whole layer thickness between the center and the both ends of the aluminum substrate was found to be 1 μm (Sample No. 1-2P).

On the other hand, in the case of Sample No. 1-1P, the surface of the surface layer 1305 and the surface of the substrate 1301 were found to be non-parallel to each other as shown in FIG. 83. In this case, the difference in average layer thickness between the center and both ends of the aluminum substrate was found to be 2 μm.

The light-receiving members for electrophotography as prepared above were subjected to image exposure by means of a device as shown in FIG. 26 with a semiconductor laser (wavelength of laser beam: 780 nm, spot diameter 80 μm), followed by development and transfer to obtain images. In the light-receiving member having the surface characteristic as shown in FIG. 82 an interference fringe pattern was observed.

On the other hand, in the light-receiving member having the surface characteristic as shown in FIG. 83, no interference fringe pattern was observed to give practically satisfactory electrophotographic characteristics.

EXAMPLE 162

By means of a lathe, the surface of a cylindrical aluminum substrate was worked as shown in Table 2P. On these cylindrical aluminum substrates (Cylinder Nos. 101P–108P), under the same condition as in the case of the Sample No. 1–1P in Example 161, light-receiving members for electrophotography were prepared (Sample Nos. 111P–118P). The difference in average layer thickness between the center and the both ends of the aluminum substrate of the light-receiving members for electrophotography was found to be 2.2 μm).

The cross-section of these light-receiving members for electrography were observed by electron microscope and the difference within the pitch of the light-receiving layer was measured to give the results as shown in Table 3P. For these light-receiving members, image exposure was effected by means of the device shown in FIG. 26 with a semiconductor laser with a wavelength of 780 nm at a spot diameter os 80 μm similarly as in Example 161 to obtain the results shown in Table 3P.

EXAMPLE 163

In formation of the first layer except for controlling the mass flow controllers 2007, 2008 and 2010 so that the flow rates of $GeH_4$ $SiH_4$ and $B_2H_6/H_2$ may be as shown in FIG. 23 and FIG. 37 the same procedure in the case of the sample No. 1–1P in Example 161 was followed to prepare a light-receiving layer for electrophotography.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 164

Light-receiving members for electrophotography were formed in the same manner as in the case of Sample No. 1–1P in Example 161 under the conditions as shown in Table 4P.

In preparation of the first layer, the mass flow controllers 2007 and 2008 and 2010 were controlled by a computer (HP9845B) so that the flow rates of $GeH_4$, $SiH_4$ and $B_2H_6/H_2$ might be as shown in FIG. 24 and FIG. 38.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 165

In formation of the first layer except for controlling the mass flow controllers 2007, 2008 and 2010 so that the flow rates of $GeH_4$, $SiH_4$ and $B_2H_6/H_2$ may be as shown in FIG. 25 and FIG. 39, the same conditions as in Example 164 was followed to prepare a light-receiving layer for electrophotography.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 166

Light-receiving members for electrophotography were formed in the same manner as in the case of Sample Nos. 1–1P in Example 161 under the conditions as shown in Table 5P.

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 40.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 167

Light-receiving members for electrophotography were formed in the same manner as in the case of Sample No. 1–1P in Example 161 under the conditions as shown in Table 6P.

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 41.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 168

Light-receiving members for electrophotography were formed in the same manner as in the case of Sample No. 1–1P in Example 161 under the conditions as shown in Table 7P.

In preparation of the first layer and A layer, the mass flow controllers 2007, 2008 and 2010 were controlled by a computer (HP9845B) so that the flow rates of $GeH_4$, $SiH_4$ and $B_2H_6/H_2$ might be as shown in FIG. 42.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 169

A light-receiving member for electrophotography was prepared following the same manner in the case of Sampl No. 1-1P in Example 162 except for changing No gas employed in Example 161 to $NH_3$ gas.

For these light-receiving members for electrophotography, by means of the same image exposure device as in Example 1, image exposure was effected, followed by development, transfer and fixing to obtain visible images on plain papers.

The images obtained in this case were free from any interference fringe pattern observed, exhibiting practically satisfactory characteristics.

EXAMPLE 170

A light-receiving member for electrophotography was prepared following the same manner in the case of Sample Nos. 1-1P in Example 161 except for changing NO gas employed in Example 161 to $CH_4$ gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 171

A light-receiving member for electrophotography was prepared following the same condition and the procedure as described in Example 164 except for changing $NH_3$ gas employed in Example 164 to NO gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 172

A light-receiving member for electrophotography was prepared following the same condition and the procedure as described in Example 164 except for changing $NH_3$ gas employed in Example 164 to $CH_4$ gas.

For these light-receiving members for electrophotograph, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 173

A light-receiving member for electrophotography was prepared following the same condition and the procedure as described in Example 166 except for changing $CH_4$ gas employed in Example 166 to NO gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 174

A light-receiving member for electrophotography was prepared following the same condition and the procedure as described in Example 166 except for changing $CH_4$ gas employed in Example 166 to $NH_3$ gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 175

Light-receiving members for electrophotography were formed in the same manner as in the case of Sample No. 1-1P in Example 161 under the conditions as shown in Table 8P.

Figure 52:
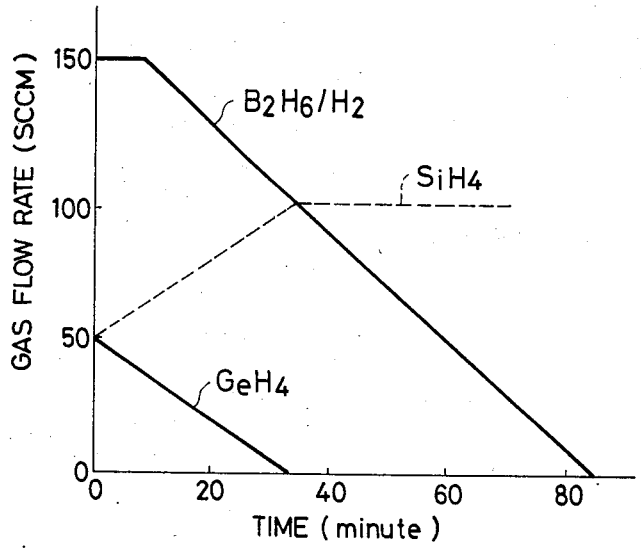

The mass flow controllers 2007, 2008, 2010 and 2009 for $SiH_4$, $GeH_4$, $B_2H_6/H_2$ and $NH_3$ were controlled by a computer (HP9845B) so that the flow rates of $SiH_4$, $GeH_4$ and $B_2H_b/H_2$ gases might be as shown in FIG. 52 and the flow rate of $NH_3$ during formation of the nitrogen containing layer might be as shown in FIG. 56.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 176

A light-receiving member for electrophotography was prepared following the same condition and the procedure as described in Example 175 except for changing $NH_3$ gas employed in Example 175 to NO gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 177

A light-receiving member for electrophotography was prepared following the same condition and the procedure as described in Example 175 except for changing $NH_3$ gas employed in Example 175 to $CH_4$ gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 178

Light-receiving members for electrophotography were formed in the same manner as in the case of Sample No. 1-1P in Example 161 under the conditions as shown in Table 9P.

Figure 53:
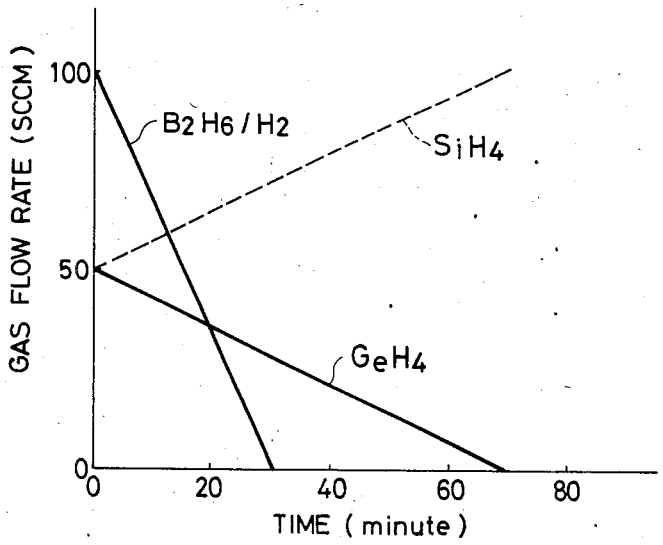

The mass flow controllers 2007, 2008, 2010 and 2009 for $SiH_4$, $GeH_4$, $B_2H_6/H_2$ and $CH_4$ were controlled by a computer (HP9845B) so that the flow rates of $SiH_4$, $GeH_4$ and $B_2H_6/H_2$ gases might be as shown in FIG. 53 and the flow rate of $CH_4$ during formation of the carbon containing layer might be as shown in FIG. 57.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 179

A light-receiving member for electrophotography was prepared following the same condition and the procedure as described in Example 178 except for changing $CH_4$ gas employed in Example 178 to NO gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 180

A light-receiving member for electrophotography was prepared following the same condition and the procedure as described in Example 178 except for changing $CH_4$ gas employed in Example 178 to $NH_3$ gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 181

Light-receiving members for electrophotography were formed in the same manner as in the case of Sample No. 1-1P in Example 161 under the conditions as shown in Table 10P.

Figure 54:
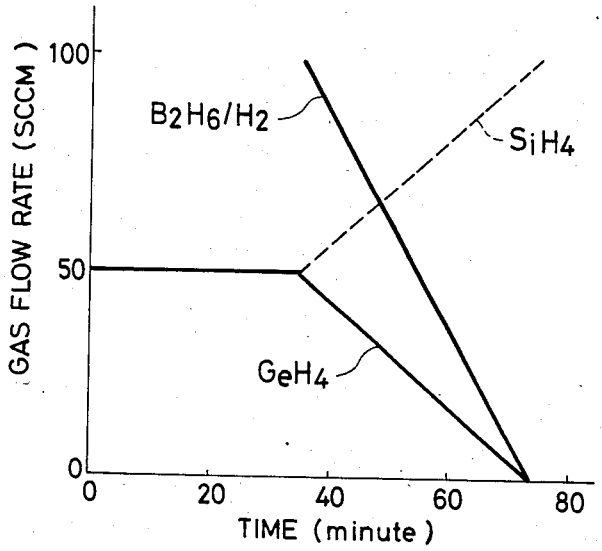

The mass flow controllers 2007, 2008, 2010 and 2009 for $SiH_4$, $GeH_4$, $B_2H_6/H_2$ and NO were controlled by a computer (HP9845B) so that the flow rates of $SiH_4$, $GeH_4$ and $B_2H_6/H_2$ gases might be as shown in FIG. 54 and the flow rate of NO during formation of the oxygen containing layer might be as shown in FIG. 58.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 182

A light-receiving member for electrophotography was prepared following the same condition and the procedure as described in Example 181 except for changing NO gas employed in Example 181 to $NH_3$ gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 183

A light-receiving member for electrophotography was prepared following the same condition and the procedure as described in Example 181 except for changing NO gas employed in Example 181 to $CH_4$ gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 184

Light-receiving members for electrophotography were formed in the same manner as in the case of Sample No. 1-1P in Example 161 under the conditions as shown in Table 11P.

Figure 55:
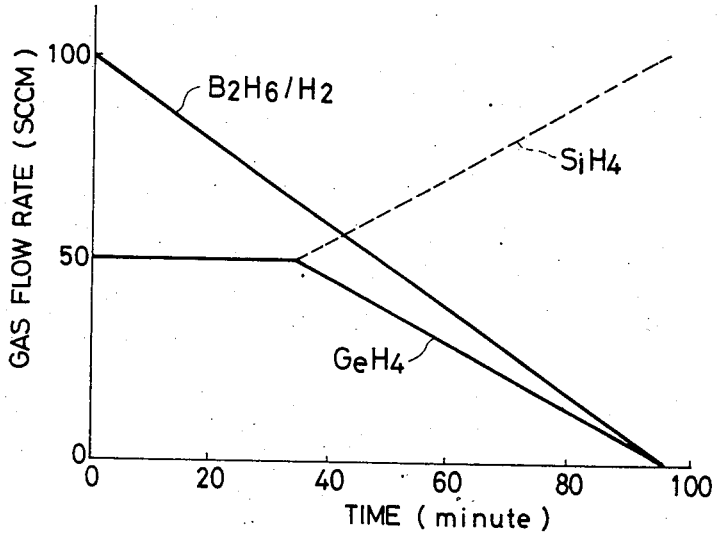

The mass flow controllers 2007, 2008, 2010 and 2009 for $SiH_4$, $GeH_4$, $B_2H_6/H_2$ and $NH_3$ were controlled by a computer (HP9854B) so that the flow rates of $SiH_4$, $GeH_4$ and $B_2H_6/H_2$ gases might be as shown in FIG. 55 and the flow rate of $NH_3$ during formation of the nitrogen containing layer might be as shown in FIG. 59.

For these light-receiving members for electrophotography, by means of the same image exposure device as in Example 161 image exposure was effected, followed by development, transfer and fixing to obtain visible images on plain papers.

The images obtained in this case were free from any interference fringe pattern observed, exhibiting practically satisfactory characteristics.

EXAMPLE 185

A light-receiving member for electrophotography was prepared following the same condition and the procedure as descirbed in Example 184 except for changing $NH_3$ gas employed in Example 184 to NO gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 186

A light-receiving member for electrophotography was prepared following the sme condition and the procedure as described in Example 184 except for changing $NH_3$ gas employed in Example 184 to $CH_4$ gas.

For these light-receiving members for electrophotography, by means of the same image exposure device as in Example 161, image exposure was effected, followed by development, transfer and fixing to obtain visible images on plain papers.

The images obtained in this case were free from any interference fringe pattern observed, exhibiting practically satisfactory characteristics.

EXAMPLE 187

The case of Sample No. 1-1P in Example 161 and Examples 163 to 186 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as the case of Sample No. 1-1P in Example 161 and in Examples 163 to 186.

For these light-receiving members for electrophotography, image exposure was effected by menas of an image exposure device as shown in FIG. 26 (wavelength of laser beam 780 nm, spot diameter 80 μm), followed by development and transfer, to obtain images. All of the images were free from interference fringe pattern and practically satisfactory.

EXAMPLE 188

Under the same conditions as in Sample No. 1-1P in Example 161 except for changing the material and the layer thickness for the surface layer as shown in Table 1A, light-receiving members for electrophotography were prepared following various operational procedures by means of the device shown in FIG. 20 (Sample Nos. 101P-122P).

The respective light-receiving members for electrophotography as prepared above were subjected to image exposure by means of a device as shown in FIG. 26 (wavelength of laser beam: 780 nm, spot diameter 80 μm), followed by development and transfer to obtain images. Any of the resulting images was found to be free from any interference fringe pattern observed, thus being practically satisfactory.

COMPARATIVE EXAMPLE 15

As a comparative test, as a-Si light-receiving member for electrophotography was prepared in entirely the same manner as in the case of Sample No. 1-1P Example 161 as described above except for employing an aluminum substrate roughened on its surface by the sane blasting method in place of the aluminum substrate used in preparation of the light-receiving member for electrophotography in Example 161. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 161, clear interference fringe was found to be formed in the black image over all the surface.

TABLE 1A

| Condition No. | 101A | 102A | 103A | 104A | 105A | 106A | 107A | 108A | 109A | 110A | 111A | 112A |
|---|---|---|---|---|---|---|---|---|---|---|---|---|
| Material for surface layer | $ZrO_2$ | | $TiO_2$ | | $ZrO_2/TiO_2 = 6/1$ | | $TiO_2/ZrO_2 = 3/1$ | | $CeO_2$ | | ZnS | |
| Refractive index | 2.00 | | 2.26 | | 2.09 | | 2.20 | | 2.23 | | 2.24 | |
| Layer thickness ($10^{-2}$ μm) | 9.75 | 29.3 | 8.63 | 25.9 | 9.33 | 28.0 | 8.86 | 26.6 | 8.74 | 26.2 | 8.71 | 26.1 |

| Condition No. | 113A | 114A | 115A | 116A | 117A | 118A | 119A | 120A | 121A | 122A |
|---|---|---|---|---|---|---|---|---|---|---|
| Material for surface layer | $Al_2O_3$ | | $CeF_3$ | | $Al_2O_3/ZrO_2 = 1/1$ | | $MgF_2$ | | $SiO_2$ | |
| Refractive index | 1.63 | | 1.60 | | 1.68 | | 1.38 | | 1.49 | |
| Layer thickness ($10^{-2}$ μm) | 12.0 | 35.9 | 12.3 | 36.6 | 11.6 | 34.8 | 14.1 | 42.4 | 13.1 | 39.3 |

TABLE 2A

| No. | 201A | 202A | 203A | 204A | 205A | 206A | 207A | 208A |
|---|---|---|---|---|---|---|---|---|
| Pitch (μm) | 620 | 190 | 110 | 49 | 38 | 26 | 11 | 4.9 |
| Depth (μm) | 1.1 | 11 | 1.9 | 2.2 | 1.8 | 0.9 | 0.25 | 1.9 |
| Angle (degree) | 0.2 | 6.6 | 2.0 | 5.1 | 5.4 | 4.0 | 2.6 | 38 |

TABLE 3A

| | No. | | | | | | | |
|---|---|---|---|---|---|---|---|---|
| | 211A | 212A | 213A | 214A | 215A | 216A | 217A | 218A |
| | Cylinder No. | | | | | | | |
| | 201A | 202A | 203A | 204A | 205A | 206A | 207A | 208A |
| Difference in layer thickness (μm) | 0.04 | 0.06 | 0.14 | 0.15 | 0.3 | 0.2 | 0.11 | 2.8 |
| Interference fringe | X | X | ○ | ○ | ◎ | ◎ | Δ | X |

X Practically unusable
Δ Practically satisfactory
○ Practically very good
◎ Practically excellent

TABLE 4A

| | No. | | | | | | | |
|---|---|---|---|---|---|---|---|---|
| | 211A | 212A | 213A | 214A | 215A | 216A | 217A | 218A |
| | Cylinder No. | | | | | | | |
| | 201A | 202A | 203A | 204A | 205A | 206A | 207A | 208A |
| Difference in layer thickness of first layer (μm) | 0.05 | 0.05 | 0.06 | 0.18 | 0.31 | 0.22 | 0.71 | 2.4 |
| Difference in layer thickness of second layer (μm) | 0.06 | 0.06 | 0.1 | 0.2 | 0.35 | 0.32 | 0.81 | 3.2 |
| Interference fringe | X | X | ○ | ◎ | ◎ | ◎ | Δ | X |

X Practically unusable
Δ Practically satisfactory
○ Practically very good
◎Practically excellent

TABLE 5A

| No. | 401A | 402A | 403A | 404A | 405A | 406A | 407A |
|---|---|---|---|---|---|---|---|
| Pitch (μm) | 41 | 32 | 26 | 21 | 11 | 4.9 | 2.1 |
| Depth (μm) | 3.51 | 2.6 | 0.9 | 1.1 | 0.71 | 0.11 | 0.51 |
| Angle (degree) | 9.7 | 9.2 | 4.0 | 6 | 7.4 | 2.6 | 2.6 |

TABLE 6A

| | No. | | | | | | |
|---|---|---|---|---|---|---|---|
| | 411A | 412A | 413A | 414A | 415A | 416A | 417A |
| | Cylinder No. | | | | | | |
| | 201A | 202A | 203A | 204A | 205A | 206A | 207A |
| Difference in layer thickness (μm) | 0.11 | 0.12 | 0.32 | 0.26 | 0.71 | 0.11 | 2.2 |
| Interference fringe | Δ | ○ | ◎ | ◎ | ◎ | Δ | X |

X Practically unusable
Δ Practically satisfactory
○ Practically very good
◎Practically excellent

TABLE 7A

| | No. | | | | | | |
|---|---|---|---|---|---|---|---|
| | 511A | 512A | 513A | 514A | 515A | 516A | 517A |
| | Cylinder No. | | | | | | |
| | 201A | 202A | 203A | 204A | 205A | 206A | 207A |
| Difference in layer thickness (μm) | 0.06 | 0.11 | 0.12 | 0.33 | 0.52 | 0.06 | 2.15 |
| Interference fringe | X | Δ | ○ | ◎ | ◎ | X | X |

X Practically unusable
Δ Practically satisfactory
○ Practically very good
◎Practically excellent

TABLE 8A

| | No. | | | | | | |
|---|---|---|---|---|---|---|---|
| | 611A | 612A | 613A | 614A | 615A | 616A | 617A |
| | Cylinder No. | | | | | | |
| | 201A | 202A | 203A | 204A | 205A | 206A | 207A |
| Difference in layer thickness (μm) | 0.11 | 0.32 | 0.4 | 0.31 | 0.9 | 0.12 | 2.51 |
| Interference fringe | Δ | ◎ | ◎ | ◎ | ◎ | ○ | X |

X Practically unusable
Δ Practically satisfactory
○ Practically very good
◎Practically excellent

TABLE 2B

| No. | 201B | 202B | 203B | 204B | 205B | 206B | 207B | 208B |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |

TABLE 2B-continued

| No. | 201B | 202B | 203B | 204B | 205B | 206B | 207B | 208B |
|---|---|---|---|---|---|---|---|---|
| Angle (degree) | 0.2 | 5.7 | 2.1 | 5.0 | 4.8 | 3.7 | 2.3 | 38 |

TABLE 3B

| | No. | | | | | | | |
|---|---|---|---|---|---|---|---|---|
| | 211B | 212B | 213B | 214B | 215B | 216B | 217B | 218B |
| | Cylinder No. | | | | | | | |
| | 201B | 202B | 203B | 204B | 205B | 206B | 207B | 208B |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X Practically unusable
Δ Practically satisfactory
○ Practically very good
◎Practically excellent

TABLE 4B

| | No. | | | | | | | |
|---|---|---|---|---|---|---|---|---|
| | 311B | 312B | 313B | 314B | 315B | 316B | 317B | 318B |
| | Cylinder No. | | | | | | | |
| | 201B | 202B | 203B | 204B | 205B | 206B | 207B | 208B |
| Difference in layer thickness of first layer (μm) | 0.05 | 0.041 | 0.1 | 0.18 | 0.31 | 0.22 | 0.1 | 2.6 |
| Difference in layer thickness of second layer (μm) | 0.06 | 0.07 | 0.11 | 0.22 | 0.41 | 0.32 | 0.1 | 3.6 |
| Interference fringe | X | X | ○ | ◎ | ◎ | ◎ | Δ | X |

X Practically unusable
Δ Practically satisfactory
○ Practically very good
◎Practically excellent

TABLE 5B

| | Starting gas | Flow rate (SCCM) | High frequency power (W) | Layer thickness (μm) |
|---|---|---|---|---|
| Charge injection preventive layer | $H_2$ | 300 | 160 | 3 |
| | $SiH_4$ | 150 | | |
| | $NH_3$ | 30 | | |
| | $B_2H$ | 0.24 | | |
| Photosensitive layer | $H_2$ | 300 | 300 | 20 |
| | $SiH_4$ | 300 | | |
| Surface layer | Ar | 100 | 300 | 0.359 |
| | $Al_2O_3$ target | | | |

TABLE 6B

| | No. | | | | | | | |
|---|---|---|---|---|---|---|---|---|
| | 401B | 402B | 403B | 404B | 405B | 406B | 407B | 408B |
| | Cylinder No. | | | | | | | |
| | 201B | 202B | 203B | 204B | 205B | 206B | 207B | 208B |
| Difference in layer thickness (μm) | 0.07 | 0.08 | 0.17 | 0.20 | 0.42 | 0.33 | 0.11 | 2.8 |
| Interference fringe | X | X | ○ | ◎ | ◎ | ◎ | Δ | X |

X Practically unusable
Δ Practically satisfactory
○ Practically very good
◎Practically excellent

TABLE 7B

| | Starting gas | Flow rate (SCCM) | High frequency power (W) | Layer thickness (μm) |
|---|---|---|---|---|
| Charge injection preventive layer | $H_2$<br>$SiH_4$<br>$NH_3$<br>$B_2H$ | 300<br>150<br>15<br>0.3 | 160 | 3 |
| Photosensitive layer | $H_2$<br>$SiH_4$ | 300<br>300 | 200 | 20 |
| Surface layer | Ar<br>$SiO_2$ target | 100 | 300 | 0.393 |

TABLE 8B

| | No. | | | | | | | |
|---|---|---|---|---|---|---|---|---|
| | 501B | 502B | 503B | 504B | 505B | 506B | 507B | 508B |
| | Cylinder No. | | | | | | | |
| | 201B | 202B | 203B | 204B | 205B | 206B | 207B | 208B |
| Difference in layer thickness of first layer (μm) | 0.05 | 0.07 | 0.1 | 0.21 | 0.31 | 0.22 | 0.1 | 2.6 |
| Difference in layer thickness of second layer (μm) | 0.06 | 0.08 | 0.1 | 0.2 | 0.41 | 0.35 | 0.1 | 3.5 |
| Interference fringe | X | X | ○ | ◎ | ◎ | ◎ | Δ | X |

X Practically unusable
Δ Practically satisfactory
○ Practically very good
◎Practically excellent

TABLE 9B

| | Starting gas | Flow rate (SCCM) | High frequency power (W) | Layer thickness (μm) |
|---|---|---|---|---|
| Charge injection preventive layer | $H_2$<br>$SiH_4$<br>$CH_4$<br>$B_2H$ | 300<br>150<br>15<br>0.45 | 170 | 2.8 |

TABLE 9B-continued

| | Starting gas | Flow rate (SCCM) | High frequency power (W) | Layer thickness (μm) |
|---|---|---|---|---|
| Photosensitive layer | $H_2$<br>$SiH_4$ | 300<br>300 | 200 | 21 |
| Surface layer | Ar<br>$CeF_3$ target | 100 | 270 | 0.424 |

TABLE 10B

| | No. | | | | | | | |
|---|---|---|---|---|---|---|---|---|
| | 1001B | 1002B | 1003B | 1004B | 1005B | 1006B | 1007B | 1008B |
| | Cylinder No. | | | | | | | |
| | 201B | 202B | 203B | 204B | 205B | 206B | 207B | 208B |
| Difference in layer thickness (μm) | 0.07 | 0.09 | 0.16 | 0.19 | 0.46 | 0.35 | 0.1 | 3.2 |
| Interference fringe | X | X | ○ | ○ | ◎ | ◎ | Δ | X |

X Practically unusable
Δ Practically satisfactory
○ Practically very good
◎Practically excellent

TABLE 11B

| | Starting gas | Flow rate (SCCM) | High frequency power (W) | Layer thickness (μm) |
|---|---|---|---|---|
| Charge injection preventive layer | $H_2$<br>$SiH_4$<br>$CH_4$<br>$B_2H$ | 300<br>160<br>16<br>0.4 | 170 | 5.1 |
| Photosensitive layer | $H_2$<br>$SiH_4$ | 300<br>300 | 200 | 22 |
| Surface layer | Ar<br>$CeO_2$ target | 70 | 300 | 0.262 |

TABLE 12B

| | No. | | | | | | | |
|---|---|---|---|---|---|---|---|---|
| | 1201B | 1202B | 1203B | 1204B | 1205B | 1206B | 1207B | 1208B |
| | Cylinder No. | | | | | | | |
| | 201B | 202B | 203B | 204B | 205B | 206B | 207B | 208B |
| Difference in layer thickness of first layer (μm) | 0.05 | 0.06 | 0.1 | 0.21 | 0.31 | 0.21 | 0.1 | 2.7 |
| Difference in layer thickness of second layer (μm) | 0.07 | 0.08 | 0.11 | 0.35 | 0.45 | 0.31 | 0.1 | 3.5 |
| Interference fringe | X | X | ○ | ◎ | ◎ | ◎ | Δ | X |

X Practically unusable
Δ Practically satisfactory
○ Practically very good
◎Practically excellent

TABLE 2C

| No. | 201C | 202C | 203C | 204C | 205C | 206C | 207C | 208C |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3C

| | No. | | | | | | | |
|---|---|---|---|---|---|---|---|---|
| | 211C | 212C | 213C | 214C | 215C | 216C | 217C | 218C |
| | Cylinder No. | | | | | | | |
| | 201C | 202C | 203C | 204C | 205C | 206C | 207C | 208C |
| Difference in layer thickness (μm) | 0.06 | 0.08 | 0.16 | 0.18 | 0.41 | 0.31 | 0.11 | 3.2 |

TABLE 3C-continued

| | No. | | | | | | | |
|---|---|---|---|---|---|---|---|---|
| | 211C | 212C | 213C | 214C | 215C | 216C | 217C | 218C |
| | Cylinder No. | | | | | | | |
| | 201C | 202C | 203C | 204C | 205C | 206C | 207C | 208C |
| Interference fringe | X | X | ○ | ○ | ◎ | ◎ | Δ | X |

X Practically unusable
Δ Practically satisfactory
○ Practically very good
◎Practically excellent

TABLE 4C

| | No. | | | | | | | |
|---|---|---|---|---|---|---|---|---|
| | 311C | 312C | 313C | 314C | 315C | 316C | 317C | 318C |
| | Cylinder No. | | | | | | | |
| | 201C | 202C | 203C | 204C | 205C | 206C | 207C | 208C |
| Difference in layer thickness of first layer (μm) | 0.05 | 0.041 | 0.1 | 0.18 | 0.31 | 0.22 | 0.1 | 2.6 |
| Difference in layer thickness of second layer (μm) | 0.06 | 0.07 | 0.11 | 0.22 | 0.41 | 0.32 | 0.1 | 3.6 |
| Interference fringe | X | X | ○ | ◎ | ◎ | ◎ | Δ | X |

X Practically unusable
Δ Practically satisfactory
○ Practically very good
◎Practically excellent

TABLE 5C

| | Starting gas | Flow rate (SCCM) | High frequency power (W) | Layer thickness (μm) |
|---|---|---|---|---|
| Charge injection preventive layer | $H_2$<br>$SiH_4$<br>$NH_3$<br>$B_2H_6$ | 300<br>150<br>30<br>0.24 | 160 | 3 |

TABLE 6C

| | No. | | | | | | | |
|---|---|---|---|---|---|---|---|---|
| | 401C | 402C | 403C | 404C | 405C | 406C | 407C | 408C |
| | Cylinder No. | | | | | | | |
| | 201C | 202C | 203C | 204C | 205C | 206C | 207C | 208C |
| Difference in layer thickness (μm) | 0.07 | 0.08 | 0.17 | 0.20 | 0.42 | 0.33 | 0.11 | 2.8 |
| Interference fringe | X | X | ○ | ◎ | ◎ | ◎ | Δ | X |

X Practically unusable
Δ Practically satisfactory
○ Practically very good
◎Practically excellent

TABLE 7C

| | Starting gas | Flow rate (SCCM) | High frequency power (W) | Layer thickness (μm) |
|---|---|---|---|---|
| Charge injection preventive layer | $H_2$<br>$SiH_4$<br>$NH_3$<br>$B_2H_6$ | 300<br>150<br>15<br>0.3 | 160 | 5 |
| Photosensitive layer | $H_2$<br>$SiH_4$ | 300<br>300 | 200 | 20 |
| Surface layer | Ar<br>$SiO_2$ target | 100 | 300 | 0.393 |

TABLE 7C-continued

| | Starting gas | Flow rate (SCCM) | High frequency power (W) | Layer thickness (μm) |
|---|---|---|---|---|
| | target | | | |

TABLE 8C

| | No. | | | | | | | |
|---|---|---|---|---|---|---|---|---|
| | 501C | 502C | 503C | 504C | 505C | 506C | 507C | 508C |
| | Cylinder No. | | | | | | | |
| | 201C | 202C | 203C | 204C | 205C | 206C | 207C | 208C |
| Difference in layer thickness of first layer (μm) | 0.05 | 0.07 | 0.1 | 0.21 | 0.31 | 0.22 | 0.1 | 2.6 |
| Difference in layer thickness of second layer (μm) | 0.06 | 0.08 | 0.1 | 0.2 | 0.41 | 0.35 | 0.1 | 3.5 |
| Interference fringe | X | X | ○ | ◎ | ◎ | ◎ | Δ | X |

X Practically unusable
Δ Practically satisfactory
○ Practically very good
◎Practically excellent

TABLE 9C

| | Starting gas | Flow rate (SCCM) | High frequency power (W) | Layer thickness (μm) |
|---|---|---|---|---|
| Charge injection preventive layer | $H_2$<br>$SiH_4$<br>$CH_4$<br>$B_2H_6$ | 300<br>150<br>15<br>0.45 | 170 | 2.8 |
| Photosensitive layer | $H_2$<br>$SiH_4$ | 300<br>300 | 200 | 21 |
| Surface layer | Ar<br>$CeF_3$ target | 100 | 270 | 0.424 |

TABLE 10C

| | No. | | | | | | | |
|---|---|---|---|---|---|---|---|---|
| | 1001C | 1002C | 1003C | 1004C | 1005C | 1006C | 1007C | 1008C |
| | Cylinder No. | | | | | | | |
| | 201C | 202C | 203C | 204C | 205C | 206C | 207C | 208C |
| Difference in layer thickness (μm) | 0.07 | 0.09 | 0.16 | 0.19 | 0.46 | 0.35 | 0.1 | 3.2 |
| Interference fringe | X | X | ○ | ○ | ◎ | ◎ | Δ | X |

X Practically unusable
Δ Practically satisfactory
○ Practically very good
◎Practically excellent

TABLE 11C

| | Starting gas | Flow rate (SCCM) | High frequency power (W) | Layer thickness (μm) |
|---|---|---|---|---|
| Charge injection preventive layer | $H_2$<br>$SiH_4$<br>$CH_4$<br>$B_2H_6$ | 300<br>160<br>16<br>0.4 | 170 | 5.1 |
| Photosensitive layer | $H_2$<br>$SiH_4$ | 300<br>300 | 230 | 22 |
| Surface layer | Ar<br>$CeO_2$ target | 70 | 300 | 0.262 |

TABLE 12C

| | No. | | | | | | | |
|---|---|---|---|---|---|---|---|---|
| | 1201C | 1202C | 1203C | 1204C | 1205C | 1206C | 1207C | 1208C |
| | Cylinder No. | | | | | | | |
| | 201C | 202C | 203C | 204C | 205C | 206C | 207C | 208C |
| Difference in layer thickness of first layer (μm) | 0.05 | 0.06 | 0.1 | 0.22 | 0.31 | 0.21 | 0.1 | 2.7 |
| Difference in layer thickness of second layer (μm) | 0.07 | 0.08 | 0.11 | 0.35 | 0.45 | 0.31 | 0.1 | 3.5 |
| Interference fringe | X | X | ○ | ◎ | ◎ | ◎ | Δ | X |

X Practically unusable
Δ Practically satisfactory
○ Practically very good
◎Practically excellent

TABLE 13C (Sample No. 1301)

| | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4$/He = 0.05<br>NO | $SiH_4$ = 50 | NO/$SiH_4$ = 3/10~0 | 150 | 12 | 1 |
| Second layer | $SiH_4$/He = 0.05 | $SiH_4$ = 50 | | 150 | 12 | 20 |

TABLE 14C (Sample No. 1302)

| | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4$/He = 0.05<br>$B_2H_6$/He = 0.0001<br>NO | $SiH_4$ = 50 | $B_2H_6$/Si<br>$H_4$ = 0.0004<br>NO/$SiH_4$ = 2/10~0 | 150 | 12 | 0.5 |
| Second layer | $SiH_4$/He = 0.05 | $SiH_4$ = 50 | | 150 | 12 | 20 |

TABLE 15C (Sample No. 1303)

| | Gases employed | Flow rate (SCCM) | Flow rate ratio | Discharging power (W) | Layer formation rate (Å/sec) | layer thickness (μm) |
|---|---|---|---|---|---|---|
| First layer | $SiH_4$/He = 0.05<br>$B_2H_6$/He = 0.0001<br>NO | $SiH_4$ = 50 | $B_2H_6$/Si<br>$H_4$ = 0.00002<br>NO/$SiH_4$ = 2/10~1/100 | 160 | 14 | 5 |
| Second layer | $SiH_4$He = 0.05<br>NO | $SiH_4$ = 50 | NO/$SiH_4$ = 1/100 | 160 | 14 | 15 |

TABLE 16C (Sample No. 1304)

| | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4$/He = 0.05<br>$B_2H_6$/He = 0.0001<br>NO | $SiH_4$ =50 | $B_2H_6$/$SiH_4$ = 0.00002<br>NO/$SiH_4$ = 3/10~0 | 160 | 14 | 1.0 |
| Second layer | $SiH_4$He = 0.05<br>$B_2H_6$/He = 0.0001 | $SiH_4$ = 50 | $B_2H_6$/$SiH_4$ = 0.00002 | 160 | 12 | 15 |

TABLE 17C (Sample No. 1305)

| | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4$/He = 0.05<br>$PH_3$/He = 0.0001<br>NO | $SiH_4$ = 50 | $PH_3$/$SiH_4$ = 0.00003<br>NO/$SiH_4$ = 3/10~0 | 170 | 15 | 1 |
| Second | $SiH_4$/He = 0.05 | $SiH_4$ = 50 | | 170 | 15 | 20 |

TABLE 17C-continued (Sample No. 1305)

| | Gases employed | Flow rate (SCCM) | Flow rate ratio | Discharging power (W) | Layer formation rate (Å/sec) | Layer thickness (μm) |
|---|---|---|---|---|---|---|
| layer | | | | | | |

TABLE 2D

| | Cylinder No. | | | | | | | |
|---|---|---|---|---|---|---|---|---|
| | 101D | 102D | 103D | 104D | 105D | 106D | 107D | 108D |
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2E

| | Cylinder No. | | | | | | | |
|---|---|---|---|---|---|---|---|---|
| | 101E | 102E | 103E | 104E | 105E | 106E | 107E | 108E |
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3D

| | Sample No. | | | | | | | |
|---|---|---|---|---|---|---|---|---|
| | 111D | 112D | 113D | 114D | 115D | 116D | 117D | 118D |
| | Cylinder No. | | | | | | | |
| | 101D | 102D | 103D | 104D | 105D | 106D | 107D | 108D |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X Practically unusable
Δ Practically satisfactory
○ Practically very good
◎Practically excellent

TABLE 3E

| | Sample No. | | | | | | | |
|---|---|---|---|---|---|---|---|---|
| | 111E | 112E | 113E | 114E | 115E | 116E | 117E | 118E |
| | Cylinder No. | | | | | | | |
| | 101E | 102E | 103E | 104E | 105E | 106E | 107E | 108E |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X Practically unusable
Δ Practically satisfactory
○ Practically very good
◎Practically excellent

TABLE 4D

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 50 | | | |
| | $SiH_4$ | 100 | | | |
| Second layer | $H_2$ | 300 | 300 | 24 | 20 |
| | $SiH_4$ | 300 | | | |

TABLE 5D

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 14 | 3 |
| | $GeH_4$ | 100 | | | |
| | $SiH_4$ | 50 | | | |
| Second layer | $H_2$ | 300 | 300 | 24 | 20 |
| | $SiH_4$ | 300 | | | |

TABLE 6D

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 12 | 5 |
| | $GeH_4$ | 50 | | | |
| | $SiH_4$ | 100 | | | |
| Second layer | $H_2$ | 300 | 300 | 24 | 20 |
| | $SiH_4$ | 300 | | | |

TABLE 7D

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 8 | 7 |
| | $GeH_4$ | 15 | | | |
| | $SiH_4$ | 135 | | | |
| Second layer | $H_2$ | 300 | 300 | 24 | 20 |
| | $SiH_4$ | 300 | | | |

TABLE 4E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4 + SiH_4 = 100$ | | | |
| Second layer | $H_2$ | 300 | 300 | 24 | 20 |
| | $SiH_4$ | 300 | | | |

TABLE 5E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | | $GeH_4 + SiH_4 = 100$ | | | |
| Second layer | $H_2$ | 300 | 300 | 24 | 20 |
| | $SiH_4$ | 300 | | | |

TABLE 2F

| | Cylinder No. | | | | | | | |
|---|---|---|---|---|---|---|---|---|
| | 101F | 102F | 103F | 104F | 105F | 106F | 107F | 108F |
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3F

| | Sample No. | | | | | | | |
|---|---|---|---|---|---|---|---|---|
| | 111F | 112F | 113F | 114F | 115F | 116F | 117F | 118F |
| | Cylinder No. | | | | | | | |
| | 101F | 102F | 103F | 104F | 105F | 106F | 107F | 108F |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X Practically unusable
Δ Practically satisfactory
○ Practically very good
◎Practically excellent

TABLE 4F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 50 | | | |
| | $SiH_4$ | 50 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |

TABLE 5F

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $B_2H_6/H_2$ (= 3000 vol ppm) | 100 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 6F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 75 | | | |
| | $SiH_4$ | 25 | | | |
| | $B_2H_6/H_2$ (= 3000 vol ppm) | 50 | | | |

TABLE 6F-continued

| Layer constitution | | Starting gas | Gas flow rate (SCCM) | Discharging power (W) | Deposition rate (Å/sec) | Layer thickness (μm) |
|---|---|---|---|---|---|---|
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 7F

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ (= 3000 vol ppm) | 150 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 8F

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 25 | | | |
| | | $SiH_4$ | 75 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 9F

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 10F

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 11F

| Layer constitution | Starting gas | Gas flow rate (SCCM) | Discharging power (W) | Deposition rate (Å/sec) | Layer thickness (μm) |
|---|---|---|---|---|---|
| First | $H_2$ | 300 | 100 | 10 | 5 |

TABLE 11F-continued

| Layer constitution | Starting gas | Gas flow rate (SCCM) | Discharging power (W) | Deposition rate (Å/sec) | Layer thickness (μm) |
|---|---|---|---|---|---|
| layer | 5 | 4 | 50 | | |
| | $SiH_4$ | 50 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |

TABLE 12F

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 13F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 2 |
| | $GeH_4$ | 50 | | | |
| | $SiH_4$ | 50 | | | |
| | $B_2H_6/H_2$ (= 3000 vol ppm) | 50 | | | |
| Second layer Layer A | $H_2$ | 300 | 100 | 8 | 3 |
| | $SiH_4$ | 100 | | | |
| | $B_2H_6/H_2$ (= 3000 vol ppm) | 100 | | | |
| Layer B | $H_2$ | 300 | 300 | 24 | 20 |
| | $SiH_4$ | 300 | | | |

TABLE 14F

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 15F

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 16F

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 17F

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 2G

| | Cylinder No. | | | | | | | |
|---|---|---|---|---|---|---|---|---|
| | 101G | 102G | 103G | 104G | 105G | 106G | 107G | 108G |
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3G

| | Sample No. | | | | | | | |
|---|---|---|---|---|---|---|---|---|
| | 111G | 112G | 113G | 114G | 115G | 116G | 117G | 118G |
| | Cylinder No. | | | | | | | |
| | 101G | 102G | 103G | 104G | 105G | 106G | 107G | 108G |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X Practically unusable
Δ Practically satisfactory
○ Practically very good
◎Practically excellent

TABLE 4G

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ = 3000 ppm | 100 | | | |
| | | $GeH_4 + SiH_4$ = 100 | | | |
| Second layer | $H_2$ | 300 | 300 | 24 | 20 |
| | $SiH_4$ | 300 | | | |

TABLE 5G

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 100 → 0 | | | |
| | | $SiH_4$ | 0 → 100 | | | |
| | | $B_2H_6/H_2$ = 3000 ppm | 100 | | | |
| | | | $GeH_4 + SiH_4$ = 100 | | | |
| Second layer | Layer A | $H_2$ | 300 | 100 | 8 | 5 |
| | | $SiH_4$ | 100 | | | |
| | | $B_2H_6/H_2$ = 3000 ppm | 100 | | | |
| | Layer B | $H_2$ | 300 | 300 | 24 | 20 |
| | | $SiH_4$ | 300 | | | |

TABLE 6G

| Layer constitution | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ = 3000 ppm | 100 | | | |
| | $GeH_4 = SiH_4$ = 100 | | | | |
| Second layer | $H_2$ | 300 | 300 | 24 | 20 |
| | $SiH_4$ | 300 | | | |

TABLE 7G

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ = 3000 ppm | 50 | | | |
| | | | $GeH_4 + SiH_4$ = 100 | | | |
| Second layer | Layer A | $H_2$ | 300 | 100 | 8 | 5 |
| | | $SiH_4$ | 100 | | | |
| | | $B_2H_6/H_2$ = 3000 ppm | 100 | | | |
| | Layer B | $H_2$ | 300 | 300 | 24 | 20 |
| | | $SiH_4$ | 300 | | | |

TABLE 8G

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 3 |
| | $GeH_4$ | 50 → 0 | | | | |
| | $SiH_4$ | 50 → 100 | | | | |
| | | | $GeH_4 + SiH_4$ = 100 | | | |
| Second Layer | Layer A | $H_2$ | 300 | 100 | 8 | 5 |
| | | $SiH_4$ | 100 | | | |
| | | $B_2H_6/H_2$ = 3000 ppm | 100 | | | |
| | Layer B | $H_2$ | 300 | 300 | 24 | 20 |
| | | $SiH_4$ | 300 | | | |

TABLE 9G

| Layer constitution | | Starting gas | Gas flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 1.5 |
| | | $GeH_4$ | 100 → 50 | | | |
| | | $SiH_4$ | 0 → 50 | | | |
| | | $B_2H_6/H_2$ = 3000 ppm | 100 | | | |
| | Layer B | $H_2$ | 300 | 100 | 10 | 1.5 |
| | | $GeH_4$ | 50 → 0 | | | |
| | | $SiH_4$ | 50 → 100 | | | |
| Second layer | | $H_2$ | 300 | 300 | 24 | 20 |
| | | $SiH_4$ | 300 | | | |

TABLE 2H

| | Cylinder No. | | | | | | | |
|---|---|---|---|---|---|---|---|---|
| | 101H | 102H | 103H | 104H | 105H | 106H | 107H | 108H |
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3H

| | Sample No. | | | | | | | |
|---|---|---|---|---|---|---|---|---|
| | 111H | 112H | 113H | 114H | 115H | 116H | 117H | 118H |
| | Cylinder No. | | | | | | | |
| | 101H | 102H | 103H | 104H | 105H | 106H | 107H | 108H |
| Difference in layer thickness (μm) | 0.06 | 0.08 | 0.16 | 0.18 | 0.41 | 0.31 | 0.11 | 3.2 |
| Interference | X | X | ○ | ○ | ◎ | ◎ | Δ | X |

TABLE 3H-continued

| Sample No. | | | | | | | |
|---|---|---|---|---|---|---|---|
| 111H | 112H | 113H | 114H | 115H | 116H | 117H | 118H |
| Cylinder No. | | | | | | | |
| 101H | 102H | 103H | 104H | 105H | 106H | 107H | 108H |

fringe

X Practically unusable
Δ Practically satisfactory
O Practically very good
◎ Practically excellent

TABLE 4H

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6/H_2$ =3000 ppm | 300<br>100<br>100<br>$B_2H_6/(GeH_4 + SiH_4)$ = 3/100 → 0 | 100 | 10 | 1 |
| Second layer | $H_2$<br>$SiH_4$ | 300<br>300 | 300 | 24 | 20 |

TABLE 5H

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6/H_2$ = 3000 ppm | 300<br>100<br>50<br>$B_2H_6/(GeH_4 + SiH_4)$ = 5/100 → 0 | 100 | 14 | 3 |
| Second layer | $H_2$<br>$SiH_4$ | 300<br>300 | 300 | 24 | 20 |

TABLE 6H

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6/H_2$ = 3000 ppm | 300<br>50<br>100<br>$B_2H_6/(GeH_4 + SiH_4)$ = 1/100 → 0 | 100 | 12 | 5 |
| Second layer | $H_2$<br>$SiH_4$ | 300<br>300 | 300 | 24 | 20 |

TABLE 7H

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6/H_2$ = 3000 ppm | 300<br>15<br>135<br>$B_2H_6/(GeH_4 + SiH_4)$ = 1/100 → 0 | 100 | 8 | 7 |
| Second layer | $H_2$<br>$SiH_4$ | 300<br>300 | 300 | 24 | 20 |

TABLE 8H

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6/H_2$ = 3000 ppm | 300<br>50<br>50<br>150 → 110 | 100 | 10 | 2 |
| Second Layer A layer | $H_2$<br>$SiH_4$ | 300<br>100 | 100 | 10 | 3 |

TABLE 8H-continued

| Layer constitution | Starting gas | Gas flow rate (SCCM) | Discharging power (W) | Deposition rate (Å/Sec) | Layer thickness (μm) |
|---|---|---|---|---|---|
| | $B_2H_6/H_2$ = 3000 ppm | 110 → 0 | | | |
| Layer B | $H_2$ | 300 | 300 | 24 | 20 |
| | $SiH_4$ | 300 | | | |

TABLE 9H

| Layer constitution | Starting gas | Gas flow rate (SCCM) | Discharging power (W) | Deposition rate (Å/Sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |
| | $B_2H_6$ /$H_2$ = 3000 ppm | 100 → 0 | | | |
| Layer B | $H_2$ | 300 | 100 | 10 | 2 |
| | $GeH_4$ | 50 | | | |
| | $SiH_4$ | 50 | | | |
| Second layer | $H_2$ | 300 | 300 | 24 | 20 |
| | $SiH_4$ | 300 | | | |

TABLE 10H

| Layer constitution | Starting gas | Gas flow rate (SCCM) | Discharging power (W) | Deposition rate (Å/Sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |
| Layer B | $H_2$ | 300 | 100 | 10 | 2 |
| | $GeH_4$ | 50 | | | |
| | $SiH_4$ | 50 | | | |
| | $B_2H_6$ /$H_2$ = 3000 ppm | 50 → 0 | | | |
| Second layer | $H_2$ | 300 | 300 | 24 | 20 |
| | $SiH_4$ | 300 | | | |

TABLE 11H

| Layer constitution | Starting gas | Gas flow rate (SCCM) | Discharging power (W) | Deposition rate (Å/Sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |
| | $B_2H_6$/ $H_2$ = 3000 ppm | 50 → 25 | | | |
| Layer B | $H_2$ | 300 | 100 | 8 | 3 |
| | $GeH_4$ | 50 | | | |
| | $SiH_4$ | 50 | | | |
| | $B_2H_6$/ $H_2$ = 3000 ppm | 25 → 0 | | | |
| Second layer | $H_2$ | 300 | 300 | 24 | 20 |
| | $SiH_4$ | 300 | | | |

TABLE 2I

| Cylinder No. | 101I | 102I | 103I | 104I | 105I | 106I | 107I | 108I |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3I

| | Sample No. | | | | | | | |
|---|---|---|---|---|---|---|---|---|
| | 111I | 112I | 113I | 114I | 115I | 116I | 117I | 118I |
| | Cylinder No. | | | | | | | |
| | 101I | 102I | 103I | 104I | 105I | 106I | 107I | 108I |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

TABLE 3I-continued

X Practically unusable
Δ Practically satisfactory
○ Practically very good
◎ Practically excellent

TABLE 4I

| Layer constitution | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $B_2H_6/H_2$ = 3000 ppm | 150 → 0 | | | |
| | | $GeH_4 + SiH_4 = 100$ | | | |
| Second layer | $H_2$ | 300 | 300 | 24 | 20 |
| | $SiH_4$ | 300 | | | |

TABLE 5I

| Layer constitution | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | $B_2H_6/H_2$ = 3000 ppm | 50 → 0 | | | |
| | | $GeH_4 + SiH_4 = 100$ | | | |
| Second layer | $H_2$ | 300 | 300 | 24 | 20 |
| | $SiH_4$ | 300 | | | |

TABLE 6I

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| Second layer | Layer A | $H_2$ | 300 | 100 | 10 | 3 |
| | | $SiH_4$ | 100 | | | |
| | | $B_2H_6/H_2$ = 3000 ppm | 100 → 0 | | | |
| | Layer B | $H_2$ | 300 | 300 | 24 | 20 |
| | | $SiH_2$ | 300 | | | |

TABLE 7I

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $B_2H_6/H_2$ = 3000 ppm | 100 → ※ | | | |
| Second layer | Layer A | $H_2$ | 300 | 100 | 10 | 3 |
| | | $SiH_4$ | 100 | | | |
| | | $B_2H_6/H_2$ = 3000 ppm | ※ → 0 | | | |
| | Layer | $H_2$ | 300 | 300 | 24 | 20 |

TABLE 7I-continued

| Layer constitution | Starting gas | Gas flow rate (SCCM) | Discharging power (W) | Deposition rate (Å/Sec) | Layer thickness (μm) |
|---|---|---|---|---|---|
| B | $SiH_4$ | 300 | | | |

Note:
The symbol ※ represents continuity of change in the gas flow rate.

TABLE 8I

| Layer constitution | | Starting gas | Gas flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 → 25 | | | |
| | | $SiH_4$ | 50 → 75 | | | |
| | | $B_2H_6/H_2$ = 3000 ppm | 100 → 0 | | | |
| | Layer B | $H_2$ | 300 | 100 | 10 | 2 |
| | | $GeH_4$ | 25 → 0 | | | |
| | | $SiH_4$ | 70 → 100 | | | |
| Second layer | | $H_2$ | 300 | 300 | 24 | 20 |
| | | $SiH_4$ | 300 | | | |

TABLE 1aJ

| | Starting gas | Gas flow rate (SCCM) | Discharging power (W) | Layer thickness (μm) |
|---|---|---|---|---|
| First layer | $H_2$ | 300 | 160 | 5 |
| | $GeH_4$ | 50 | | |
| | $SiH_4$ | 100 | | |
| | NO | | | |
| Second layer | $H_2$ | 300 | 150 | 20 |
| | $SiH_4$ | 300 | | |
| Surface layer | Material for surface layer $ZrO_2$ | | 300 | 0.0975 |

TABLE 2J

| No | 101J | 102J | 103J | 104J | 105J | 106J | 107J | 108J |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3J

| | No. | | | | | | | |
|---|---|---|---|---|---|---|---|---|
| | 111J | 112J | 113J | 114J | 115J | 116J | 117J | 118J |
| | Cylinder No. | | | | | | | |
| | 101J | 102J | 103J | 104J | 105J | 106J | 107J | 108J |
| Difference in layer thickness (μm) | 0.06 | 0.08 | 0.16 | 0.18 | 0.41 | 0.31 | 0.11 | 3.2 |
| Interference fringe | X | X | ○ | ◎ | ◎ | ◎ | Δ | X |

X Practically unusable
Δ Practically satisfactory
○ Practically very good
◎ Practically excellent

TABLE 4J

| Layer | Starting gas | Flow rate (SCCM) | High frequency power (W) | Layer thickness (μm) |
|---|---|---|---|---|
| First | $H_2$ | 300 | 160 | 3 |

TABLE 4J-continued

| Layer | Starting gas | Flow rate (SCCM) | High frequency power (W) | Layer thickness (μm) |
|---|---|---|---|---|
| layer | $SiH_4$ | 100 | | |
| | $GeH_4$ | 50 | | |
| | $NH_3$ | 30 | | |
| Second layer | $H_2$ | 300 | 300 | 20 |
| | $SiH_4$ | 300 | | |
| Surface layer | Material for surface layer $TiO_2$ | | 300 | 0.0863 |

TABLE 5J

| Layer | Starting gas | Flow rate (SCCM) | High frequency power (W) | Layer thickness (μm) |
|---|---|---|---|---|
| First layer | $H_2$ | 300 | 160 | 5 |
| | $SiH_4$ | 100 | | |
| | $GeH_4$ | 50 | | |
| | $NH_3$ | 15 | | |
| Second layer | $H_2$ | 300 | 200 | 20 |
| | $SiH_4$ | 300 | | |
| | $NH_3$ | 15 | | |
| Surface layer | Material for surface layer $CeO_2$ | | 300 | 0.0874 |

TABLE 6J

| Layer | Starting gas | Flow rate (SCCM) | High frequency power (W) | Layer thickness (μm) |
|---|---|---|---|---|
| First layer | $H_2$ | 300 | 170 | 2.8 |
| | $SiH_4$ | 50 | | |
| | $GeH_4$ | 100 | | |
| | $CH_4$ | 15 | | |
| Second layer | $H_2$ | 300 | 200 | 21 |
| | $SiH_4$ | 300 | | |
| | $CH_4$ | 15 | | |
| Surface layer | Material for surface layer ZnS | | 300 | 0.0871 |

TABLE 7J

| Layer | Starting gas | Flow rate (SCCM) | High frequency power (W) | Layer thickness (μm) |
|---|---|---|---|---|
| First layer | $H_2$ | 300 | 170 | 5.1 |
| | $SiH_4$ | 100 | | |
| | $GeH_4$ | 60 | | |
| | $CH_4$ | 16 | | |
| Second layer | $H_2$ | 300 | 230 | 22 |
| | $SiH_4$ | 300 | | |
| Surface layer | Material for surface layer $Al_2O_3$ | | 300 | 0.120 |

TABLE 8J

| Layer | Starting gas | Flow rate (SCCM) | High frequency power (W) | Layer thickness (μm) |
|---|---|---|---|---|
| First layer | $H_2$ | 300 | 160 | 3 |
| | $SiH_4$ | 50 | | |
| | $GeH_4$ | 100 | | |
| | $NH_3$ | 30~0 | | |
| Second layer | $H_2$ | 300 | 300 | 20 |
| | $SiH_4$ | 300 | | |
| Surface layer | Material for surface layer $CeF_3$ | | 300 | 0.123 |

TABLE 9J

| Layer | Starting gas | Flow rate (SCCM) | High frequency power (W) | Layer thickness (μm) |
|---|---|---|---|---|
| First layer | $H_2$ | 300 | 160 | 5 |
| | $SiH_4$ | 100 | | |
| | $GeH_4$ | 50 | | |
| | $NH_3$ | 15~0 | | |
| Second layer | $H_2$ | 300 | 200 | 20 |
| | $SiH_4$ | 300 | | |

TABLE 9J-continued

| Layer | Starting gas | Flow rate (SCCM) | High frequency power (W) | Layer thickness (μm) |
|---|---|---|---|---|
| | $NH_3$ | | | |
| Surface layer | Material for surface layer $MgF_2$ | | 300 | 0.141 |

TABLE 10J

| Layer | Starting gas | Flow rate (SCCM) | High frequency power (W) | Layer thickness (μm) |
|---|---|---|---|---|
| First layer | $H_2$ | 300 | 170 | 2.8 |
| | $SiH_4$ | 100 | | |
| | $GeH_4$ | 50 | | |
| | $CH_4$ | 15~0 | | |
| Second layer | $H_2$ | 300 | 200 | 21 |
| | $SiH_4$ | 300 | | |
| Surface layer | Material for surface layer $SiO_2$ | | 300 | 0.131 |

TABLE 11J

| Layer | Starting gas | Flow rate (SCCM) | High frequency power (W) | Layer thickness (μm) |
|---|---|---|---|---|
| First layer | $H_2$ | 300 | 170 | 5.1 |
| | $SiH_4$ | 100 | | |
| | $GeH_4$ | 60 | | |
| | $CH_4$ | 16~0 | | |
| Second layer | $H_2$ | 300 | 230 | 22 |
| | $SiH_4$ | 300 | | |
| | $CH_4$ | | | |
| Surface layer | Material for surface layer $ZrO_2$ | | 300 | 0.0975 |

TABLE 12J (Sample No. 2201)

| Layer constitution | Gases employed | Flow rate (SCCM) | Flow rate ratio | Discharging power (W) | Layer formation rate (Å/Sec) | Layer thickness (μ) |
|---|---|---|---|---|---|---|
| First layer | $SiH_4/He = 0.05$ | $SiH_4 + GeH_4 = 50$ | $NO/(SiH_4 + GeH_4) = 3/10 \sim 0$ | 150 | 12 | 1 |
| | $GeH_4/He = 0.05$ | | | | | |
| | NO | | | | | |
| Second layer | $SiH_4/He = 0.05$ | $SiH_4 = 50$ | | 150 | 12 | 20 |

TABLE 13J (Sample No. 2202)

| Layer constitution | Gases employed | Flow rate (SCCM) | Flow rate ratio | Discharging power (W) | Layer formation rate (Å/Sec) | Layer thickness (μ) |
|---|---|---|---|---|---|---|
| First layer | $SiH_4/He = 0.05$ | $SiH_4 + GeH_4 = 50$ | $NO/(SiH_4 + GeH_4) = 2/10 \sim 0$ | 150 | 12 | 0.5 |
| | $GeH_4/He = 0.05$ | | | | | |
| | NO | | | | | |
| Second layer | $SiH_4/He = 0.05$ | $SiH_4 = 50$ | | 150 | 12 | 20 |

TABLE 14J (Sample No. 2203)

| Layer constitution | Gases employed | Flow rate (SCCM) | Flow rate ratio | Discharging power (W) | Layer formation rate (Å/Sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 1/10 \sim 1/100$ | 160 | 14 | 5 |
| Second layer | $SiH_4/He = 0.05$ | $SiH_4 = 50$ | | 160 | 14 | 15 |

TABLE 15J (Sample No. 2204)

| Layer constitution | Gases employed | Flow rate (SCCM) | Flow rate ratio | Discharging power (W) | Layer formation rate (Å/Sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 160 | 14 | 1.0 |
| Second layer | $SiH_4/He = 0.05$ | $SiH_4 = 50$ | | 160 | 12 | 15 |

TABLE 16J (Sample No. 2204)

| Layer constitution | Gases employed | Flow rate (SCCM) | Flow rate ratio | Discharging power (W) | Layer formation rate (Å/Sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 160 | 14 | 1.0 |
| Second layer | $SiH_4/He = 0.05$ | $SiH_4 = 50$ | | 160 | 12 | 15 |

TABLE 17J (Sample No. 2206)

| Layer constitution | Gases employed | Flow rate (SCCM) | Flow rate ratio | Discharging power (W) | Layer formation rate (Å/Sec) | Layer thickness (μ) |
|---|---|---|---|---|---|---|
| First layer | $SiH_4/He = 0.05$<br>$GeH_4/He = 0.05$<br>$NH_3$ | $SiH_4 + GeH_4 = 50$ | $NH_3/(SiH_4 + GeH_4) = 1/10 \sim 1/100$ | 160 | 14 | 5 |
| Second layer | $SiH_4/He = 0.05$<br>$NH_3$ | $SiH_4 = 50$ | $NH_3/SiH_4 = 1/100$ | 160 | 14 | 15 |

TABLE 18J (Sample No. 2206)

| Layer constitution | Gases employed | Flow rate (SCCM) | Flow rate ratio | Discharging power (W) | Layer formation rate (Å/Sec) | Layer thickness (μ) |
|---|---|---|---|---|---|---|
| First layer | $SiH_4/He = 0.05$<br>$GeH_4/He = 0.05$<br>$CH_4$ | $SiH_4 + GeH_4 = 50$ | $CH_4/(SiH_4 + GeH_4) = 1/10 \sim 1/100$ | 160 | 14 | 5 |
| Second layer | $SiH_4/He = 0.05$<br>$CH_4$ | $SiH_4 = 50$ | $CH_4/SiH_4 = 1/100$ | 160 | 14 | 15 |

TABLE 1K

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | $100 \rightarrow 0$ | | | |
| | $SiH_4$ | $0 \rightarrow 100$ | | | |
| | | $GeH_4 + SiH_4 = 100$ | | | |
| | NO | 10 | | | |

TABLE 1K-continued

| | Starting gas | Gas flow rate (SCCM) | Discharging power (W) | Deposition rate (Å/Sec) | Layer thickness (μm) |
|---|---|---|---|---|---|
| Second layer | $H_2$<br>$SiH_4$ | 300<br>300 | 300 | 24 | 20 |
| Surface layer | | Material for surface layer $ZrO_2$ | 300 | 1 | 0.0975 |

TABLE 2K

| No | 101K | 102K | 103K | 104K | 105K | 106K | 107K | 108K |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3K

| | No. | | | | | | | |
|---|---|---|---|---|---|---|---|---|
| | 111K | 112K | 113K | 114K | 115K | 116K | 117K | 118K |
| | Cylinder No. | | | | | | | |
| | 101K | 102K | 103K | 104K | 105K | 106K | 107K | 108K |
| Difference in layer thickness (μm) | 0.06 | 0.08 | 0.16 | 0.18 | 0.41 | 0.31 | 0.11 | 3.2 |
| Interference fringe | X | X | ○ | ◎ | ◎ | ◎ | Δ | X |

X Practically unusable
Δ Practically satisfactory
○ Practically very good
◎ Practically excellent

TABLE 4K

| | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br><br>$CH_4$ | 300<br>100 → 0<br>0 → 100<br>$GeH_4 + SiH_4 = 100$<br>10 | 100 | 9 | 3 |
| Second layer | $H_2$<br>$SiH_4$ | 300<br>300 | 300 | 24 | 20 |
| Surface layer | | Material for surface layer $TiO_2$ | 300 | 1 | 0.0863 |

TABLE 5K

| | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br><br>$NH_3$ | 300<br>50 → 0<br>50 → 100<br>$GeH_4 + SiH_4 = 100$<br>10 | 100 | 9 | 3 |
| Second layer | $H_2$<br>$SiH_4$ | 300<br>300 | 300 | 24 | 20 |
| Surface layer | | Material for surface layer $CeO_2$ | 300 | 1 | 0.0874 |

TABLE 6K

| | Starting gas | Gas flow rate (SCCM) | Dis-charging power (W) | Deposition rate (Å/Sec) | Layer thickness (μm) |
|---|---|---|---|---|---|
| First layer | $H_2$<br>$GeH_4$<br>$SiH_4$<br><br>$NH_3$ | 300<br>50 → 0<br>50 → 100<br>$GeH_4 + SiH_4 = 100$<br>6 | 100 | 9 | 3 |
| Second layer | $H_2$<br>$SiH_4$<br>$NH_3$ | 300<br>300<br>6 | 300 | 24 | 20 |
| Surface layer | | Material for surface layer ZnS | 300 | 1 | 0.0871 |

TABLE 7K

| | Starting gas | Gas flow rate (SCCM) | Dis-charging power (W) | Deposition rate (Å/Sec) | Layer thickness (μm) |
|---|---|---|---|---|---|
| First layer | $H_2$<br>$GeH_4$<br>$SiH_4$<br><br>NO | 300<br>100 → 0<br>0 → 100<br>$GeH_4 + SiH_4 = 100$<br>20 → 0 | 100 | 9 | 3 |
| Second layer | $H_2$<br>$SiH_4$ | 300<br>300 | 300 | 24 | 20 |
| Surface layer | | Material for surface layer $ZrO_2$ | 300 | 1 | 0.0975 |

TABLE 8K

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4$ + $SiH_4$ = 100 | | | |
| | $NH_3$ | 20 → 0 | | | |
| Second layer | $H_2$ | 300 | 300 | 24 | 20 |
| | $SiH_4$ | 300 | | | |
| Surface layer | Material for surface layer $ZrO_2$ | | 300 | 1 | 0.0975 |

TABLE 9K

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4$ + $SiH_4$ = 100 | | | |
| | NO | 10 →※ | | | |
| Second layer | $H_2$ | 300 | 300 | 24 | 20 |
| | $SiH_4$ | 300 | | | |
| | NO | ※ → 0 | | | |
| Surface layer | Material for surface layer $ZrO_2$ | | 300 | 1 | 0.0975 |

Note:
The symbol ※ represents continuity of change in the gas flow rate.
The same note applies to Table 9L.

TABLE 10K

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4$ + $SiH_4$ = 100 | | | |
| | $CH_4$ | 10 → 0 | | | |
| Second layer | $H_2$ | 300 | 300 | 24 | 20 |
| | $SiH_4$ | 300 | | | |

TABLE 10K-continued

| | Starting gas | Gas flow rate (SCCM) | Discharging power (W) | Deposition rate (Å/Sec) | Layer thickness (μm) |
|---|---|---|---|---|---|
| Surface layer | Material for surface layer $ZrO_2$ | | 300 | 1 | 0.0975 |

TABLE 1L

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 50 | | | |
| | $SiH_4$ | 50 | | | |
| | $B_2H_6/H_2$ (= 3000 vol ppm) | 100 | | | |
| | NO | 10 | | | |
| Second layer | $H_2$ | 300 | 300 | 24 | 20 |
| | $SiH_4$ | 300 | | | |
| Surface layer | Material for surface layer $ZrO_2$ | | 300 | 1 | 0.0975 |

TABLE 2L

| NO | 101L | 102L | 103L | 104L | 105L | 106L | 107L | 108L |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3L

| | No. | | | | | | | |
|---|---|---|---|---|---|---|---|---|
| | 111L | 112L | 113L | 114L | 115L | 116L | 117L | 118L |
| | Cylinder No. | | | | | | | |
| | 101L | 102L | 103L | 104L | 105L | 106L | 107L | 108L |
| Difference in layer thickness (μm) | 0.06 | 0.08 | 0.16 | 0.18 | 0.41 | 0.31 | 0.11 | 3.2 |
| Interference fringe | X | X | ○ | ◎ | ◎ | ◎ | Δ | X |

X Practically unusable
Δ Practically satisfactory
○ Practically very good
◎ Practically excellent

TABLE 4L

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $B_2H_6/H_2$ (= 3000 vol ppm) | 100 | | | |
| | | $NH_3$ | 11 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |
| Surface layer | | Material for surface layer $ZrO_2$ | | 300 | 1 | 0.0975 |

TABLE 5L

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ | 50 | | | |
| | | (= 3000 vol ppm) | 10 | | | |
| | | $CH_4$ | | | | |
| Second layer | Layer A | $H_2$ | 300 | 100 | 8 | 5 |
| | | $SiH_4$ | 100 | | | |
| | | $B_2H_6/H_2$ | 100 | | | |
| | | (= 3000 vol ppm) | | | | |
| | Layer B | $H_2$ | 300 | 300 | 24 | 20 |
| | | $SiH_4$ | 300 | | | |
| Surface layer | | Material for surface layer $TiO_2$ | | 300 | 1 | 0.0863 |

TABLE 6L

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ | 150 | | | |
| | | (= 3000 vol ppm) | | | | |
| | | NO | 10 | | | |
| Second layer | Layer A | $H_2$ | 300 | 100 | 8 | 5 |
| | | $SiH_4$ | 100 | | | |
| | | $B_2H_6/H_2$ | 100 | | | |
| | | (= 3000 vol ppm) | 10 | | | |
| | | NO | | | | |
| | Layer B | $H_2$ | 300 | 300 | 24 | 20 |
| | | $SiH_4$ | 300 | | | |
| | | NO | 10 | | | |
| Surface layer | | Material for surface layer $TiO_2$ | | 300 | 1 | 0.0863 |

TABLE 7L

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 25 | | | |
| | | $SiH_4$ | 75 | | | |
| | | $NH_3$ | 12 | | | |
| Second layer | Layer A | $H_2$ | 300 | 100 | 8 | 5 |
| | | $SiH_4$ | 100 | | | |
| | | $B_2H_6/H_2$ | 100 | | | |
| | | (= 3000 vol ppm) | 12 | | | |
| | | $NH_3$ | | | | |
| | Layer B | $H_2$ | 300 | 300 | 24 | 20 |
| | | $SiH_4$ | 300 | | | |
| | | $NH_3$ | 12 | | | |
| Surface layer | | Material for surface layer $CeO_2$ | | 300 | 1 | 0.0874 |

TABLE 8L

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ | 100 | | | |
| | | (= 3000 vol ppm) | 8 | | | |
| | | $CH_4$ | | | | |
| | Layer B | $H_2$ | 300 | 100 | 10 | 2 |
| | | $GeH_4$ | 50 | | | |
| | | $SiH_4$ | 50 | | | |
| | | $CH_4$ | 8 | | | |
| Second layer | | $H_2$ | 300 | 300 | 24 | 20 |
| | | $SiH_4$ | 300 | | | |

TABLE 8L-continued

| Layer constitution | Starting gas | Gas flow rate (SCCM) | Discharging power (W) | Deposition rate (Å/sec) | Layer thickness (μm) |
|---|---|---|---|---|---|
| | $CH_4$ | 8 | | | |
| Surface layer | Material for surface layer ZnS | | 300 | 1 | 0.0871 |

TABLE 9L

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | NO | 10~※ | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | NO | ※~0 | | | |
| Second layer | | $H_2$ | 300 | 300 | 24 | 20 |
| | | $SiH_4$ | 300 | | | |
| Surface layer | | Material for surface layer $Al_2O_3$ | | 300 | 1 | 0.120 |

TABLE 10L

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 5 |
| | $GeH_4$ | 50 | | | |
| | $SiH_4$ | 50 | | | |
| | $B_2H_6/H_2$ (= 3000 vol ppm) | 100 | | | |

TABLE 10L-continued

| | Starting gas | Gas flow rate (SCCM) | Discharging power (W) | Deposition rate (Å/sec) | Layer thickness (μm) |
|---|---|---|---|---|---|
| | $NH_3$ | 10~0 | | | |
| Second layer | $H_2$ | 300 | 300 | 24 | 20 |
| | $SiH_4$ | 300 | | | |
| Surface layer | Material for surface layer $CeF_3$ | | 300 | 1 | 0.0123 |

TABLE 11L

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | $CH_4$ | 10~0 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |
| Surface layer | | Material for surface layer $MgF_2$ | | 300 | 1 | 0.141 |

TABLE 12L

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 | | | |
| | | NO | 10~ ※ | | | |
| Second layer | Layer A | $H_2$ | 300 | 300 | 8 | 3 |
| | | $SiH_4$ | 100 | | | |
| | | $B_2H_6/H_2$ (= 3000 vol ppm) | 100 | | | |
| | | NO | ※ ~ ※※ | | | |

TABLE 12L-continued

| Layer constitution | | Starting gas | Gas flow rate (SCCM) | Discharging power (W) | Deposition rate (Å/sec) | Layer thickness (μm) |
|---|---|---|---|---|---|---|
| | Layer B | $H_2$ | 300 | 300 | 24 | 20 |
| | | $SiH_4$ | 300 | | | |
| | | NO | ※※ ~0 | | | |
| Surface layer | | Material for surface layer $SiO_2$ | | 300 | 1 | 0.131 |

Note:
The symbols ※ and ※※ represent continuity of change in the gas flow rate respectively. The same note applies to the subsequent other tables.

TABLE 13L

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 | | | |
| | | $NH_3$ | 10~ ※ | | | |
| Second layer | Layer A | $H_2$ | 300 | 100 | | 3 |
| | | $SiH_4$ | 100 | | | |
| | | $B_2H_6/H_2$ (= 3000 vol ppm) | 100 | | | |
| | | $NH_3$ | ※ ~ ※※ | | | |
| | Layer B | $H_2$ | 300 | 300 | 24 | 20 |
| | | $SiH_4$ | 300 | | | |
| | | $NH_3$ | ※※~0 | | | |
| Surface layer | | Material for surface layer $ZrO_2:TiO_2$ = 6:1 | | 300 | 1 | 0.0933 |

TABLE 14L

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_4$ | 300 | 100 | 10 | 2 |
| | | $GeH_4$ | 50 | | | |
| | | $SiH_4$ | 50 | | | |
| | | $CH_4$ | 10~※ | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| | | $CH_4$ | ※~※※ | | | |
| Second layer | | $H_2$ | 300 | 300 | 24 | 20 |
| | | $SiH_4$ | 300 | | | |
| | | $CH_4$ | ※※~0 | | | |
| Surface layer | | Material for surface layer $Al_2O_3:ZrO_2$ = 1:1 | | 300 | 1 | 0.116 |

TABLE 15L

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | NO | 8 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |
| Surface layer | | Material for surface layer $MgF_2$ | | 300 | 1 | 0.424 |

TABLE 16L

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $NH_3$ | 11 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |
| Surface layer | | Material for surface layer $MgF_2$ | | 300 | 1 | 0.424 |

TABLE 1M

| NO | 101M | 102M | 103M | 104M | 105M | 106M | 107M | 108M |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2M

| | No. | | | | | | | |
|---|---|---|---|---|---|---|---|---|
| | 111M | 112M | 113M | 114M | 115M | 116M | 117M | 118M |
| | Cylinder No. | | | | | | | |
| | 101M | 102M | 103M | 104M | 105M | 106M | 107M | 108M |
| Difference in layer thickness (μm) | 0.06 | 0.08 | 0.16 | 0.18 | 0.41 | 0.31 | 0.11 | 3.2 |
| Interference fringe | X | X | ⊙ | ⊙ | ⊙ | ○ | Δ | X |

X Practically unusable
Δ Practically satisfactory
⊙ Practically very good
○ Practically excellent

TABLE 3M

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $B_2H_6/H_2$ (= 3000 vol ppm) | $GeH_4 + SiH_4 = 100$ | | | |
| | NO | 12 | | | |
| Second layer | $H_2$ | 300 | 300 | 24 | 20 |
| | $SiH_4$ | 300 | | | |
| Surface layer | Material for surface layer $ZrO_2$ | | 300 | 1 | 0.0975 |

TABLE 4M

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50→0 | | | |
| | | $SiH_4$ | 50→100 | | | |
| | | $B_2H_6/H_2$ (= 3000 vol ppm) | 100 | | | |
| | | | $GeH_4 + SiH_4 = 100$ | | | |
| | | $NH_3$ | 8 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | $NH_3$ | 8 | | | |
| | Layer B | $H_2$ | 300 | 300 | 24 | 20 |
| | | $SiH_4$ | 300 | | | |
| | | $NH_3$ | 8 | | | |
| Surface layer | | Material for surface layer | | 300 | 1 | 0.0863 |

TABLE 4M-continued

| Layer constitution | Starting gas | Gas flow rate (SCCM) | Discharging power (W) | Deposition rate (Å/sec) | Layer thickness (μm) |
|---|---|---|---|---|---|
| | | $TiO_2$ | | | |

TABLE 5M

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 100 → 0 | | | |
| | $B_2H_6/H_2$ | 100 | | | |
| | (= 3000 vol ppm) | GeH + SiH = 100 | | | |
| | $CH_4$ | 10 → 0 | | | |
| Second layer | $H_2$ | 300 | 300 | 24 | 20 |
| | $SiH_4$ | 300 | | | |
| Surface layer | Material for surface layer $CeO_2$ | | 300 | 1 | 0.0874 |

TABLE 6M

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50→0 | | | |
| | | $SiH_4$ | 50→100 | | | |
| | | $B_2H_6/H_2$ | 50 | | | |
| | | (= 3000 vol ppm) | $GeH_4$ + $SiH_4$ = 100 | | | |
| | | NO | 10 — * | | | |
| Second layer | Layer A | $H_2$ | 300 | 100 | 8 | 5 |
| | | $SiH_4$ | 100 | | | |
| | | $B_2H_6/H_2$ | 100 | | | |
| | | (= 3000 vol ppm) | | | | |
| | | NO | *→** | | | |
| | Layer B | $H_2$ | 300 | 300 | 24 | 20 |
| | | $SiH_4$ | 300 | | | |
| | | NO | **→0 | | | |
| Surface layer | | Material for surface layer ZnS | | 300 | 1 | 0.0871 |

TABLE 7M

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50→0 | | | |
| | | $SiH_4$ | 50→100 | | | |
| | | | $GeH_4$ + $SiH_4$= 100 | | | |
| | | $NH_3$ | 10→* | | | |
| Second layer | Layer A | $H_2$ | 300 | 100 | 8 | 5 |
| | | $SiH_4$ | 100 | | | |
| | | $B_2H_6/H_2$ | 100 | | | |
| | | (= 3000 vol ppm) | | | | |
| | | $NH_3$ | *→** | | | |
| | Layer B | $H_2$ | 300 | 300 | 24 | 20 |
| | | $SiH_4$ | 300 | | | |
| | | $NH_3$ | **→0 | | | |
| Surface layer | | Material for surface layer ZnS | | 300 | 1 | 0.0871 |

TABLE 8M

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 1.5 |
| | | $GeH_4$ | 100→0 | | | |
| | | $SiH_4$ | 0→100 | | | |
| | | $B_2H_6/H_2$ | 100 | | | |
| | | (3000 vol ppm) | | | | |

TABLE 8M-continued

| Layer constitution | Starting gas | Gas flow rate (SCCM) | Discharging power (W) | Deposition rate (Å/sec) | Layer thickness (μm) |
|---|---|---|---|---|---|
| | $CH_4$ | 10→* | | | |
| Layer B | $H_2$ | 300 | 100 | 10 | 1.5 |
| | $GeH_4$ | 50→0 | | | |
| | $SiH_4$ | 50→100 | | | |
| | $CH_4$ | *→** | | | |
| Second layer | $H_2$ | 300 | 300 | 24 | 20 |
| | $SiH_4$ | 300 | | | |
| | $CH_4$ | **→0 | | | |
| Surface layer | Material for surface layer ZnS | | 300 | 1 | 0.0871 |

TABLE 1N

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 100 | | | |
| | $SiH_4$ | 100 | | | |
| | $B_2H_6/H_2$ (= 3000 vol ppm) | $B_2H_6/(GeH_4 + SiH_4)$ = 3/100 → 0 | | | |
| | NO | 12 | | | |
| Second layer | $H_2$ | 300 | 300 | 24 | 20 |
| | $SiH_4$ | 300 | | | |
| Surface layer | Material for surface layer $ZrO_2$ | | 300 | 1 | 0.0975 |

TABLE 2N

| NO | 101N | 102N | 103N | 104N | 105N | 106N | 107N | 108N |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3N

| | No. | | | | | | | |
|---|---|---|---|---|---|---|---|---|
| | 111N | 112N | 113N | 114N | 115N | 116N | 117N | 118N |
| | Cylinder No. | | | | | | | |
| | 101N | 102N | 103N | 104N | 105N | 106N | 107N | 108N |
| Difference | 0.06 | 0.08 | 0.16 | 0.18 | 0.41 | 0.31 | 0.11 | 3.2 |

TABLE 3N-continued

| | No. | | | | | | | |
|---|---|---|---|---|---|---|---|---|
| | 111N | 112N | 113N | 114N | 115N | 116N | 117N | 118N |
| | Cylinder No. | | | | | | | |
| | 101N | 102N | 103N | 104N | 105N | 106N | 107N | 108N |
| in layer thickness (μm) | | | | | | | | |
| Interference fringe | X | X | ∘ | ⊙ | ⊙ | ⊙ | Δ | X |

X Practically unusable
Δ Practically satisfactory
∘ Practically very good
⊙ Practically excellent

TABLE 4N

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 100 | | | |
| | $SiH_4$ | 50 | | | |
| | $B_2H_6/H_2$ (= 3000 vol ppm) | $B_2H_6/(GeH_4 + SiH_4)$ = 5/100 → 0 | | | |
| | $NH_3$ | 10 | | | |
| Second layer | $H_2$ | 300 | 300 | 24 | 20 |
| | $SiH_4$ | 300 | | | |
| | $NH_3$ | 10 | | | |
| Surface layer | Material for surface layer $ZrO_2$ | | 300 | 1 | 0.0975 |

TABLE 5N

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 12 | 5 |
| | $GeH_4$ | 50 | | | |
| | $SiH_4$ | 100 | | | |
| | $B_2H_6/H_2$ (= 3000 vol ppm) | $B_2H_6/(GeH_4 + SiH_4)$ = 1/100 → 0 | | | |
| | $CH_4$ | 15 | | | |
| Second | $H_2$ | 300 | 300 | 24 | 20 |

TABLE 5N-continued

| | Starting gas | Gas flow rate (SCCM) | Discharging power (W) | Deposition rate (Å/sec) | Layer thickness (μm) |
|---|---|---|---|---|---|
| layer | $SiH_4$ | 300 | | | |
| Surface layer | Material for surface layer $TiO_2$ | | 300 | 1 | 0.0863 |

TABLE 6N

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 8 | 7 |
| | $GeH_4$ | 15 | | | |
| | $SiH_4$ | 135 | | | |
| | $B_2H_6/H_2$ (= 3000 vol ppm) | $B_2H_6/(GeH_4 + SiH_4)$ = 1/100 → 0 | | | |
| | NO | 15 | | | |
| Second layer | $H_2$ | 300 | 300 | 24 | 20 |
| | $SiH_4$ | 300 | | | |
| | NO | 15 | | | |
| Surface layer | Material for surface layer $TiO_2$ | | 300 | 1 | 0.0863 |

TABLE 7N

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150→110 | | | |
| | | $NH_3$ | 10→0 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 110→0 | | | |
| | Layer B | $H_2$ | 300 | 300 | 24 | 20 |
| | | $SiH_4$ | 300 | | | |
| Surface layer | | Material for surface layer $CeO_2$ | | 300 | 1 | 0.0874 |

TABLE 8N

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100→0 | | | |
| | | $CH_4$ | 10→0 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |
| Surface layer | | Material for surface layer ZnS | | 300 | 1 | 0.0871 |

TABLE 9N

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $SiH_4$ | 50 | | | |
| | | $GeH_4$ | 50 | | | |
| | | NO | 10→* | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ | 50→0 | | | |

TABLE 9N-continued

| Layer constitution | Starting gas | Gas flow rate (SCCM) | Discharging power (W) | Deposition rate (Å/sec) | Layer thickness (μm) |
|---|---|---|---|---|---|
| | (= 3000 vol ppm) NO | *→** | | | |
| Second layer | $H_2$ | 300 | 300 | 24 | 20 |
| | $SiH_4$ | 300 | | | |
| | NO | **→0 | | | |
| Surface layer | Material for surface layer $Al_2O_3$ | | 300 | 1 | 0.120 |

TABLE 10N

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $SiH_4$ | 50 | | | |
| | | $GeH_4$ | 50 | | | |
| | | $B_2H_6/H_2$ (= 3000 vol ppm) | 50→*** | | | |
| | | $NH_3$ | 10→* | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | ***→0 | | | |
| | | $NH_3$ | *→** | | | |
| Second layer | | $H_2$ | 300 | 300 | 24 | 20 |
| | | $SiH_4$ | 300 | | | |
| | | $NH_3$ | **→0 | | | |
| Surface layer | | Material for surface layer $CeF_3$ | | 300 | 1 | 0.123 |

Note:
The symbol *** represents continuity of change in the gas flow rate.
The same note applies to the following tables.

TABLE 1P

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $B_2H_6/H_2$ (= 3000 vol ppm) | $GeH_4 + SiH_4 = 100$ 150 → 0 | | | |
| | NO | 12 | | | |
| Second layer | $H_2$ | 300 | 300 | 24 | 20 |
| | $SiH_4$ | 300 | | | |
| Surface layer | Material for surface layer $ZrO_2$ | | 300 | 1 | 0.0975 |

TABLE 2P

| NO | 101P | 102P | 103P | 104P | 105P | 106P | 107P | 108P |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3P

| | No. | | | | | | | |
|---|---|---|---|---|---|---|---|---|
| | 111P | 112P | 113P | 114P | 115P | 116P | 117P | 118P |
| | Cylinder No. | | | | | | | |
| | 101P | 102P | 103P | 104P | 105P | 106P | 107P | 108P |
| Difference | 0.06 | 0.08 | 0.16 | 0.18 | 0.41 | 0.31 | 0.11 | 3.2 |

TABLE 3P-continued

| | No. | | | | | | | |
|---|---|---|---|---|---|---|---|---|
| | 111P | 112P | 113P | 114P | 115P | 116P | 117P | 118P |
| | Cylinder No. | | | | | | | |
| | 101P | 102P | 103P | 104P | 105P | 106P | 107P | 108P |
| in layer thickness (μm) | | | | | | | | |
| Interference fringe | X | X | ∘ | ◎ | ◎ | ◎ | Δ | X |

X Practically unusable
Δ Practically satisfactory
∘ Practically very good
◎ Practically excellent

TABLE 1P

| | Starting gas | Gas flow rate (SCCM) | Discharging power (W) | Deposition rate (Å/sec) | Layer thickness (μm) |
|---|---|---|---|---|---|
| First | $H_2$ | 300 | 100 | 9 | 3 |

TABLE 1P-continued

| | Starting gas | Gas flow rate (SCCM) | Discharging power (W) | Deposition rate (Å/sec) | Layer thickness (μm) |
|---|---|---|---|---|---|
| layer | $GeH_4$ | 50 → 0 | | | |
| | $SiH_4$ | 50 → 100 | | | |
| | $B_2H_6/H_2$ (= 3000 vol ppm) | $GeH_4 + SiH_4 = 100$ 50 → 0 | | | |
| | $NH_3$ | 12 | | | |
| Second layer | $H_2$ | 300 | 300 | 24 | 20 |
| | $SiH_4$ | 300 | | | |
| | $NH_3$ | 12 | | | |
| Surface layer | Material for surface layer $TiO_2$ | | 300 | 1 | 0.0863 |

TABLE 5P

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50→0 | | | |
| | | $SiH_4$ | 50→100 | | | |
| | | $CH_4$ | 15 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 100→0 | | | |
| | Layer B | $H_2$ | 300 | 300 | 24 | 20 |
| | | $SiH_4$ | 300 | | | |
| Surface layer | | Material for surface layer $CeO_2$ | | 300 | 1 | 0.0874 |

TABLE 6P

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50→0 | | | |
| | | $SiH_4$ | 50→100 | | | |
| | | $B_2H_6/H_2$ (= 3000 vol ppm) | 100 - * | | | |
| | | NO | 10 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | *→0 | | | |
| | | NO | 10 | | | |
| | Layer B | $H_2$ | 300 | 300 | 24 | 20 |
| | | $SiH_4$ | 300 | | | |
| | | NO | 10 | | | |
| Surface layer | | Material for surface layer ZnS | | 300 | 1 | 0.0871 |

TABLE 7P

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50→25 | | | |
| | | $SiH_4$ | 50→75 | | | |
| | | $B_2H_6/H_2$ (= 3000 vol ppm) | 100→0 | | | |
| | | $NH_3$ | 10 | | | |
| | Layer B | $H_2$ | 300 | 100 | 10 | 2 |
| | | $GeH_4$ | 25→0 | | | |
| | | $SiH_4$ | 75 →100 | | | |
| | | $NH_3$ | 10 | | | |
| Second layer | | $H_2$ | 300 | 300 | 24 | 20 |
| | | $SiH_4$ | 300 | | | |
| Surface layer | | Material for surface layer $Al_2O_3$ | | 300 | 1 | 0.120 |

TABLE 8P

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50→0 | | | |
| | | $SiH_4$ | 50→100 | | | |
| | | $B_2H_6/H_2$ (= 3000 vol ppm) | 150→110 | | | |
| | | $NH_3$ | 10→0 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 110→0 | | | |
| | Layer B | $H_2$ | 300 | 300 | 24 | 20 |
| | | $SiH_4$ | 300 | | | |
| Surface layer | | Material for surface layer $CeF_3$ | | 300 | 1 | 0.123 |

TABLE 9P

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50→* | | | |
| | | $SiH_4$ | 50→** | | | |
| | | $B_2H_6/H_2$ (= 3000 vol ppm) | 100→0 | | | |
| | | $CH_4$ | 10→0 | | | |
| | Layer B | $H_2$ | 300 | 100 | 10 | 2 |
| | | $GeH_4$ | *→0 | | | |
| | | $SiH_4$ | **→100 | | | |
| Second layer | | $H_2$ | 300 | 300 | 24 | 20 |
| | | $SiH_4$ | 300 | | | |
| Surface layer | | Material for surface layer $MgF_2$ | | 300 | 1 | 0.141 |

TABLE 10P

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | NO | 10→* | | | |
| | Layer B | $H_2$ | 300 | 100 | 10 | 2 |
| | | $GeH_4$ | 50→0 | | | |
| | | $SiH_4$ | 50→100 | | | |
| | | $B_2H_6/H_2$ (= 3000 vol ppm) | 100→0 | | | |
| | | NO | *→** | | | |
| Second layer | | $H_2$ | 300 | 300 | 24 | 20 |
| | | $SiH_4$ | 300 | | | |
| | | NO | **→0 | | | |
| Surface layer | | Material for surface layer $SiO_2$ | | 300 | 1 | 0.131 |

TABLE 11P

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (3000 vol ppm) | 100→*** | | | |
| | | $NH_3$ | 10→* | | | |
| Second layer | Layer A | $H_2$ | 300 | 100 | 8 | 3 |
| | | $GeH_4$ | 50→0 | | | |
| | | $SiH_4$ | 50→100 | | | |
| | | $B_2H_6/H_2$ (= 3000 vol ppm) | ***→0 | | | |
| | | $NH_3$ | *→** | | | |
| | Layer B | $H_2$ | 300 | 300 | 24 | 20 |
| | | $SiH_4$ | 300 | | | |

TABLE 11P-continued

| Layer constitution | Starting gas | Gas flow rate (SCCM) | Discharging power (W) | Deposition rate (Å/sec) | Layer thickness (μm) |
|---|---|---|---|---|---|
| | $NH_3$ | **→0 | | | |
| Surface layer | Material for surface layer $ZrO_2/TiO_2$ = 6:1 | | 300 | 1 | 0.0933 |

What is claimed is:

1. A light-receiving member comprising a substrate and a light-receiving layer of a multi-layer structure having at least one photosensitive layer and a surface layer having reflection preventive function provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

2. An electrophotographic system comprising a light-receiving member as defined below:

a light-receiving member comprising a substrate and a light-receiving layer of a multi-layer structure having at least one photosensitive layer and a surface layer having reflection preventive function provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

3. The invention according to claim 1 or 2, wherein the arrangement is made regularly.

4. The invention according to claim 1 or 2, wherein the arrangement is made in cycles.

5. The invention according to claim 1 or 2, wherein the short range is 0.3 to 500 μm.

6. The invention according to claim 1 or 2, wherein the non-parallel interfaces are formed on the basis of the smooth unevenness arranged regularly provided on the surface of the substrate.

7. The invention according to claim 6, wherein the unevenness is formed by sinusoidal linear projections.

8. The invention according to claim 1 or 2, wherein the substrate is cylindrical.

9. The invention according to claim 8, wherein the sinusoidal linear projection has a spiral structure whthin the surface of the substrae.

10. The invention according to claim 9, wherein the spiral structure is a multiple spiral structure.

11. The invention according to claim 7, wherein the sinusoidal linear projection is divided in its edge line direciton.

12. The invention according to claim 8, wherein the edge line direction of the sinusoidal linear projection is along the center axis of the cylindrical substrate.

13. The invention according to claim 6, wherein the smooth unevenness has slanted planes.

14. The invention according to claim 13, wherein the slanted planes are mirror finished.

15. The invention according to claim 6, wherein on the free surface of the light-receiving layer is formed a smooth unevenness arranged with the same pitch as the smooth unevenness provided on the substrate surface 16. The invention according to claim 1 or 2, wherein the photosensitive layer comprises an amorphous material containing silicon atoms.

17. The invention according to claim 16, wherein hydrogen atoms are contained in the photosensitive layer.

18. The invention according to claim 1 or 2, wherein the surface layer is constituted of an inorganic fluoride.

19. The invention according to claim 1 or 2, wherein the surface layer is constituted of an inorganic oxide.

20. The invention according to claim 1 or 2, wherein the surface layer is constituted of an inorganic nitride.

21. The invention according to claim 1 or 2, wherein the surface layer is constituted of an organic compound.

22. The invention according to claim 1 or 2, wherein the light-receiving layer has a charge injection preventive layer between the substrate and the layer having photosensitivity.

23. The invention according to claim 22, wherein the charge injection preventive layer contains at least one of hydrogen atoms and halogen atoms and also a substance (C) for controlling conductivity.

24. The invention according to claim 22, wherein the substance (C) for controlling conductivity is a p-type impurity.

25. The invention according to claim 23, wherein the substance (C) for controlling conductivity is an n-type impurity.

26. The invention according to claim 23, wherein the content of the substance (C) for controlling conductivity contained in the charge injection preventive layer is 0.001 to $5\times10^4$ atomic ppm.

27. The invention according to claim 23, wherein the charge injection preventive layer has a layer thickness of 30 Å to 10 μm.

28. The invention according to claim 1 or 2, wherein a substance (C) for controlling conductivity is contained in the layer having photosensitivity.

29. The invention according to claim 28, wherein the substance (C) for controlling conductivity contained in the layer having photosensitivity is 0.001 to 1000 atomic ppm.

30. The invention according to claim 1 or 2, wherein the layer having photosensitivity has a layer thickness of 1 to 100 μm.

31. The invention according to claim 1 or 2, wherein at least one of hydrogen atoms and halogen atoms are contained in the layer having photosensitivity.

32. The invention according to claim 1 or 2, wherein 1 to 40 atomic % of hydrogen atoms are contained in the layer having photosensitivity.

33. The invention according to claim 1 or 2, wherein 1 to 40 atomic % of halogen atoms are contained in the layer having photosensitivity.

34. The invention according to claim 1 or 2, wherein 1 to 40 atomic % as total of hydrogen atoms and halogen atoms are contained in the layer having photosensitivity.

35. A light-receiving member comprising a substrate and a light-receiving layer of a multi-layer structure having a first layer comprising an amorphous material containing silicon atoms and germanium atoms, a second layer comprising an amorphous material containing silicon atoms and exhibiting photoconductivity and a surface layer having reflection preventive function provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

36. A light-receiving member according to claim 35, wherein the light-receiving layer has a layer thickness of 1 to 100 μm.

37. A light-receiving member according to claim 35, wherein the layer thickness $T_B$ of the first layer and the layer thickness T of the second layer satisfy the relationship of $TB/T \leqq 1$.

38. An electrophotographic system comprising a light-receiving member as defined below:

light-receiving member comprising a substrate and a light-receiving layer of a multi-layer structure having a first layer comprising an amorphous material containing silicon atoms and germanium atoms, a second layer comprising an amorphous mateal containing silicon atoms and exhibiting photoconductivity and a surface layer having reflection preventive funciton provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

39. The invention according to claim 35 or 38, wherein the arrangement is made regularly.

40. The invention according to claim 35 or 38, wherein the arrangement is made in cycles.

41. The invention according to claim 35 or 38, wherein the short range is 0.3 to 500 μm.

42. The invention according to claim 35 or 38, wherein the non-parallel interfaces are formed on the basis of the smooth unevenness arranged regularly provided on the surface of the substrate.

43. The invention according to claim 42, wherein the unevenness is formed by sinusoidal linear projections.

44. The invention according to claim 35 or 38, wherein the substrate is cylindrical.

45. The invention according to claim 44, wherein the sinusoidal linear projection has a spiral structure within the surface of the substrate.

46. The invention according to claim 45, wherein the spiral structure is a multiple spiral structure.

47. The invention according to claim 43, wherein the sinusoidal linear projection is divided in its edge line direction.

48. The invention according to claim 44, wherein the edge line direction of the sinusoidal linear projection is along the center axis of the cylindrical substrate.

49. The invention according to claim 42, wherein the smooth unevenness has slanted planes.

50. The invention according to claim 45, wherein the slanted planes are mirror finished.

51. The invention according to claim 42, wherein on the free surface of the light-receiving layer is formed a smooth unevenness arranged with the same pitch as the smooth unevenness provided on the substrate surface.

52. The invention according to claim 35 or 38, wherein the distribution state of germanium atoms in the first layer is nonuniform in the layer thickness direction.

53. The invention according to claim 52, the nonunirom distribution state of germanium atoms is more enriched toward the substrate side.

54. The invention according to claim 35 or 38, wherein a substance for controlling conductivity is contained in the first layer.

55. The invention according to claim 35 or 38, wherein the substance for controlling conductivity is an atom belonging to the group III or the group V of the periodic table.

56. The invention according to claim 35 or 38, wherein a substance for controlling conductivity is contained in the second layer.

57. The invention according to claim 56, wherein the substance for controlling conductivity is an atom belonging to the group III or the group V of the periodic table.

58. The invention according to claim 35 or 38, wherein the light-receiving layer has a layer region (PN) containing a substance for controlling conductivity.

59. The invention according to claim 58, wherein the distribution state of the substance for controlling conductivity in the layer region (PN) is nonuniform in the layer thickness direction.

60. The invention according to claim 58, wherein the distribution state of the substance for controlling conductivity in the layer region (PN) is uniform in the layer thickness direction.

61. The invention according to claim 58, wherein the substance for controlling conductivity is an atom belonging to the group III or the group V of the periodic table.

62. The invention according to claim 58, wherein the layer region (PN) is provided in the first layer.

63. The invention according to claim 58, wherein the layer region (PN) is provided in the second layer.

64. The invention according to claim 58, wherein the layer region (PN) is provided at the end portion on the substrate side of the light-receiving layer.

65. The invention according to claim 58, wherein the layer region (PN) is provided over both the first layer and the second layer.

66. The invention according to claim 58, wherein the layer region (PN) occupies a part of the layer region in the light-receiving layer.

67. The invention according to claim 66, wherein the content of the substance for controlling conductivity in the layer region (PN) is 0.01 to $5 \times 10^4$ atomic ppm.

68. The invention according to claim 35 or 38, wherein at least one of hydrogen atoms and halogen atoms are contained in the first layer.

69. The invention according to claim 35 or 38, wherein 0.01 to 40 atomic % of hydrogen atoms are contained in the first layer.

70. The invention according to claim 35 or 38, wherein 0.01 to 40 atomic % of halogen atoms are contained in the first layer.

71. The invention according to claim claim 35 or 38, wherein 0.01 to 40 atomic % as a total of hydrogen atoms and halogen atoms are contained in the first layer.

72. The invention according to claim 35 or 38, wherein 1 to 40 atomic % of hydrogen atoms are contained in the second layer.

73. The invention according to claim 35 or 38, wherein 1 to 40 atomic % of halogen atoms are contained in the second layer.

74. The invention according to claim 35 or 38, wherein 1 to 40 atomic % as a total of hydrogen atoms and halogen atoms are contained in the second layer.

75. The invention according to claim 35 or 38, wherein at least one of hydrogen atoms and halogen atoms are contained in the second layer.

76. The invention according to claim 35 or 38, wherein the light-receiving layer contains at least one kind of atoms selected from oxygen atoms, carbon atoms and nitrogen atoms.

77. The invention according to claim 35 or 38, wherein the light-receiving layer has a layer region (OCN) containing at least one kind of atoms selected from oxygen atoms, carbon atoms and nitrogen atoms.

78. The invention according to claim 77, wherein the layer region (OCN) is provided at the end portion on the substrate side of the light-receiving layer.

79. The invention according to claim 78, wherein the layer region (OCN) contains 0.001 to 50 atomic % of oxygen atoms.

80. The invention according to claim 78, wherein the layer region (OCN) contains 0.001 to 50 atomic % of carbon atoms.

81. The invention according to claim 78, wherein the layer region (OCN) contains 0.001 to 50 atomic % of nitrogen atoms.

82. The invention according to claim 78, wherein oxygen atoms are contained in the layer region (OCN) in nonuniform distribution state in the layer thickness direction.

83. The invention according to claim 78, wherein oxygen atoms are contained in the layer region (OCN) in uniform distribution state in the layer thickness direction.

84. The invention according to claim 78, wherein carbon atoms are contained in the layer region (OCN) in nonuniform distribution state in the layer thickness direction.

85. The invention according to claim 78, wherein carbon atoms are contained in the layer region (OCN) in uniform distribution state in the layer thickness direction.

86. The invention according to claim 78, wherein nitrogen atoms are contained in the layer region (OCN) in nonuniform distribution state in the layer thickness direction.

87. The invention according to claim 78, wherein nitrogen atoms are contained in the layer region (OCN) in uniform distribution state in the layer thickness direction.

88. The invention according to claim 35 or 38, wherein the first layer has a layer thickness of 30 Å to 50 μm.

89. The invention according to claim 35 or 38, wherein the second layer has a layer thickness of 0.5 to 90 μm.

90. The invention according to claim 35 or 38, wherein the surface layer is constituted of an inorganic fluoride.

91. The invention accoriding to claim 35 or 38, wherein the surface layer is constituted of an inorganic oxide.

92. The invention according to claim 35 or 38, wherein the surface layer is constituted of an inorganic nitride.

93. The invention according to claim 35 or 38, wherein the surface layer is constituted of an organic compound.

94. An electrophotographic image forming process comprising:

(a) applying a charging treatment to the light receiving member of claim 1 or claim 67;

(b) irradiating the light receiving member with a laser beam carrying information to form an electrostatic latent image; and (c) developing said electrostatic latent image.

* * * * *

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below: On the Title Page

AT [56] IN THE REFERENCES

"Minnura et al." should read --Mimura et al.--.

SHEET 35

Figure 79, "GAS FROW RATE RATIO" should read --GAS FLOW RATE RATIO--.

COLUMN 1

Line 9, "sugject" should read --subject--.
Line 12, "739,867," should read --739,867;--.
Line 12, "726,768," should read --726,768;--.
Line 66, "light" should read --light---.

COLUMN 2

Line 3, "light receiving" should read --light-receiving--.
Line 14, "light receiving" should read --light-receiving--.
Line 17, "an" should read --a--.
Line 28, "iamge." should read --image.--.
Line 42, "average" should read --average layer--.
Line 45, "uniform" should read --ununiform--.
Line 53, "light receiving" should read --light-receiving--.

COLUMN 3

Line 13, "sized" should read --sizes--.
Line 23, "sufficinent" should read --sufficient--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 4

Line 38, "interferance" should read --interference--.
Line 68, "light receiving" should read --light-receiving--.

COLUMN 5

Line 21, "lihgt-" should read --light---.

COLUMN 6

Line 15, "accompnaying" should read --accompanying--.
Line 17, "FIG." should read --FIGS.--.
Line 17, "is a schematic illustration" should read --are schematic illustrations--.
Line 26, "layer 606" should read --layer 602--.
Line 36, "lgiht" should read --light--.
Line 57, "exsit" should read --exist--.

COLUMN 7

Line 9, "l<L," should read --l<l,--.
Line 62, "spital" should read --spiral--.

COLUMN 8

Line 18, "earlily." should read --easily--.

UNITED STATES PATENT AND TRADEMARK OFFICE

CERTIFICATE OF CORRECTION

DATED : September 29, 1987

INVENTOR(S) : KEISHI SAITOH, ET AL.

It is certified that error appears in the above-identified patent and that said Letters Patent is hereby corrected as shown below:

COLUMN 9

Line 29, "Pd etc." should read --Pd, etc.--.
Line 64, "preferablly" should read --preferably--.

COLUMN 10

Line 9, "so called" should read --so-called--.
Line 26, "be suitably be" should read --suitably be--.

COLUMN 11

Lines 37-38, "so called" should read --so-called--.

COLUMN 12

Line 11, "atoms" should read --atom--.
Line 27, "as" should be deleted.
Line 29, "great" should read --greatly--.

COLUMN 16

Line 9, "so called" should read --so-called--.

COLUMN 17

Line 6, "$siH_2I_2$" should read --$SiH_2I_2$--.

COLUMN 18

Line 47, delete "suitably so deserved depending on".

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 19

Line 9, "so called" should read --so-called--.
Line 27, "be suitably be" should read --suitably be--.

COLUMN 20

Line 19, "so called" should read --so-called--.
Line 24, "so" should read --so---.
Line 43, "(C), and (PN)," should read --(C), and the ordinate the layer thickness of the layer region (PN),--.
Line 49, "toward side" should read --toward--.

COLUMN 21

Line 54, "shown" should read --shown in--.

COLUMN 22

Line 26, "Typical" should read --As typical--.

COLUMN 25

Line 2, "$C_{17}$ position" should read --$C_{17}$ at the position--.

COLUMN 26

Line 44, "acetyllene" should read --acetylene--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 27

Line 28, "should" should read --is--.
Line 60, "CvD" should read --CVD--.

COLUMN 28

Line 47, "contaiing" should read --containing--.

COLUMN 29

Line 57, "are" should read --is--.

COLUMN 30

Line 46, "1161" should read --1162--.
Line 51, "introduced" should read --was introduced--.

COLUMN 31

Line 22, "(condition" should read --(Condition--.

COLUMN 32

Line 31, "(Sylinder" should read --(Cylinder--.

UNITED STATES PATENT AND TRADEMARK OFFICE

CERTIFICATE OF CORRECTION

DATED : September 29, 1987

INVENTOR(S) : KEISHI SAITOH, ET AL.

It is certified that error appears in the above-identified patent and that said Letters Patent is hereby corrected as shown below:

COLUMN 34

Line 34, "monenitrogen oxide" should read --nitrogen monoxide--.
Line 54, "1161" should read --1162--.
Line 62, "134" should read --1134--.

COLUMN 35

Line 37, "(condition" should read --(Condition--.

COLUMN 36

Line 34, "1.2 μum," should read --1.2 μm,--.

COLUMN 38

Line 32, "requlators" should read --regulators--.
Line 32, "hydroqen" should read --hydrogen--.
Line 33, "($SiH_4$bomb 1163" should read --($SiH_4$) bomb, 1163--.
Line 54, "1161" should read --1162--.

COLUMN 39

Line 29, "(condition" should read --(Condition--.
Line 37, "depositting" should read --depositing--.
Line 41, "(condition" should read --(Condition--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 42

Line 41, "electrography" should read --electrophotography--.
Line 59, "outerdiameter" should read --outer diameter--.

COLUMN 43

Line 15, "ayer" should read --layer--.
Line 66, "conductor" should be deleted.

COLUMN 44

Line 54, "electrography" should read --electrophotography--.

COLUMN 45

Line 5, "outerdiameter" should read --outer diameter--.

COLUMN 47

Line 39, "outerdiameter" should read --outer diameter--.

COLUMN 48

Lines 52-53, "the ¶ case" should read --the case--.

COLUMN 51

Line 34, "$R_2H_6$ should read --$B_2H_6$--.
Line 56, "electrography" should read --electrophotography--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 52

Line 7, "outerdiameter" should read --outer diameter--.

COLUMN 53

Line 8, "electrophotograhy" should read --electrophotography--.

COLUMN 54

Line 21, "($HP_{9845}B$)" should read --(HP9845B)--.
Line 40, "$GeH_4$and" should read --$GeH_4$ and--.
Line 59, "$GeH_4$and" should read --$GeH_4$ and--.

COLUMN 55

Line 47, "electrography" should read --electrophotography--.
Line 65, "outerdiameter" should read --outer diameter--.

COLUMN 59

Line 14, "electrography" should read --electrophotography--.

COLUMN 62

Lines 32-33, "electrography" should read --electrophotography--.
Lines 53-54, "pitch (P) 25 m" should read --pitch (P) 25 μm--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 62 (continued)

Line 54, "0.8 S" should read --0.8 μm--.
Line 66, "over" should be deleted.

COLUMN 63

Line 47,"NO" should read --no--.

COLUMN 64

Line 19, "ot" should read --to--.
Line 47, "obaseved" should read --observed--.
Line 65, "1301" should read --1201--.
Line 67, "1303" should read --1203--.

COLUMN 67

Line 7, "imaqes" should read --images--.
Line 38, "outerdiameter" should read --outer diameter--.
Line 47, "(HP9854B)" should read --(HP9845B)--.
Line 56, "vaccum" should read --vacuum--.

COLUMN 68

Line 7, "surface of layer" should read --surface layer--.
Line 34, "Sam-" should read --(Sam---.
Line 40, "member" should read --members--.
Line 52, "member" should read --members--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 69

Line 27, "(HP9854B)" should read --(HP9845B)--.
Line 53, "light- receiving" should read --light-receiving--.

COLUMN 70

Line 7, "jof" should read --of--.
Line 42, "effect" should read --effected--.

COLUMN 71

Line 16, "condictions" should read --conditions--.
Line 30, "Example" should read --in Example--.
Line 36, "member" should read --members--.
Lines 36-37, "electrophotographt" should read --electrophotography--.
Line 41, "101J-122J)" should read --101J-122J--.
Line 52, "alminum" should read --aluminum--.
Line 54, "electrography" should read --electrophotography--.

COLUMN 72

Line 5, "outerdiameter" should read --outer diameter--.
Line 31, "inparallel" should read --in parallel--.
Line 45, "21" should read --26--.
Line 59, "(Cylindrical" should read --(Cylinder--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 73

Line 31, "iamge" should read --image--.
Line 35, "firnge" should read --fringe--.
Line 48, "inthis" should read --in this--.

COLUMN 74

Line 66, "fromed" should read --formed--.

COLUMN 77

Line 5, "0.8 S" should read --0.8 μm--.

COLUMN 81

Line 41, "nm" should read --nm,--.

COLUMN 82

Line 5, "electrography" should read --electrophotography--.
Line 23, "outerdiameter" should read --outer diameter--.
Lines 25-26, "for electrophotography" should read --for electrophotography were prepared following the procedures and--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 84

Line 26, "member" should read --members--.
Line 32, "interference characteristics." should read --interference fringe pattern observed, exhibiting practically satisfactory characteristics.--.
Line 61, "exporure" should read --exposure--.

COLUMN 86

Line 5, "(HP9845)" should read --(HP9845B)--.

COLUMN 87

Lines 51-52, "(sample Nos. 101A-122N)" should read --(Sample Nos. 101N-122N)--.

COLUMN 88

Line 20, "outerdiameter" should read --outer diameter--.
Line 29, "$CeH_4$," should read --$GeH_4$,--.

COLUMN 89

Line 20, "2.2 μm)." should read --2.2 μm.--.
Line 21, "cross-section" should read --cross-sections--.
Line 22, "electrography" should read --electrophotography--.
Line 28, "os" should read --of--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 91

Line 8, "Sampl" should read --Sample--.
Line 8, "162" should read --161--.

COLUMN 92

Line 31, "$B_2H_b/H_2$" should read --$B_2H_6/H_2$--.

COLUMN 94

Line 42, "(HP9854P)" should read --(HP9845P)--.

COLUMN 95

Line 4, "sme" should read --same--.
Line 46, "menas" should read --means--.

COLUMN 96

Line 7, "sane" should read --sand--.

COLUMN 97

Table 5A, "407A" should read --407A--.

| | |
|---|---|
| 2.1 | 2.1 |
| 0.51 | 0.51 |
| 2.6 | 26 |

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 101

Table 5C, "$B_2H_6$ 0.24" should read
--

| | | | | |
|---|---|---|---|---|
| | $B_2H_6$ | 0.24-- | | |
| Photosensitive layer | $H_2$ | 300 | 300 | 20 |
| | $SiH_4$ | 300 | | |
| | Ar | 100 | 300 | 0.359 |
| Surface layer | $Al_2O_3$ target | | | |

COLUMN 102

Table 8C, " ○ Practically excellent" should read
-- ⊙ Practically excellent--.

COLUMN 103

Table 15C, "Second $SiH_4He$ = 0.05" should read
--Second $SiH_4/He$ = 0.05--.

COLUMN 103

Table 16C, "Second $SiH_4He$ = 0.05" should read
--Second $SiH_4/He$ = 0.05--.

COLUMN 111

Table 11F, "layer 5 4 50" should read
--layer $GeH_4$ 50--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 114

Table 3G, "$10^{-}$G" should read --103G--.

COLUMN 115

Table 6G, "$B_2H_6/H_2$ = 3000 100"
ppm $GeH_4$ = $SiH_4$
=100 should read --$B_2H_6/H_2$ = 100"
3000ppm $GeH_4$ + $SiH_4$ =
100

Table 8G, "Layer Gas flow rate"

| constitution | Starting gas | (SCCM) |
|---|---|---|
| First | $H_2$ | 300 |
| layer $GeH_4$ | 50 → 0 | |
| $SiH_4$ | 50 → 100 | |

should read --Layer Gas flow rate--

| constitution | Starting gas | (SCCM) |
|---|---|---|
| | $H_2$ | 300 |
| First | $GeH_4$ | 50 → 0 |
| layer | $SiH_4$ | 50 → 100 |

COLUMN 122

Table 6I, " 50 → 100" should read -- 50 → 100--.
300 300
100
100 100
100 → 0 100 → 0

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 136

Table 10L, "0.0123" should read --0.123--.

Table 12L, "Second layer Layer A $H_2$ 300 300"
should read --Second layer Layer A $H_2$ 300 300--

COLUMN 137

Table 13L, " Deposition" should read -- Deposition--.

| rate (Å/sec) | rate (Å/sec) |
|---|---|
| 10 | 10 |
| | 8 |
| 24 | 24 |
| 1 | 1 |

COLUMN 139

Table 2M, "X X ◎ ◎ ◎ ○ △ X" should read
--X X ○ ◎ ◎ ◎ △ X--.

Table 2M, " ○ Practically excellent" should read
--◎ Practically excellent--.

COLUMN 141

Table 5M, "Gas flow rate" should read --Gas flow rate--.

| (SCCM) | (SCCM) |
|---|---|
| 300 | 300 |
| 100 → 0 | 100 → 0 |
| 100 → 0 | 0 → 100 |

UNITED STATES PATENT AND TRADEMARK OFFICE

CERTIFICATE OF CORRECTION

DATED : September 29, 1987

INVENTOR(S) : KEISHI SAITOH, ET AL.

It is certified that error appears in the above-identified patent and that said Letters Patent is hereby corrected as shown below:

COLUMN 141 (continued)

Table 5M, "GeH + SiH = 100" should read --$GeH_4$ + $SiH_4$ = 100--.
Table 6M, "*" should read --⊗-- (each occurrence).
Table 7M, "*" should read --⊗-- (each occurrence).

COLUMN 143

Table 8M, "*" should read --⊗-- (each occurrence).

COLUMN 144

Table 4N, " Deposition" should read -- Deposition--.

| rate (Å/sec) | rate (Å/sec) |
|---|---|
| 10 | 14 |

COLUMNS 145-147

Table 9N, "*" should read --⊗-- (each occurrence).

COLUMN 147

Table 10N, "*" should read --⊗-- (each occurrence).

COLUMN 148

Table 3P, " ○ Practically excellent" should read --◎ Practically excellent--.
Table 1P, "TABLE 1P" should read --TABLE 4P--.

UNITED STATES PATENT AND TRADEMARK OFFICE

CERTIFICATE OF CORRECTION

DATED : September 29, 1987

INVENTOR(S) : KEISHI SAITOH, ET AL.

It is certified that error appears in the above-identified patent and that said Letters Patent is hereby corrected as shown below:

COLUMN 149

Table 1P, "TABLE 1P-continued" should read --TABLE 4P-continued--.
Table 6P, "*" should read --※-- (each occurrence).

COLUMN 151

Table 9P, "*" should read --※-- (each occurrence).
Table 10P, "*" should read --※-- (each occurrence).
Table 11P, "*" should read --※-- (each occurrence).

COLUMN 153

Line 52, "claim 8," should read --claim 7,--.
Line 53, "whthin" should read --within--.
Line 54, "substrae." should read --substrate.--.
Line 59, "direciton." should read --direction.--.

COLUMN 154

Line 12, "surface" should read --surface.--.
Line 35, "claim 22," should read --claim 23,--.

COLUMN 155

Line 24, "TB/T≦1." should read --$T_B/T \leqq 1$.--.
Line 27, "light-receiving" should read --a light-receiving--.
Line 31, "materal" should read --material--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 155 (continued)

Line 34, "funciton" should read --function--.
Line 58, "claim 44," should read --claim 43,--.

COLUMN 156

Line 3, "claim 45," should read --claim 49,--.
Line 13, "52, the" should read --52, wherein the--.
Line 14, "rom" should read --form--.

COLUMN 157

Line 4, "claim claim" should read --claim--.

UNITED STATES PATENT AND TRADEMARK OFFICE

CERTIFICATE OF CORRECTION

PATENT NO. : 4,696,883

DATED : September 29, 1987

INVENTOR(S) : KEISHI SAITOH, ET AL.

It is certified that error appears in the above-identified patent and that said Letters Patent is hereby corrected as shown below:

COLUMN 158

Line 28, "accoriding" should read --according--.
Line 40, "claim 67;" should read --claim 35;--.

Signed and Sealed this

Fourth Day of October, 1988

*Attest:*

DONALD J. QUIGG

*Attesting Officer*

*Commissioner of Patents and Trademarks*